US005788500A

United States Patent [19]

Gerber

[11] Patent Number: 5,788,500

[45] Date of Patent: Aug. 4, 1998

[54] CONTINUOUS WAVE LASER BATTLEFIELD SIMULATION SYSTEM

[75] Inventor: Peter Gerber, Berikon, Switzerland

[73] Assignee: Oerlikon-Contraves AG, Zurich, Switzerland

[21] Appl. No.: 565,960

[22] Filed: Dec. 4, 1995

[51] Int. Cl.[6] ..... F41G 3/26

[52] U.S. Cl. ..... 434/22; 434/11; 434/21; 463/51; 455/39; 455/73; 250/208.1; 102/355; 372/25

[58] Field of Search ..... 434/11, 16, 307 R; 364/578; 463/5, 50–52; 340/988; 455/39, 73; 250/203.2, 208.1; 102/355; 342/357; 372/24, 25, 38; 273/371; 89/1.11; 356/152.1–152.3; 359/333, 356

[56] References Cited

U.S. PATENT DOCUMENTS

| | | | |
|---|---|---|---|
| 3,696,248 | 10/1972 | Cunningham et al. | 250/203.2 |
| 3,911,598 | 10/1975 | Mohon | 434/20 |
| 4,487,583 | 12/1984 | Brucker et al. | 434/22 |
| 4,614,913 | 9/1986 | Honeycutt et al. | 359/333 |
| 4,629,427 | 12/1986 | Gallagher | 434/22 |
| 4,695,058 | 9/1987 | Carter, III et al. | 434/22 X |
| 4,934,937 | 6/1990 | Judd | 434/21 |
| 5,198,607 | 3/1993 | Livingston et al. | 89/1.11 |
| 5,215,464 | 6/1993 | Marshall et al. | 434/21 X |
| 5,228,854 | 7/1993 | Eldridge | 434/11 |
| 5,292,254 | 3/1994 | Miller et al. | 434/11 |
| 5,317,582 | 5/1994 | Siebert | 372/38 |
| 5,556,281 | 9/1996 | FitzGerald et al. | 434/21 X |
| 5,571,018 | 11/1996 | FitzGerald | 434/11 X |

*Primary Examiner*—Joe Cheng
*Attorney, Agent, or Firm*—John P. McGonagle

[57] ABSTRACT

An improved battlefield simulation system based upon continuous wave lasers. The system uses continuous wave lasers and high-power light-emitting diodes (LEDs) to simulate weapons. A continuous wave laser energy beam is coded using pulse-code modulation (PCM) and pulse-pause modulation (PPM) so that the agent is uniquely identified, as well as the type of weapon responsible for the light beam. The present system provides improved eye safety, improved sensitivity, improved realism, and improved data transfer.

29 Claims, 49 Drawing Sheets

| FIG. 19A | FIG. 19B | FIG. 19C |
|---|---|---|

INCIDENT LIGHT DETECTED - SOLDIER HIT

DIRECTLY ON DETECTOR

SCATTERED LIGHT DETECTED-SOLDIER HIT

NOT DIRECTLY ON DETECTOR

DIRECT HIT / NEAR HIT AT 100m

CONTINUOUS WAVE LASER BATTLEFIELD SIMULATION SYSTEM

BACKGROUND OF THE INVENTION

The present invention relates generally to battlefield simulation systems, and more particularly to a laser-based battlefield simulation system using continuous wave (CW) lasers. Lasers are referred to, not only in the commonly referred to visible light bandwidth, but also in their more modern generic bandwidth sense, i.e., ultraviolet to infrared.

Battlefield simulation systems are commonly used today by the military of various countries so that military combat practices may be practiced in a safe, but realistic, fashion. Radiation transmitters are commonly utilized for emitting a narrow beam of radiation, the transmitter being mounted to be aimed with the weapon simulated and combined with detector means oriented to a target and hit and miss indicator means in the form or audio or visual signal means.

One of the best known battlefield simulation systems is the Multiple Integrated Laser Engagement System ("MILES") developed for and used by the U.S. Army and Marine Corps. The MILES system uses laser bullets to simulate the lethality and realism of the modern tactical battlefield. Laser transmitters, capable of shooting pulses of coded infrared energy, simulate the effects of live ammunition. The transmitters are attached to and removed from all hand-carried and vehicle mounted direct fire weapons. Detectors located on opposing force troops and vehicles receive the coded laser beam. The MILES decoders then determine whether the target was hit by a weapon which could cause damage (hierarchy of weapons effects) and whether the laser bullet was accurate enough to cause a casualty. The target vehicles or troops are made instantly aware of the accuracy of the shot by means of audio alarms and visual displays, which can indicate a hit or a near miss, but nothing more.

To the best of the present inventor's knowledge, all prior art laser-based battlefield simulation systems use pulse lasers. Pulse lasers have certain inherent problems associated with their use in a simulation environment, such as eye safety, sensitivity, realism, and data transfer.

Pulse lasers are capacitor controlled and due to inherent capacitor-discharging effects, the optical power emitted has strong fluctuations that are usually above 1% and often exceed 10% Furthermore, due to thermal effects such as temperature sensitivity, contact problems, emitting-face effects, etc., the emitted power from a pulse laser can change dramatically over the long term. Not only does the power of the pulse laser vary, but the pulse duration and the time between pulses (chitter from capacitor charging) varies significantly. These effects combine so that it is common for the emitted energy to vary by as much as a factor of two in typical devices. Thus, a pulse laser designed to run in Laser Class 1 (completely eye safe), might often emit pulses exceeding the limits of this class if the design limit is not placed far below the Class limits. Due to stochastic variations and the above-mentioned effects, even factory testing cannot insure that all manufactured pulse lasers will never emit pulses exceeding laser class limits.

Since pulse lasers have inherent jitter problems (that is, the pulse period is not constant), have pulse-power fluctuations (typically several percent), and have large variations in pulse duration (often 50%), the techniques available for attaining maximum detection sensitivity are also limited. Pulse laser based systems use simple algorithms to decide between direct hits and near misses. These decisions are typically based on laser beam received-power measurements. If the received power falls below a certain level, the system registers a near miss, and if the system measures received power above a defined level, then a direct hit is registered. This is not always realistic, however, since other factors can lower the power of the laser beam. For example, the intensity of a laser beam decreases with distance because of beam divergence. Also fog, rain, dirt, smoke, foliage, etc., can lower the intensity of laser beam. Thus, systems based solely on received-power measurements will not react to these effects realistically. Jitter in pulse laser systems will also limit data rates and accuracy to levels below that possible with well designed continuous wave (CW) systems.

SUMMARY OF THE INVENTION

In view of the foregoing disadvantages inherent in the known types of devices now present in the prior art, the present invention provides an improved battlefield simulation system based upon continuous wave lasers. As such, the general purpose of the present invention, which will be described subsequently in greater detail, is to provide a continuous wave laser battlefield simulation system with improved eye safety, sensitivity, realism and data transfer.

To attain this, the present invention provides a system for the control, monitoring and evaluation of simulated battlefield scenarios and military maneuvers. The system uses CW lasers and high-power light-emitting diodes (LEDs) to simulate all types of weapons, including, but not limited to, rifles, pistols, hand grenades, tanks, and land mines. In each case, the weapon is used normally by the soldier and a beam of energy is used to represent the effects of the simulated weapons, be it the firing of a bullet, the explosion of a hand grenade, and so on, as realistically as possible. All participants in the exercise (both personnel and objects such as tanks, aeroplanes, jeeps, trucks, and so on) are outfitted with detectors which register the probable effects (such as direct hit, injury or near miss) on the participant.

The instant invention CW beam of energy is coded so that the agent responsible for the energy beam is uniquely identified, as well as the type of weapon responsible for the laser beam. Rules are defined which facilitate the interpretation of received signals into probable effects. For example, a rifle fired at a tank will be registered as having little or no effect whereas a rifle hit on a soldier will be registered as an injury, kill or near miss, depending on the nature of the hit. By using coded Signals with well-defined rules, the system can simulate all phases of training, including: (i) registering direct hits, near misses, injuries, incapacitation, etc.; (ii) recording all events with time and agent; and (iii) compiling individual and group performance reports.

In order to accomplish these tasks with accuracy and realism, using a laser and LED system which is completely safe for viewing with the naked eye and which is effective through foliage, fog rain, etc., the system uses (CW) lasers. The CW laser energy beam is coded using pulse-code modulation (PCM) and pulse-pause modulation (PPM). These modulation schemes are used because of their high accuracy, immunity to disturbances and noise, and high sensitivity. The present invention simulation system is able to use these modulation schemes because the lasers and light sources used are CW devices. All previous simulation systems have used pulse lasers. The advantages of the present system include improved eye safety, improved sensitivity, improved realism, and improved data transfer. The use of CW lasers with PCM and/or PPM allow data transfer accuracy and rates to be realized which are impossible with systems using pulse lasers.

The CW lasers used in the present invention simulation system have a built-in monitor photodiode which gives a precise measure of the optical power emitted by the laser. This measured optical power is used in a feedback circuit and allows for automatic power compensation, that is, the laser is driven so that the desired power is emitted. This ensures that the maximum amount of power is emitted by the laser while the designated laser class specifications are never exceeded. By properly using the monitor photodiode, correctly used CW lasers can be insured to fall in the proper laser class at all times.

The use of PCM and PPM as encoding techniques allows lock-in and other high-sensitivity techniques to be used in detection. The laser emits its signal with quartz accurate timing, and the receiver also have quartz crystals with corresponding frequencies. Sensitivities are realized by using CW lasers that are impossible for pulse systems to realize. Subnanowatt sensitivities are realized with the present system. This allows an effective range of up to several kilometers.

Because of the extreme sensitivity possible when using present invention CW lasers and modulation techniques, other algorithms are possible for deciding between near miss and direct hit. The current system uses many detectors which allows the system to locate the incident laser beam on the participant, e.g., soldier, or object, e.g., tank. The realism and accuracy of the system is uncompromised by fog, rain, dirt, sand, etc.; only the range will be shortened (since typical ranges of the current system are up to several kilometers versus the much shorter range of 300 meters for prior art pulse laser systems, a reduction of even 50% in the range will have no noticeable effect on simulation exercises).

Because of the high sensitivity of the invention system, it is the first time in the field of laser combat simulation that the laser beam used can have a low divergence. By low divergence is meant a 5 centimeters (cm) spot size at 100 meters (m). Compared to existing systems, such as the MILES system, which have a divergence of approximately 500 cm at 100 m, this is lower by two orders of magnitude, a factor of 100. The present invention 5 cm spot size does not have to hit a sensor. Scattered light on the body of the soldier or tank is enough to trigger a present invention sensor, as will be shown in detail below.

The advantages of a low divergence, i.e., small diameter, laser beam include: (i) The same laser system can be used for night combat fighting; (ii) With a low divergence beam it is possible to point at a particular soldier and identify him; (iii) Low divergence laser beams are also more difficult for "enemy" soldiers to see; (iv) Two soldiers standing close to each other can be clearly distinguished with a low divergence laser beam, a feature especially important in close quarter combat; and (v) A low divergence beam more closely simulates a real gun shot because a real bullet has a divergence variation in flight of approximately 3 cm at 100 m.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE INVENTION

Figure 1:
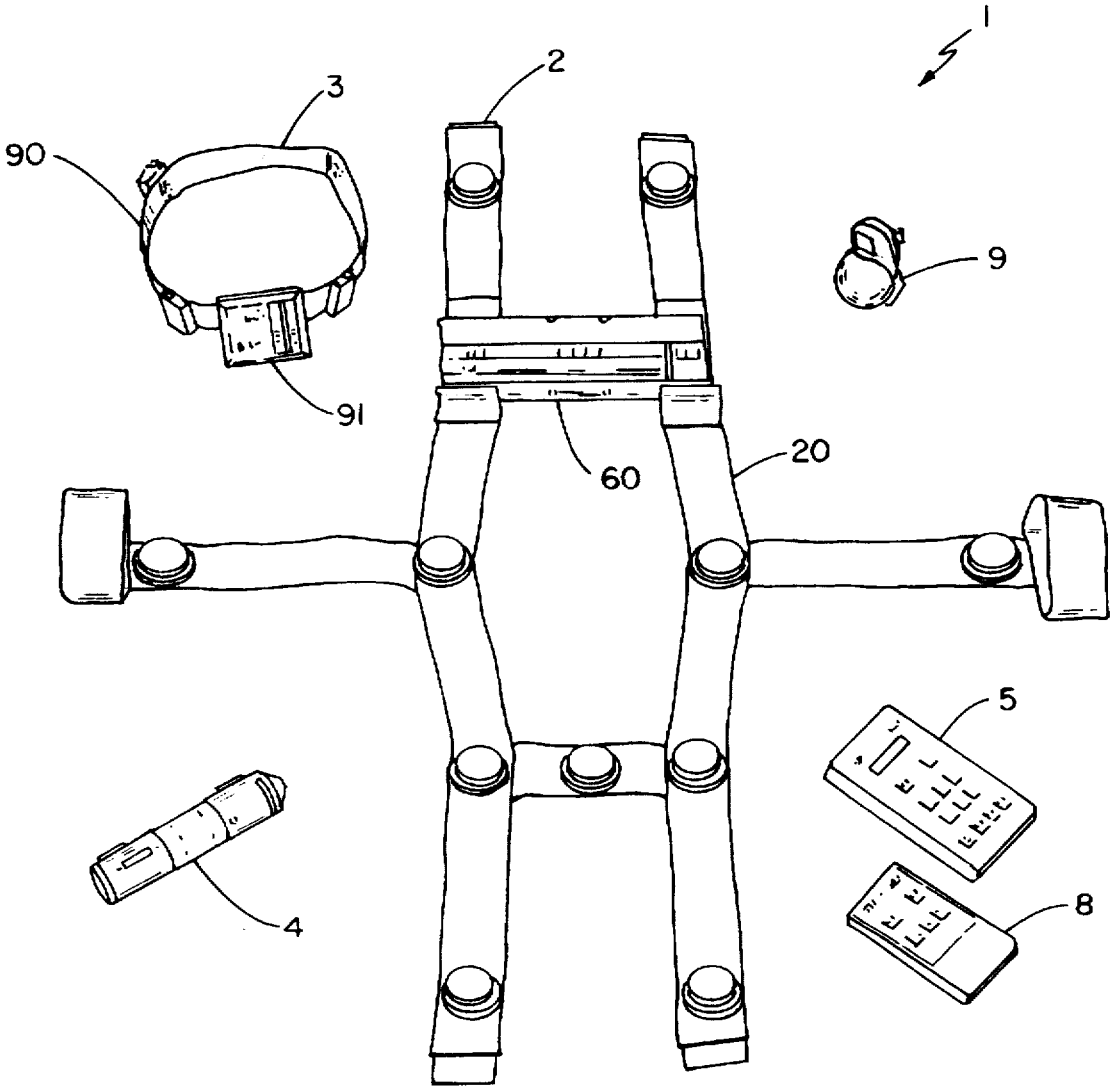
FIG. 1 is a view of the invention components worn or used by a simulation participant.
Figure 3:
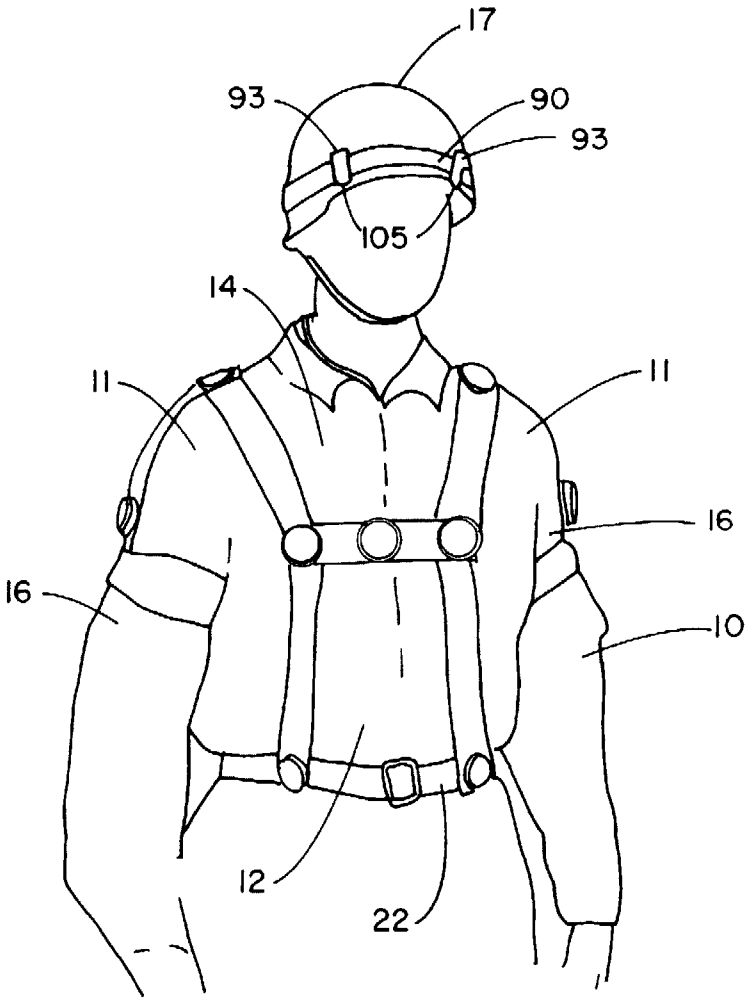
FIG. 3 is a front view of a soldier-participant with the invention components worn during a simulation exercise.
Figure 2:
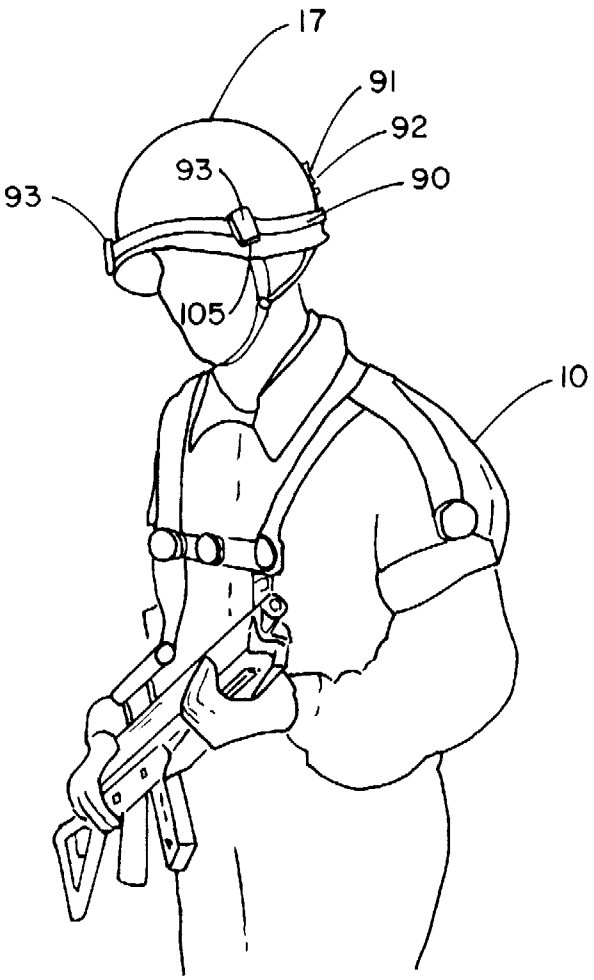
FIG. 2 is a perspective view of the invention components worn and carried by a soldier-participant.
Figure 4:
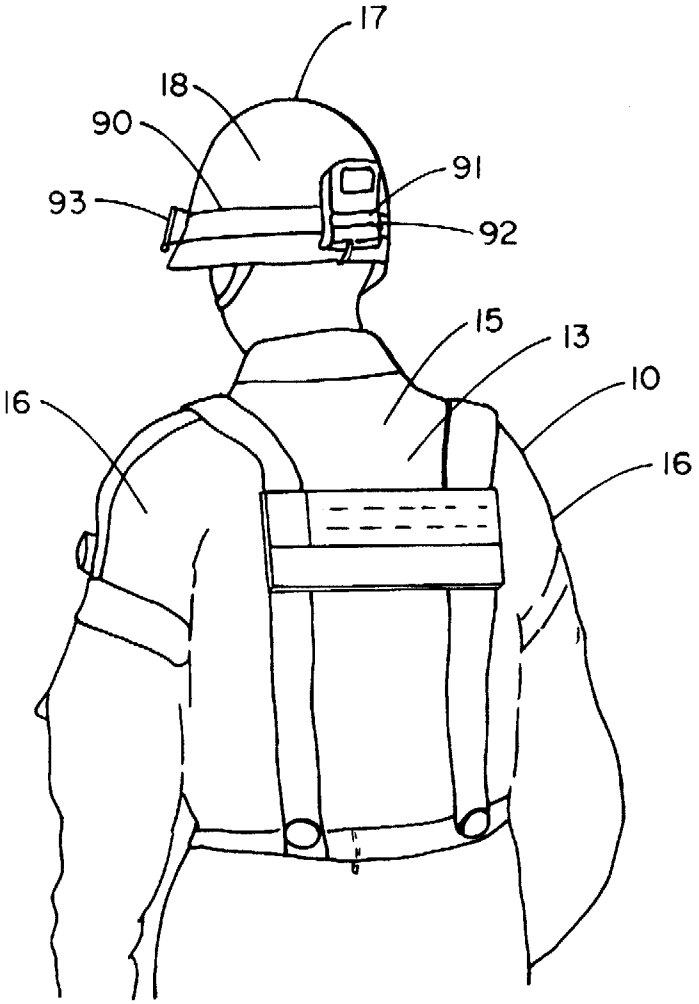
FIG. 4 is a back view of the soldier-participant shown in FIG. 3.

Referring to the drawings in detail wherein like elements are indicated by like numerals, there is shown a continuous wave laser battlefield simulation system 1. The system 1 of the present invention is comprised of the following main assemblies: torso assembly 2, including harness 20, master box 60, detectors 40, and transmitter units 50; helmet assembly 3, including belt 90, main microprocessor subsystem 91, and helmet detectors 93; laser target pointer 4 including CW laser 120, laser triggering mechanism 130, 131, communications receivers 127, 128 and rifle mount 112; umpire unit 5 with microprocessor 143, liquid crystal display 141 and communications subsystem 145; system computer 6 with interface unit 201 and maneuver evaluation software; aiming tool 7 with keyboard 167 for personnel data input; and test box 8. The system 1 of the present invention can be expanded with options such as simulation hand grenades 9, simulation mines, and global positioning system (GPS). FIG. 1 is a view of the main invention components, i.e., torso assembly 2, helmet assembly 3, laser target pointer 4, umpire unit 5, test box 8, and simulation hand grenade 9, carried by a simulation participant. FIGS. 2–4 illustrate the invention components carried or worn by a soldier-participant 10.

The basis of the system 1 is CW laser technology. This is a significant departure from prior art, pulse laser simulation systems. To more clearly illustrate the differences between the CW laser technology of the present invention and the prior art pulse laser technology, FIGS. 5A and 5B contain schematic diagrams of a typical operating CW laser circuit and typical pulse laser circuit, respectively.

Figure 5A:
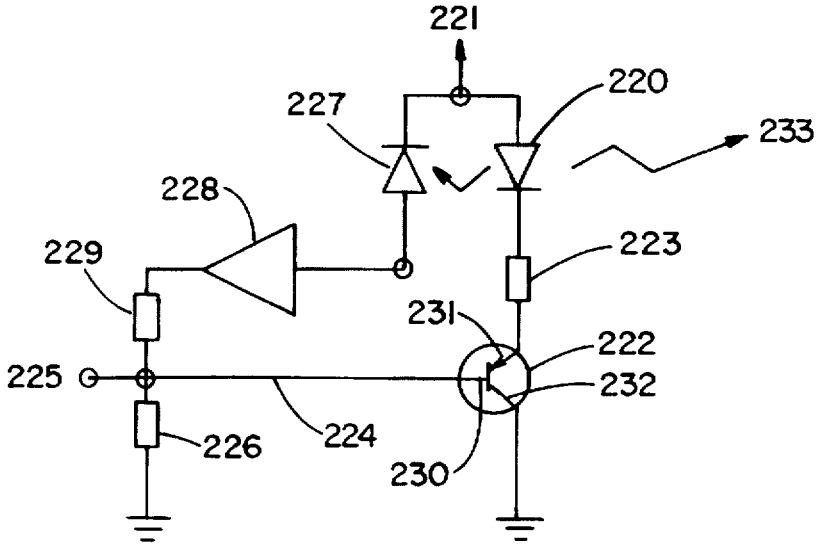
FIG. 5A is a schematic diagram of a CW laser circuit.
Figure 6A:
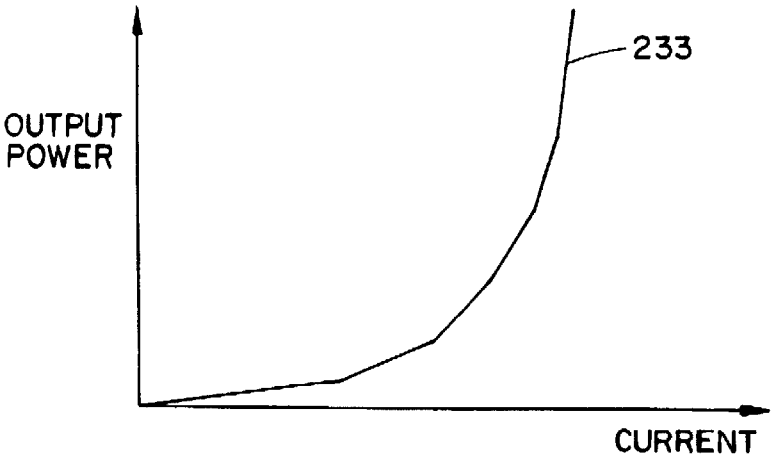
FIG. 6A is a diagram of CW laser output power versus current.
Figure 7A:
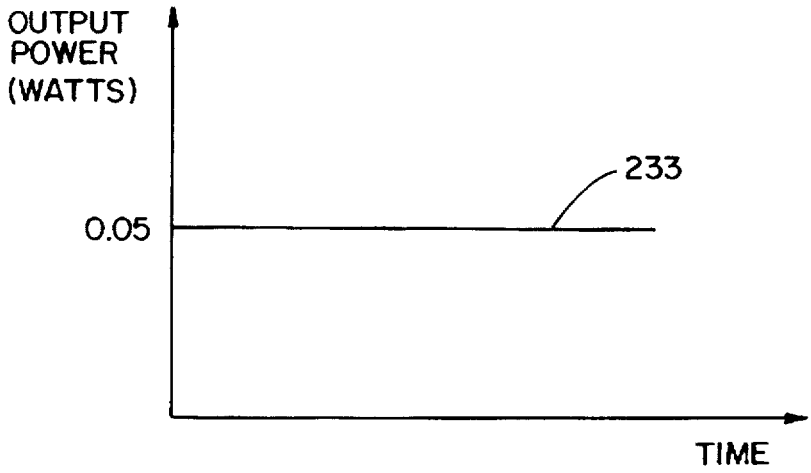
FIG. 7A is a diagram of CW laser with feedback control output power versus time.

Referring to FIG. 5A, the CW laser 220 is driven by a 3 to 5 volt power source 221. The laser 220 is turned on by a transistor 222 in series with a resistor 223 and the laser diode 220. The transistor "on/off" input 224 at the transistor electrode 230 is determined by an external, modulation input 225 across the input resistor 226 which is grounded on one side. The CW laser circuit includes a feedback diode 227. The feedback diode 227 is connected in series to an operating amplifier 228 and feedback resistor 229. The feedback diode subcircuit, comprised of the feedback diode 227, operating amplifier 228 and feedback resistor 229, is connected generally in parallel to the laser diode subcircuit comprising the laser 220 and resistor 223. The feedback diode circuit is connected at one end to the power source 221 and at the other end to the transistor electrode 230. The laser subcircuit is connected at one end to the power source 221 and at the other end to the transistor electrode 231. Transistor electrode 232 is grounded. The purpose of the feedback diode 227 is to control the laser diode 220 output power 233. As current starts flowing through the laser 220, the feedback diode 227 immediately starts controlling the laser output power 233. The laser diode output power 233 is continuous while the transistor 222 is "on" and the power magnitude is a function of the amount of current passed through the diode 220. This can been seen more clearly in FIG. 6A. However, with the feedback diode 227, the amount of current, and therefore the amount of output power can be controlled and held to a desired level. The effect of the feedback control can be seen more clearly in FIG. 7A. With the feedback subcircuit, a desired fixed output power will never be exceeded.

Figure 5B:
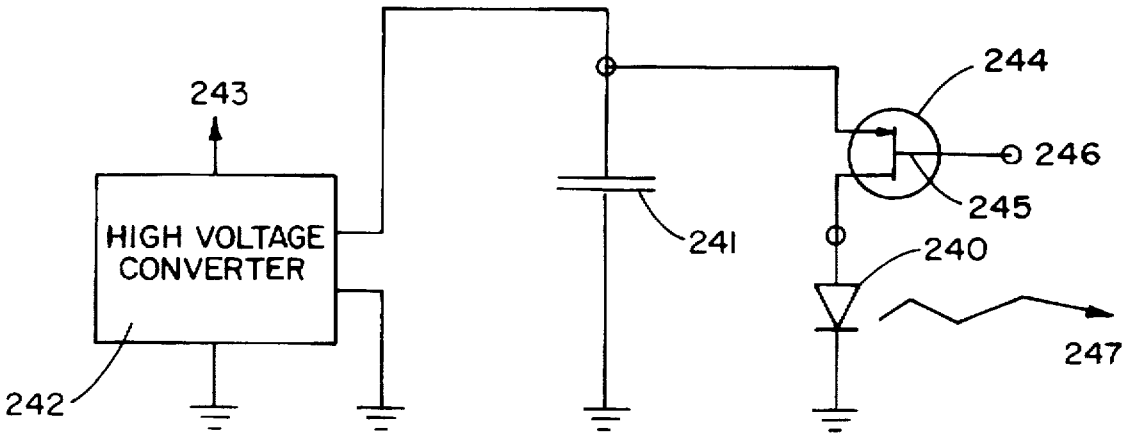
PRIOR ART FIG. 5B
FIG. 5B is a schematic diagram of a pulse laser circuit.
Figure 6B:
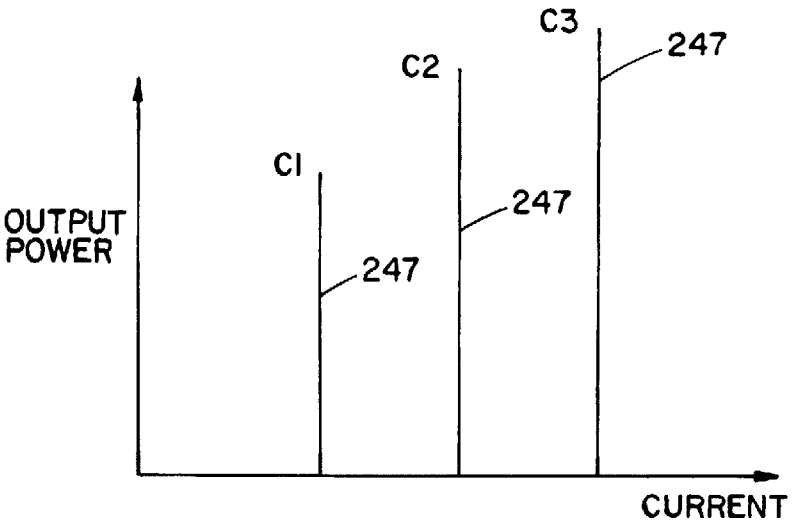
PRIOR ART FIG. 6B
FIG. 6B is a diagram of pulse laser output power versus capacitor size and/or voltage.
Figure 7B:
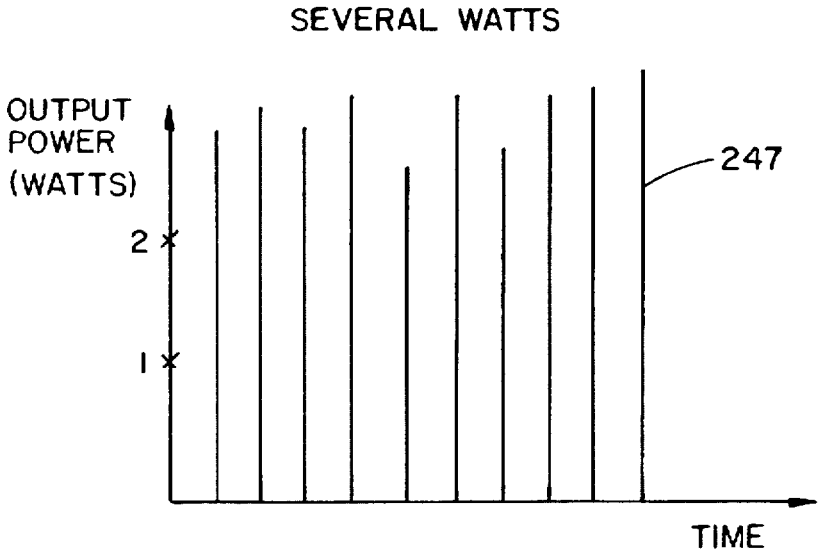
PRIOR ART FIG. 7B
FIG. 7B is a diagram of pulse laser output power versus time.

Referring now to FIG. 5B, the pulse laser 240 is driven by the discharge output of a capacitor 241, i.e., a "pulse" of discharged current from the capacitor 241. The capacitor 241 is initially charged by a high voltage converter 242 which in turn is powered by a 5 volt power supply 243. The pulse laser 240 has a triggering transistor 244 in series with it. The capacitor 241 is connected in parallel with the subcircuit formed by the pulse laser 240 and triggering transistor 244. The high voltage converter 242 puts a 100 volt potential across the capacitor 241. When fully charged the capacitor 241 is ready to be discharged by the transistor 244 across the pulse laser diode 240. The transistor 244 is triggered by an external signal 246 to the transistor electrode 245. The output power 247 from the laser 240 is determined by the size of the capacitor 241 and the voltage from the converter 242. FIG. 6B illustrates the effect of three different size capacitors, C1, C2 and C3. The larger the capacitor ( $C1<C2<C3$ ), the larger is the amount of current discharged through the pulse laser 240, and consequently the greater is the laser power output 247. The pulse laser 240 has no other means to control laser output power 247. The main disadvantages of pulse lasers are caused by the high capacitor voltage discharge (there is a current flow of several amperes) which creates a great deal of noise and electronic instability. Wire size and the soldiering connections required for the high current discharges are critical. See FIG. 7B.

Figure 8A:
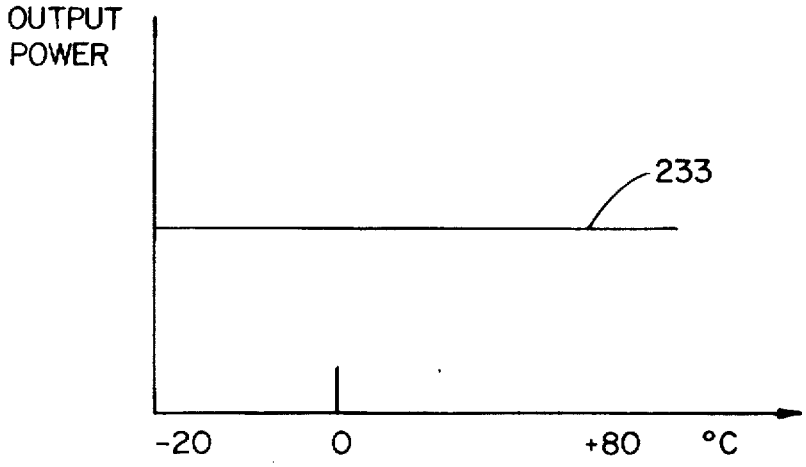
FIG. 8A is a diagram of CW laser output power versus temperature.
Figure 8B:
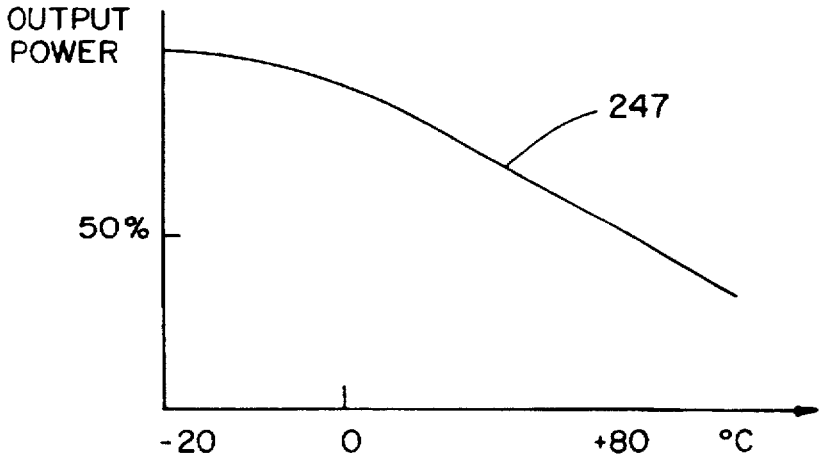
PRIOR ART FIG. 8B
FIG. 8B is a diagram of pulse laser output power versus temperature.

CW lasers are not affected by any temperatures in the normal operation region. The feedback system controls the stability of the output power. See FIG. 8A. However, temperature and modulation frequency have dramatic affects on pulse laser output power. As temperatures rise, pulse laser output power 247 may be halved. Conversely, as temperatures drop, laser output power 247 could double. See FIG. 8B. Increasing modulation frequencies has a similar effect on CW and pulse laser output power. See, also, Table 1 below.

Figure 9A:
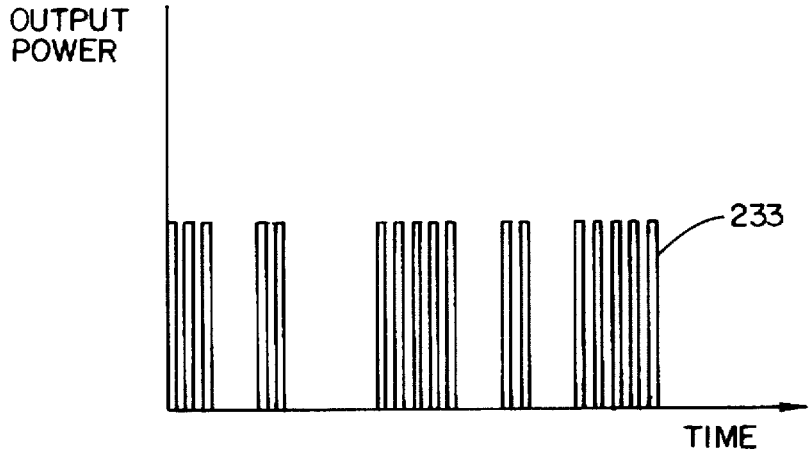
FIG. 9A is a diagram of CW laser modulated output versus time.
Figure 9B:
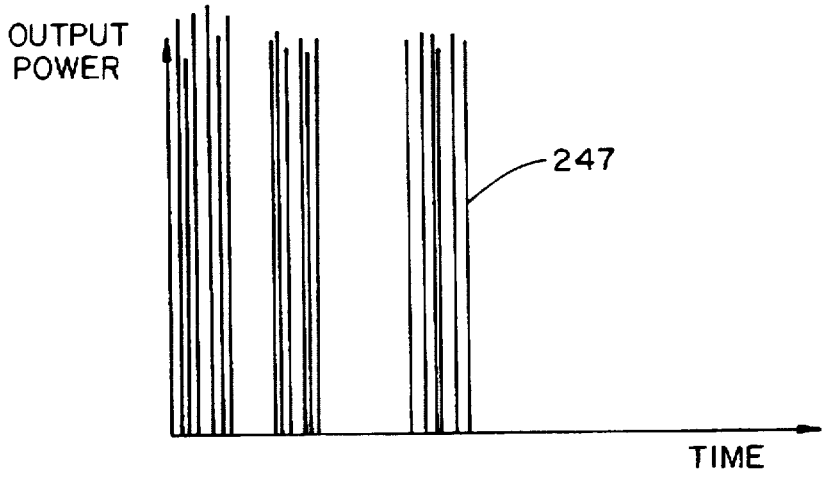
PRIOR ART FIG. 9B
FIG. 9B is a diagram of pulse laser modulated output versus time.
Figure 10:
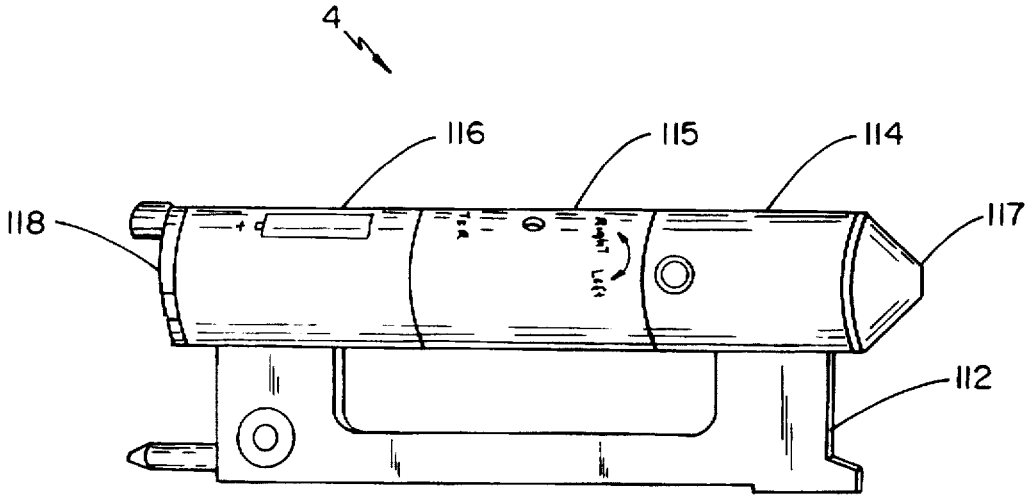
FIG. 10 is a side elevational view of the invention Laser Target Pointer.
Figure 11:
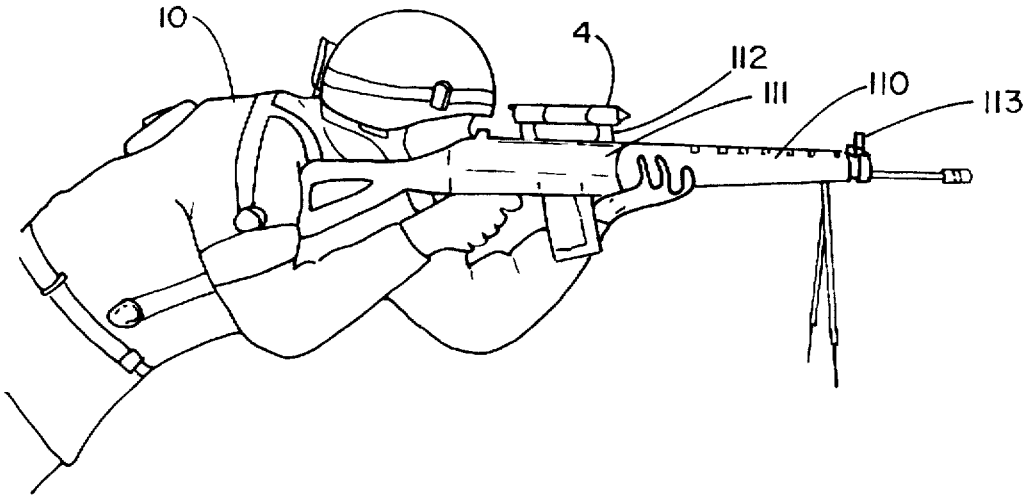
FIG. 11 is a side elevational view of the Laser Target Pointer mounted on a weapon.
Figure 12:
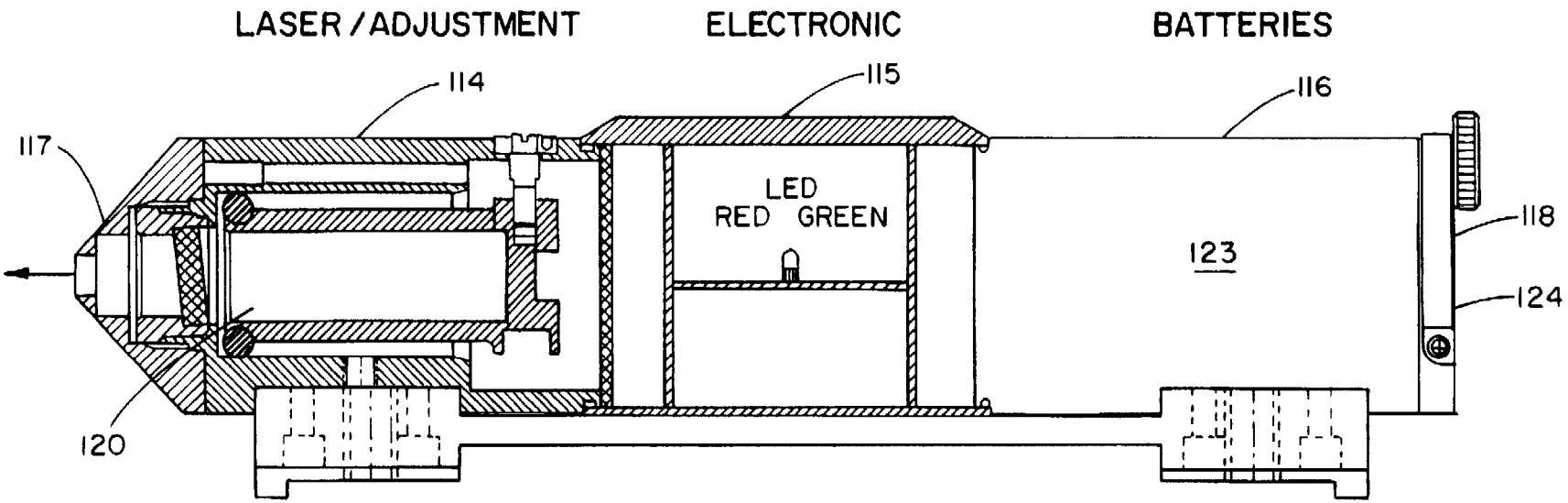
FIG. 12 is a cross section view of FIG. 10.
Figure 13A:
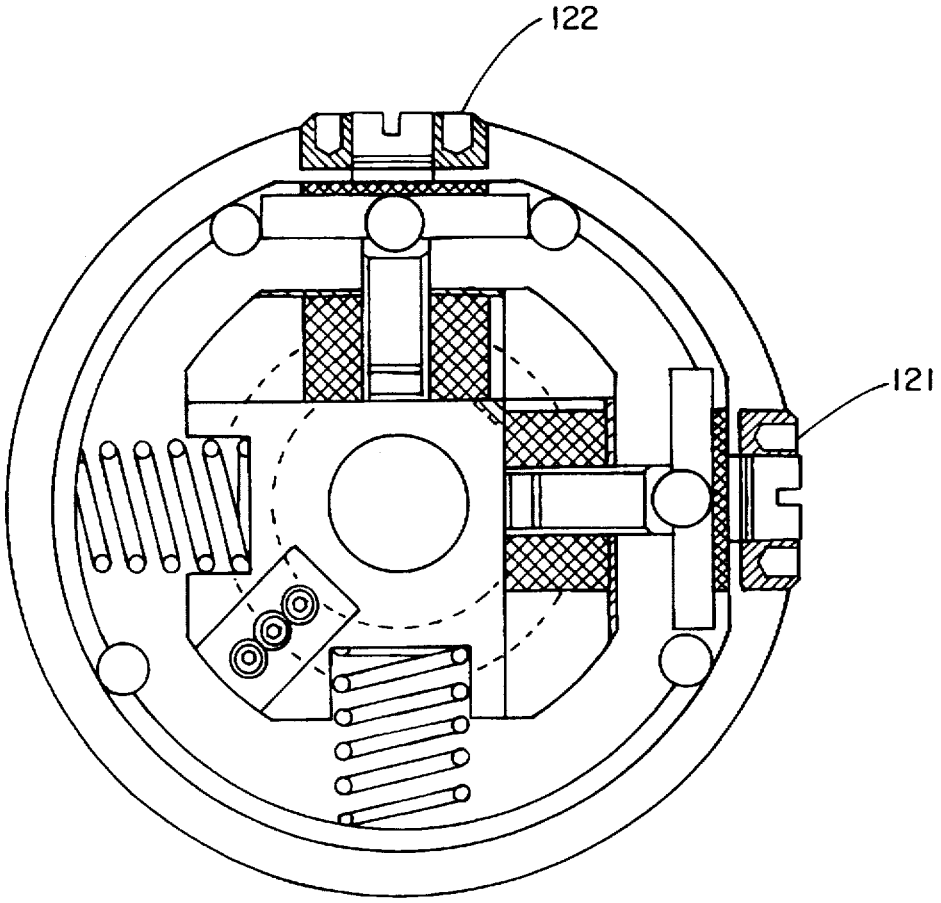
FIG. 13A is a front plan view of the pointer.
Figure 13B:
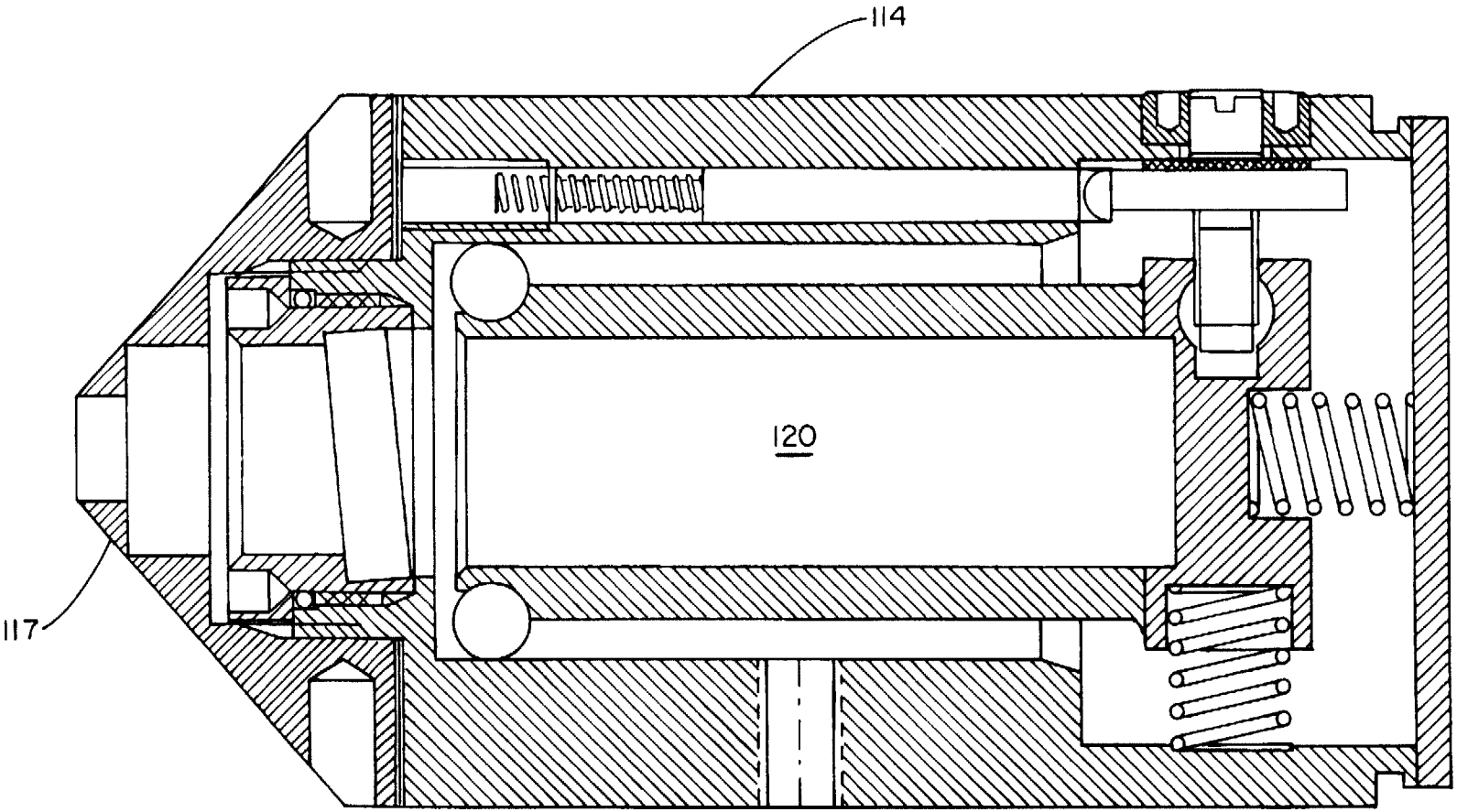
FIG. 13B is a close up cross section view of the Laser Target Pointer front section.
Figure 14:
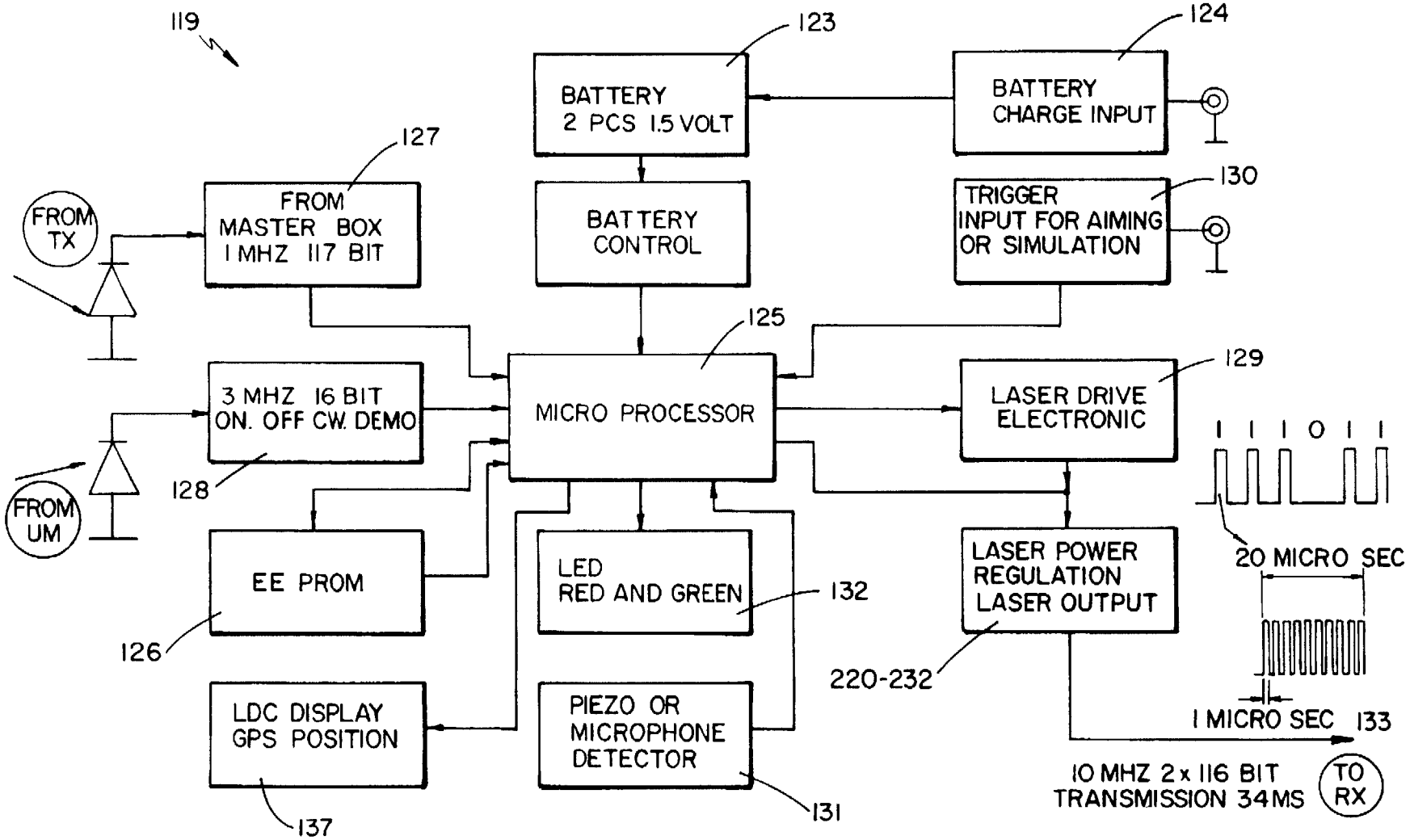
FIG. 14 is a circuit block diagram of the invention laser target pointer.
Figure 15:
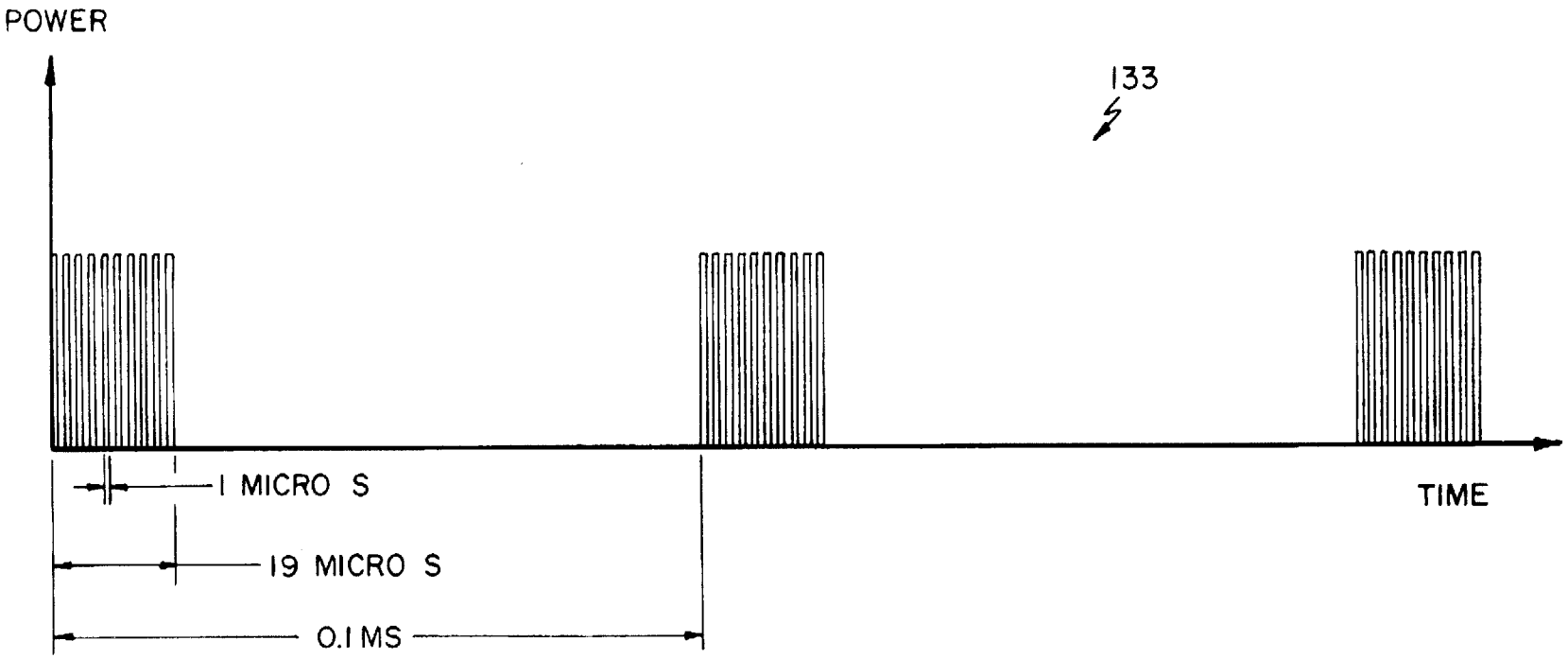
FIG. 15 is a schematic view of the laser beam pulse train outputted from the laser target pointer.
Figure 16A:
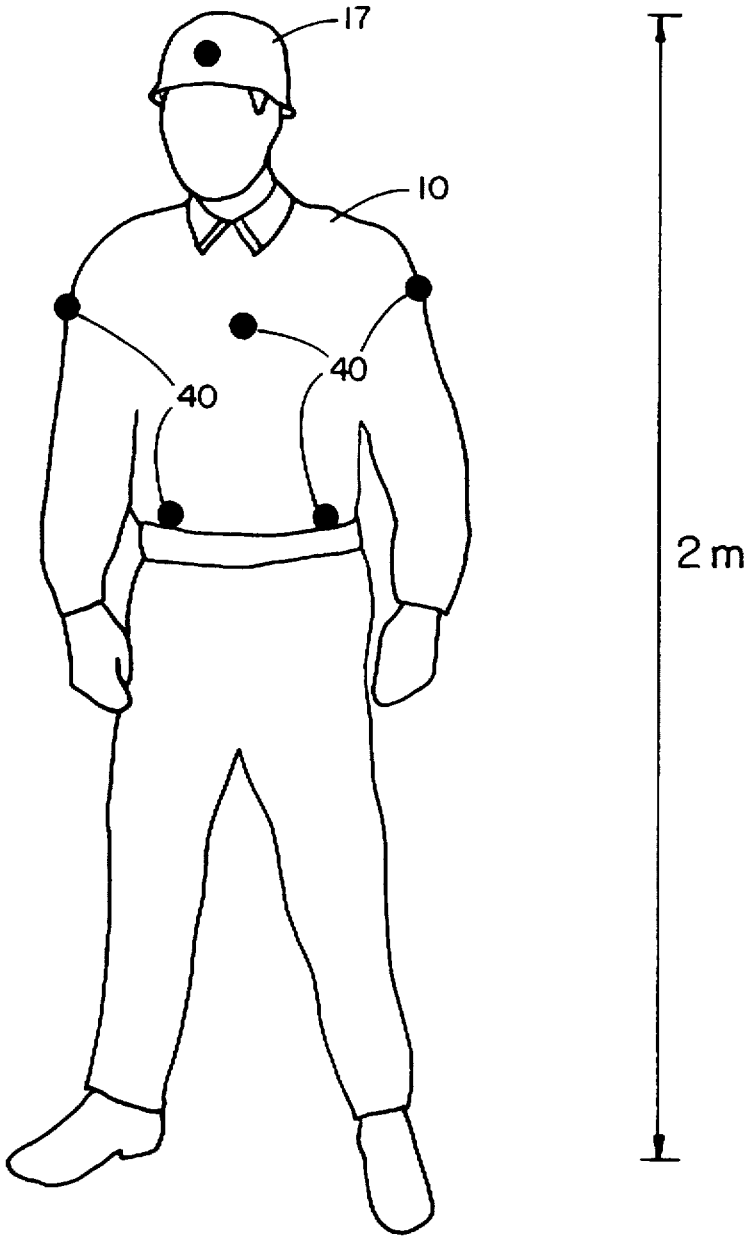
FIG. 16 is a profile of the laser target pointer laser beam at varying distances.
Figure 16B:
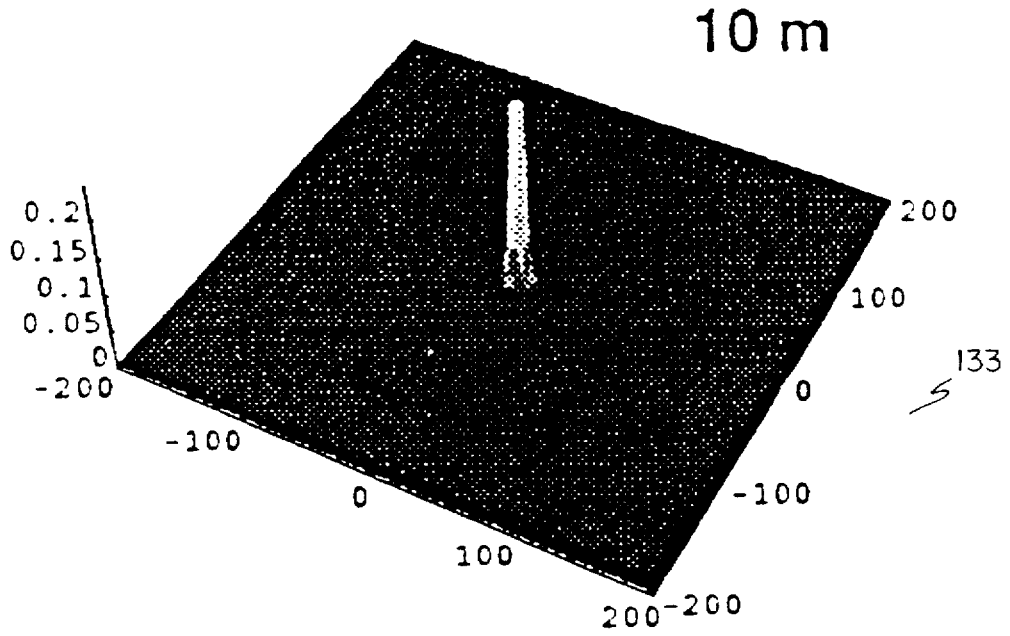
Figure 16C:
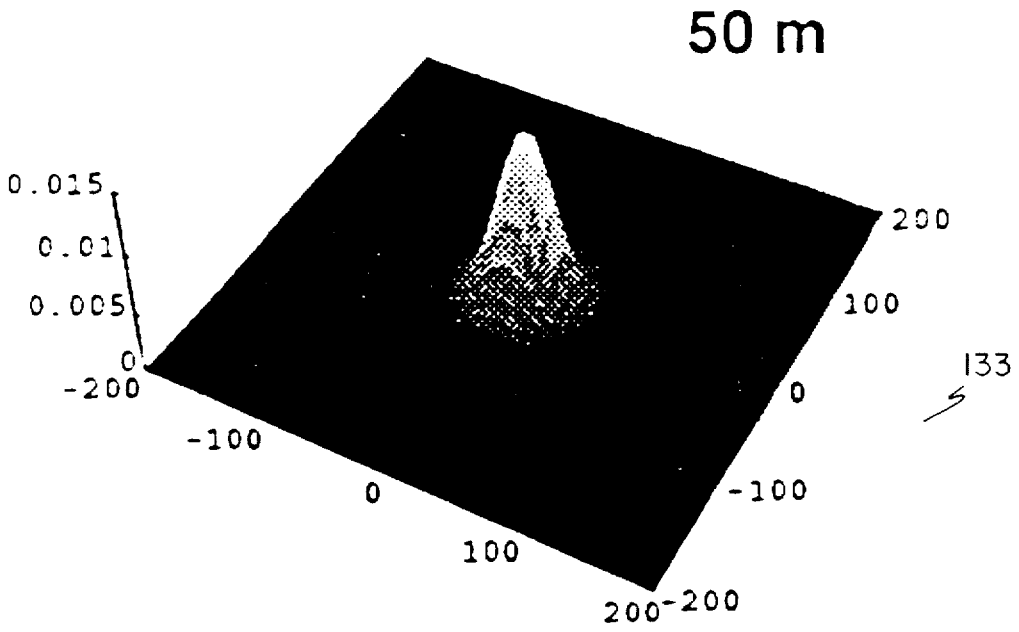
Figure 16D:
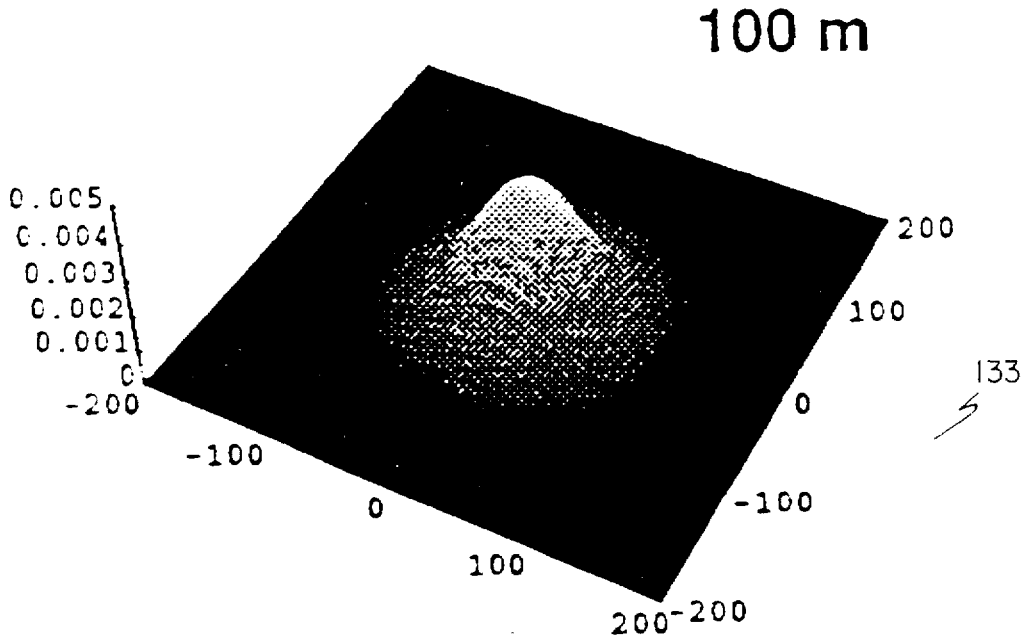
Figure 16E:
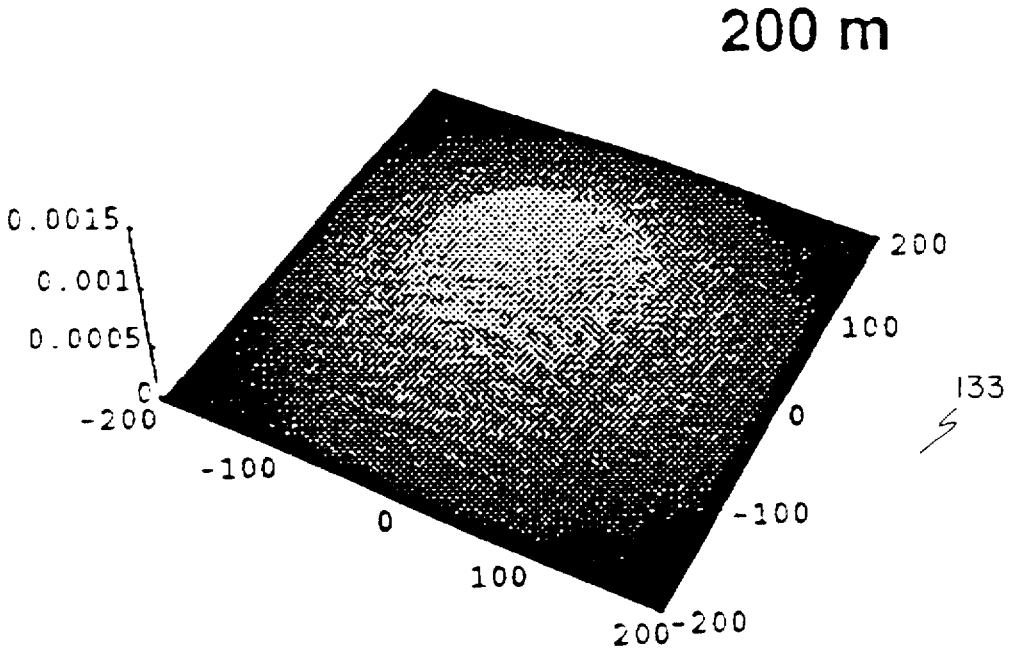
Figure 16F:
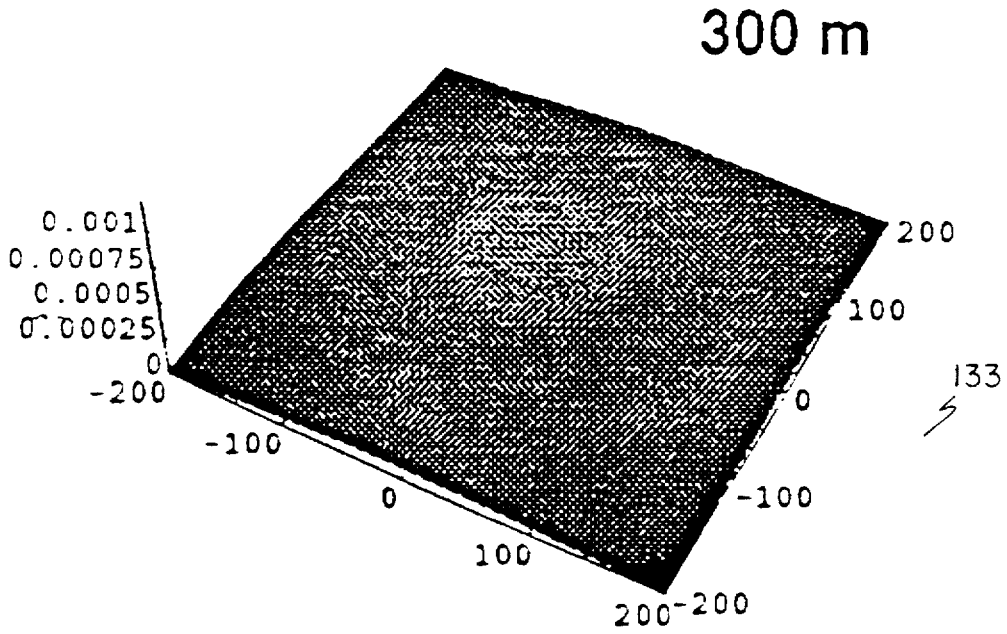
Figure 17:
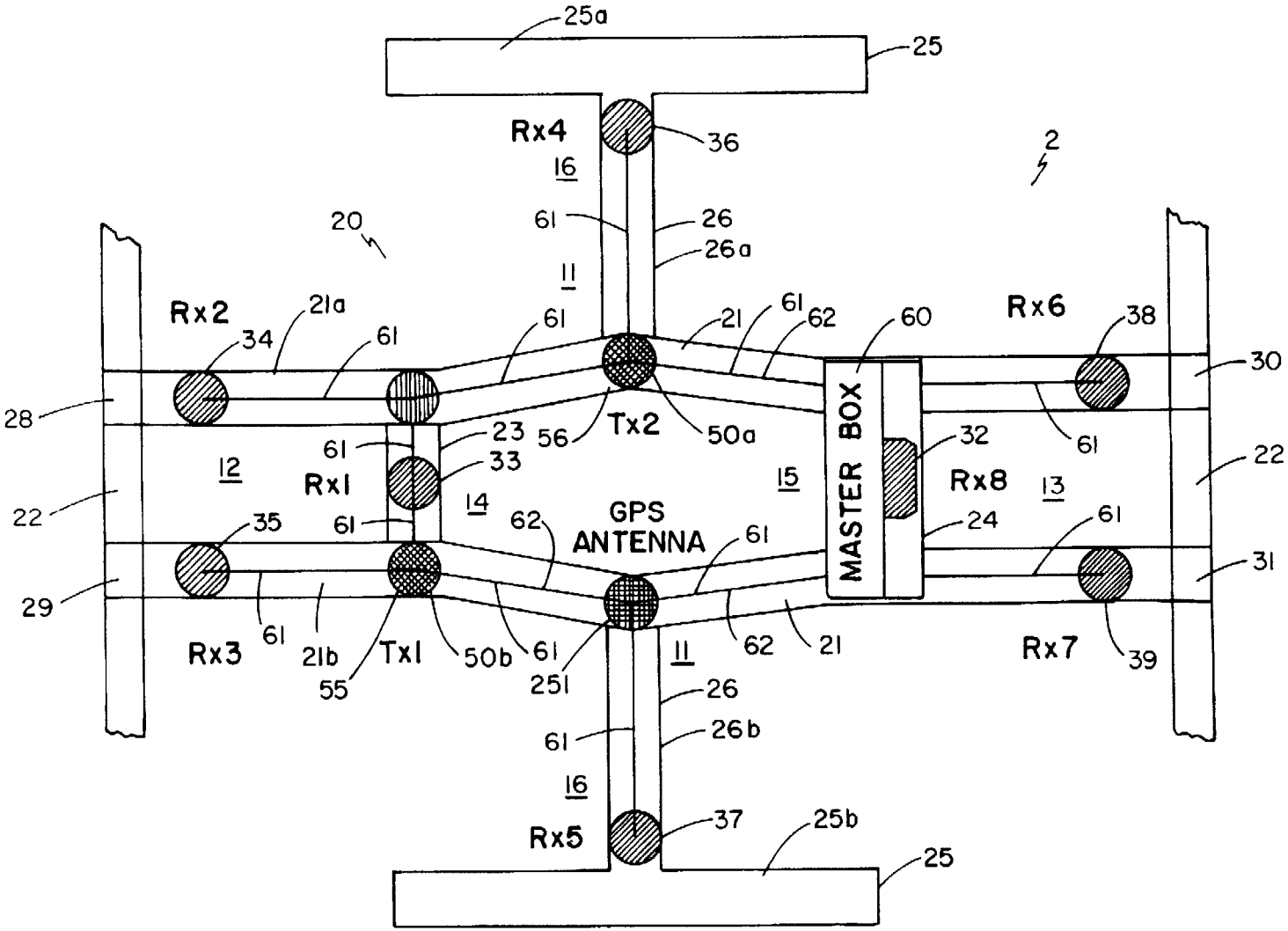
FIG. 17 is a schematic illustration of the torso assembly harness.

The CW laser is a continuous laser and can be turned on and off nearly as fast as wanted. Every pulse follows exactly the modulated, electronic trigger commands. There is no jitter or variation of the pulse duration. See FIG. 9A. The CW laser of the present invention is also extremely accurate with respect to the time between pulses. Because of this, the sensitivity of the present invention detection system (described in detail below) has been increased over prior art systems by several hundred times. One of the biggest problems with prior art pulse lasers is their very high jitter. Because of this, the time between pulses cannot be used for any detection system. Pulse laser based systems must rely exclusively on the detection of peak power. See FIG. 9B.

Table 1, below, lists and compares the optical characteristics of a CW laser and a pulse power laser. In this table W=watts; mW=milliwatts; nm=nanometers; micron=one millionth of a meter; A=amperes; mA=milliamperes; Hz=hertz; kHz=kilohertz; and GHz=gigahertz.

TABLE 1

Laser Optical Characteristics

| Feature | CW Laser | Pulse Laser |
|---|---|---|
| Power | 1 mW to 100 mW | 1 W to 100 W |
| Output Wavelength | 780 nm to 1500 nm | 850 nm to 1000 nm |
| Chip Size | 2 to 7 microns | 50 to 100 microns |
| Operating Current | 100 mA | 10 to 80 Ampere |
| Modulation Bandwidth | 0 Hz to 1 GHz | 1 Hz to 20 kHz |

Table 1 contains data typical of CW lasers and pulse lasers. Since the chip size of a CW laser is no more than half of the pulse laser, it is possible to reduce the laser beam output angle with a good optic to approximately 0.5 millirad (mrad), where a mrad is defined as 1 millimeter at 1,000 millimeters. This means that the beam diameter at 100 m is only 5 cm instead of one meter or more. This allows the invention CW laser to be used also as an aiming device. Output wavelength is also important. Current night vision goggles are sensitive only in the range of 500 nm to a maximum of 880 nm. All laser outputs higher than 880 nm cannot be seen with current night vision goggles. Therefore, the CW laser of the present invention is an ideal night time target recognition device for simulation and real shooting. The substantially greater modulation bandwidth capability of the present invention CW laser, permits far greater information transfer capabilities, as well as providing a vehicle for GPS location and transmission. As the table illustrates, CW lasers are capable of being modulated up to 1 GHz. Pulse lasers will lose more than 50% or their power if they are modulated higher than 50 kHz. The power output of the CW laser is dramatically less than that of a pulse laser system. This insures an eye-safe system with the present invention.

Referring now more particularly to FIGS. 10–16, there is included within the invention system 1 a laser target pointer 4 mounted securely onto a weapon 110 in the same manner as a targeting telescope. The laser target pointer 4 houses the CW laser of the present system 1. The laser target pointer 4 has a front end 117 and a rear end 118 and is divided into three sections. The front section 114 contains a semiconductor CW laser 120 and horizontal 121 and vertical 122 adjustment means. The middle section 115 contains the pointer control electronics 119 described more fully below. The back section 116 of the pointer 4 contains a battery pack 123 comprised of two 1.5 volt AA rechargeable batteries and a battery charge plug 124.

For purposes of exposition, the pointer 4 is mounted on the upper receiver 111 of a standard combat rifle 110. The mount 112 for the laser target pointer 4 has a bore along the gun sight 113 which allows the soldier-participant 10 to aim at a target in the usual manner. The pointer 4 is mounted near the center of mass of the weapon 110, thus the balance of the weapon 110 is unaltered.

The laser pointer control electronics 119 includes a microprocessor 125 with EE PROM 126. The middle section 115 also contains two receivers 127, 128 electrically connected to the microprocessor 125. One receiver 127 receives instructions and data from a torso assembly master box 60 via a transmitter unit 50 in the torso assembly 2. In this embodiment of the invention 1 the master box 60 will transmit to the laser pointer 4 a signal modulated at 2 MHz and containing a 117-bit code comprised of a 16-bit soldier identifier, a 4-bit weapon code, and 3×32-bit GPS codes. The other receiver 128 receives instructions and data from an umpire unit 5 and/or test box 8. In this embodiment of the invention 1, the umpire unit 5 and/or test box 8 will transmit to the laser pointer 4 a signal modulated at 3 MHz and containing 16 bits of code comprised of an "on/off" command or continuous wave operation, or demonstration soldier identifier. The microprocessor 125 is electrically connected to and monitors the signals from the receivers 127, 128, provides pulse coding to a laser driver 129, generates a laser firing trigger from the trigger input 130 or trigger detector 131, drives the LED display 132, drives and optional display 137. The pointer, built-in LED display 132 is used to indicate pointer status. A red or green blinking LED warns of a low battery. A red LED indicates the power is turned on, and a green LED indicates that the pointer 4 is free to be fired. The soldier-participant 10 can fire his weapon 110, and thereby trigger the laser pointer 4, using several options. One option uses a piezoelectric sensor 131 built into the pointer 4, which instructs the microprocessor 125 to "fire" the laser when one pulls the trigger of the weapon 110. The "click" made by the firing pin when the trigger is pulled activates the sensor 131. Another option uses a microswitch 130 which instructs the microprocessor 125 to "fire" the laser when the microswitch 130 is pushed.

The pointer laser output beam 133 generates a coded, 17 millisecond, modulated CW laser beam with superimposed pulse packet for each shot when the firearm 110 with pointer 4 is aimed and fired at an "enemy" soldier-participant 10. See FIGS. 14 & 15. The beam 133 contains a short train of microsecond-long pulses in the near infrared. The laser beam may have a wavelength in the 780 nm to 2 μm (micrometer) range and emits trains of pulses, each one microsecond in duration. The entire pulse packet has a duration of 17 milliseconds and the emitted energy is 20 nanojoules (nJ). In this embodiment of the invention, the laser beam 133 contains two 116-bit words modulated at 10 MHz. The laser target pointer 4 belongs in Laser Class 1. The laser beam output 133 has a divergence of approximately 0.5 mrad and an effective range from 0 to over 4 miles. The laser beam output 133 from the pointer 4 enlarges at a rate of 5 cm per 100 m distance. See FIG. 16. This corresponds roughly to the scatter area of most weapons. The laser used in the present invention 1 is certified as Laser Class I and is completely safe for direct viewing.

Since CW laser technology is being used, PCM and PPM encoding may be used on the laser energy beams. The detector microprocessors 44, 96 described below can be programed to respond to certain codes and/or groups of codes, thereby filtering out extraneous signals and noise. The coding techniques allow the user to determine exactly who "shot" whom and where. Pulse lasers cannot provide this ability because of pulse noise from switching ("chatter"). The encoding techniques permitted by the CW lasers used, keeps the laser output within class 1 tolerances while still obtaining ranges of up to six miles. The system 1 would nominally operate with laser strengths of approximately 50 milliwatts.

The laser target pointer 4 is in constant communication with the soldier-participant's master box 60. If the soldier-participant 10 is "killed" or otherwise deactivated, then the laser target pointer 4 will not "fire." The laser target pointer 4 may be turned on and off by an optical signal from either the umpire unit 5 or the test box 8.

The torso assembly 2 of the present invention 1 includes a harness 20, master box 60, detectors 40, and two transmitter units 50, which are shown in detail in FIGS. 1–4, and 17–20. The torso assembly harness 20 is made of webbing material which resembles the military standard-issue load-carrying lift harness and is worn by each soldier-participant 10. As may be most clearly understood from FIG. 17, the harness 20 is comprised of two suspenders 21 positioned over the shoulders 11 of a soldier-participant 10. The suspenders 21 engage a waist belt 22 worn by the soldier-participant 10 each suspender 21 beginning at the waist belt 22 portion on the soldier-participant's front 12 and terminating at the waist belt 22 portion on the soldier-participant's lower back 13. The suspenders 21 are further engaged by two horizontal support straps, one 23 interconnecting the suspenders 21 across the soldier-participant's chest 14 and the other 24 interconnecting the suspenders 21 across the soldier-participant's upper back 15. The harness 20 is further comprised of two upper arm bands 25, each one fitted over an upper arm 16 of the soldier-participant 10. Each upper arm band 25 is connected by means of a connecting strap 26 to the nearest suspender 21 at the soldier-participant's shoulder 11.

In this embodiment of the invention, seven detectors (collectively and generally referred to by the reference numeral 40) are attached to the torso assembly harness 20. The first detector 33 is attached to the center of the front horizontal support strap 23. The second detector 34 is attached to the right suspender 21*a* near to the front junction 28 of right suspender 21*a* and the waist belt 22. The third detector 35 is attached to the left suspender 21*b* near to the front junction 29 of the left suspender 21*b* and the waist belt 22. The fourth detector 36 is attached to the right connecting strap 26*a* near to the right upper arm band 25*a*. The fifth detector 37 is attached to the left connecting strap 26*b* near to the left upper arm band 25*b*. The sixth detector 38 is attached to the right suspender 21*a* near to the back junction 30 of the right suspender 21*a* and the waist belt 22. The seventh detector 39 is attached to the left suspender 21*b* near to the back junction 31 of the left suspender 21*b* and the waist belt 22. The torso assembly 2 has an eighth detector 32 mounted on the back of the master box 60 attached to the harness rear horizontal support strap 24. In alternative embodiments, the master box 60, itself, may replace the rear horizontal support strap 24 in its entirety.

Figure 18:
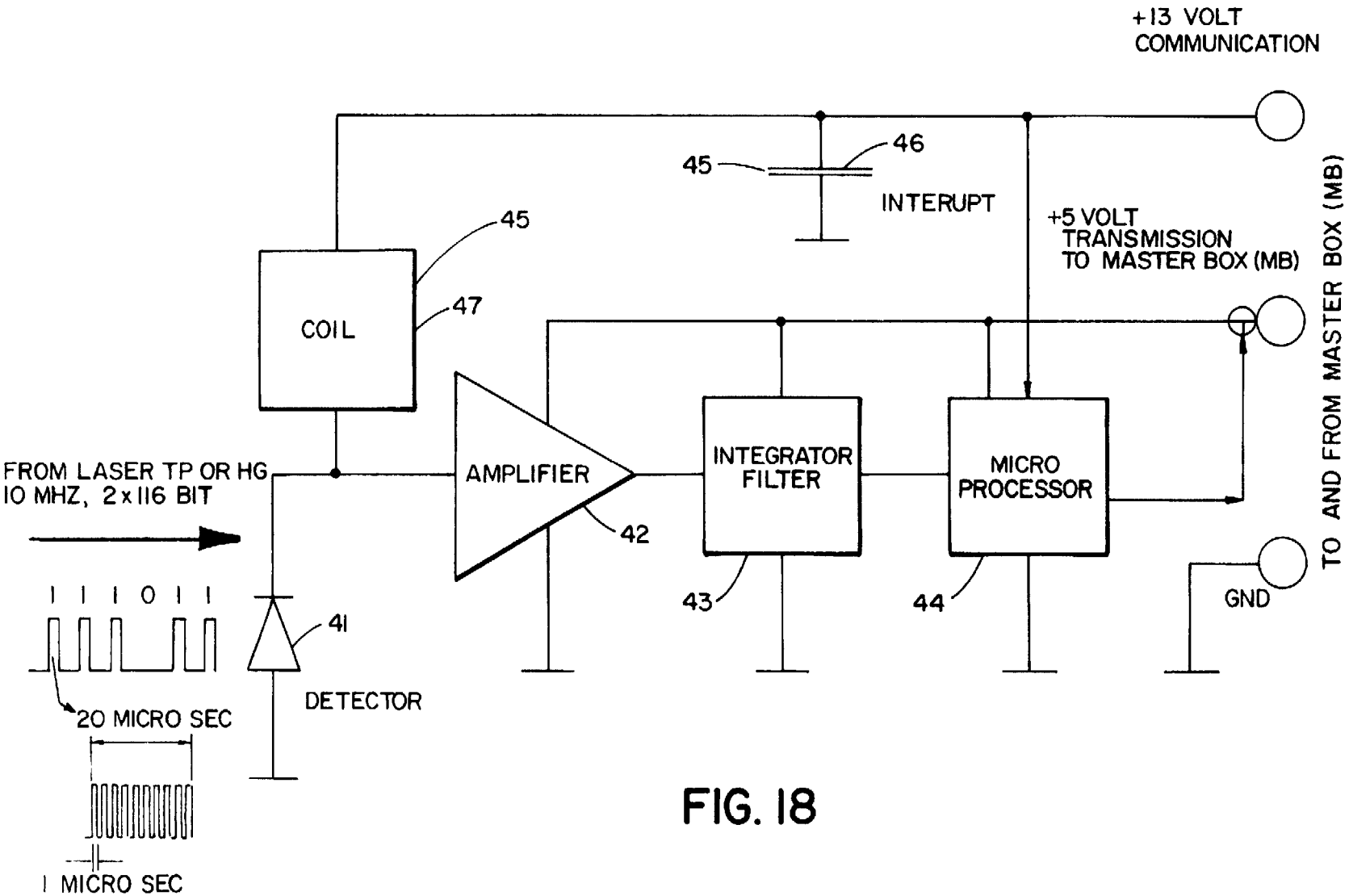
FIG. 18 is a circuit block diagram of a torso assembly receiver-detector.

Referring particularly to FIG. 18, the torso assembly detectors 40 each contain a microprocessor 44 which is programed to look for the specific laser beam packet 133 being fired. In this embodiment of the invention 1, each detector is programed to detect two 116-bit words modulated at 10 MHz. The generated laser beam output 133 can be shaped in any desired format as will be described more fully below. The detectors 40 do not require direct hits to detect a fired signal 133. Each detector 40 is electronically comprised of a detector component 41, the output of which is passed to an amplifier 42, through an integrator filter 43 into the detector microprocessor 44. The detector electronics includes a frequency sensitive tank circuit 45 comprised of a capacitor 46 and coil 47, or equivalent, which provides additional means for selectively detecting laser pulses. The filter 43 and tank circuit 45, as well as microprocessor 44 programming filter out extraneous signals and noise. This filtration in combination with the detector component 41 and amplifier 42, provides an extremely sensitive detector 40. The detectors 40 are each electrically connected by means of a cable 61 imbedded in the harness webbing to the master box 60.

Each torso assembly 2 has a master box 60 attached to the harness rear horizontal support strap 24. The master boxes 60 for the soldier-participants 10 serve as the core of the system 1. Each master box 60 continuously monitors the eight detectors 40 in a soldier-participant's the torso assembly 2 and the helmet assembly 3. The master box 60 also receives a transmission from the helmet assembly 3 every 10 seconds. In addition, the master box 60 transmits signals every 4 seconds to the laser target pointer 4; runs a period self test and a test of all detectors 40; and communicates with the umpire unit 5 and test box 8. The master box 60 is capable of recording an entire sequence of events involving a particular soldier-participant 10. Every master box 60 is coded with a permanent serial number (S/N), or soldier identification number, lying between 1 and 65,000. This number is used to identify the soldier-participant 10 through the exercise. A transmitter unit 50 electrically connected to the master box 60 and mounted on the torso assembly harness 20 sends this serial number and the status of the soldier-participant 10 to the laser target pointer 4.

Figures 19, 19A:
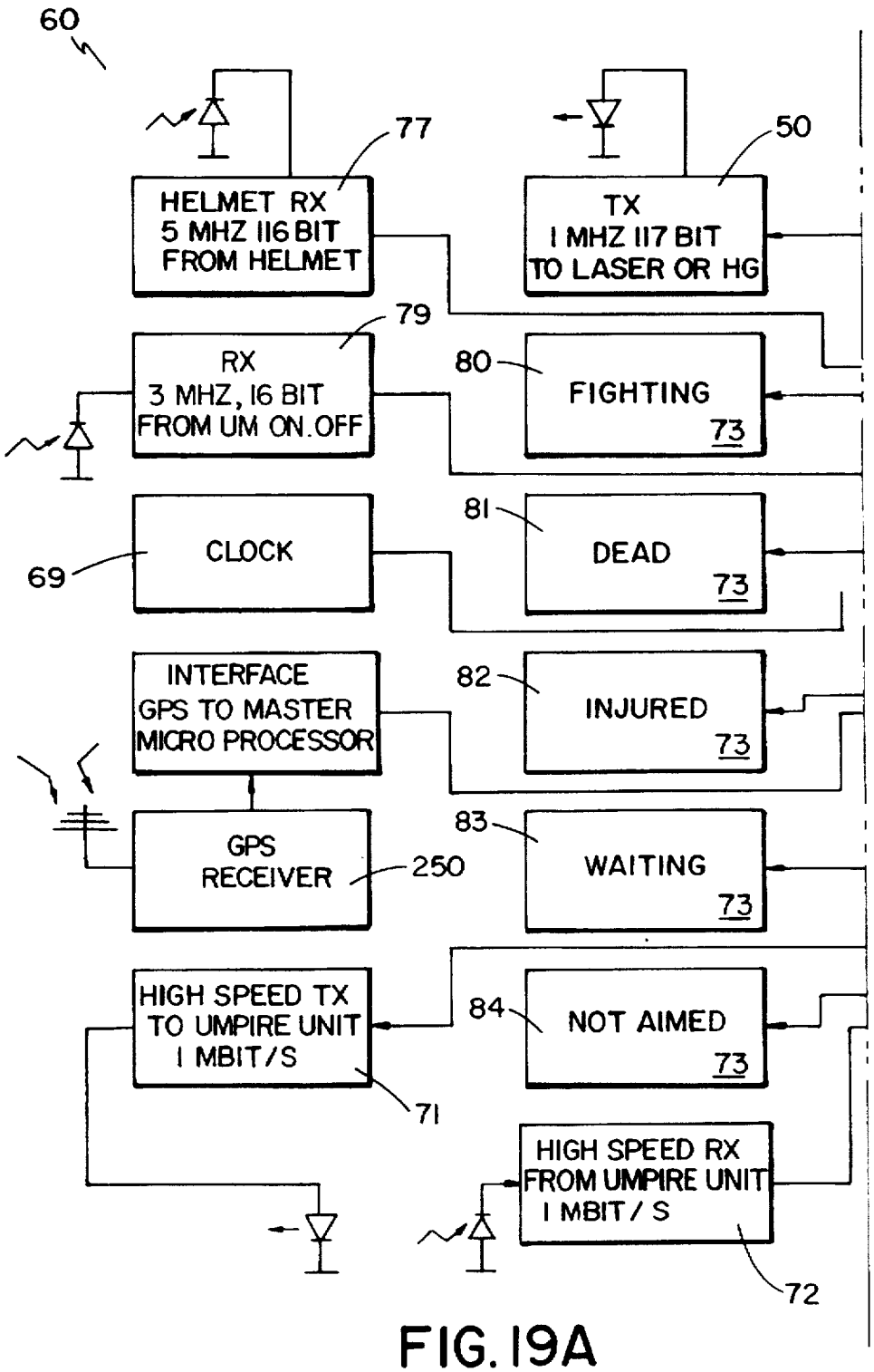
FIG. 19 is a circuit block diagram of the torso assembly master box.
Figure 19B:
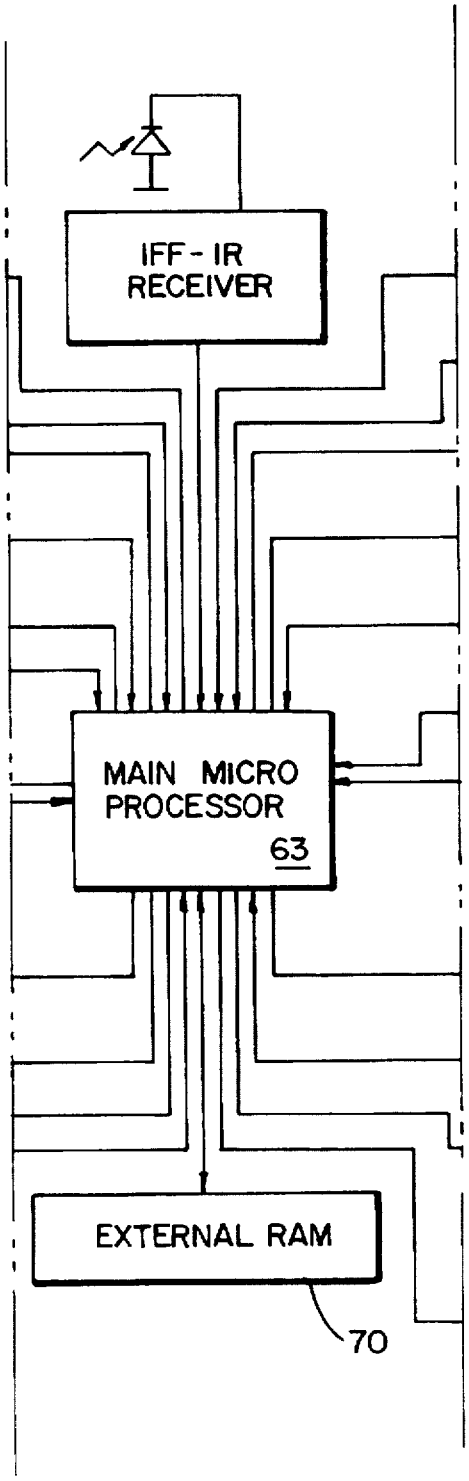
Figure 19C:
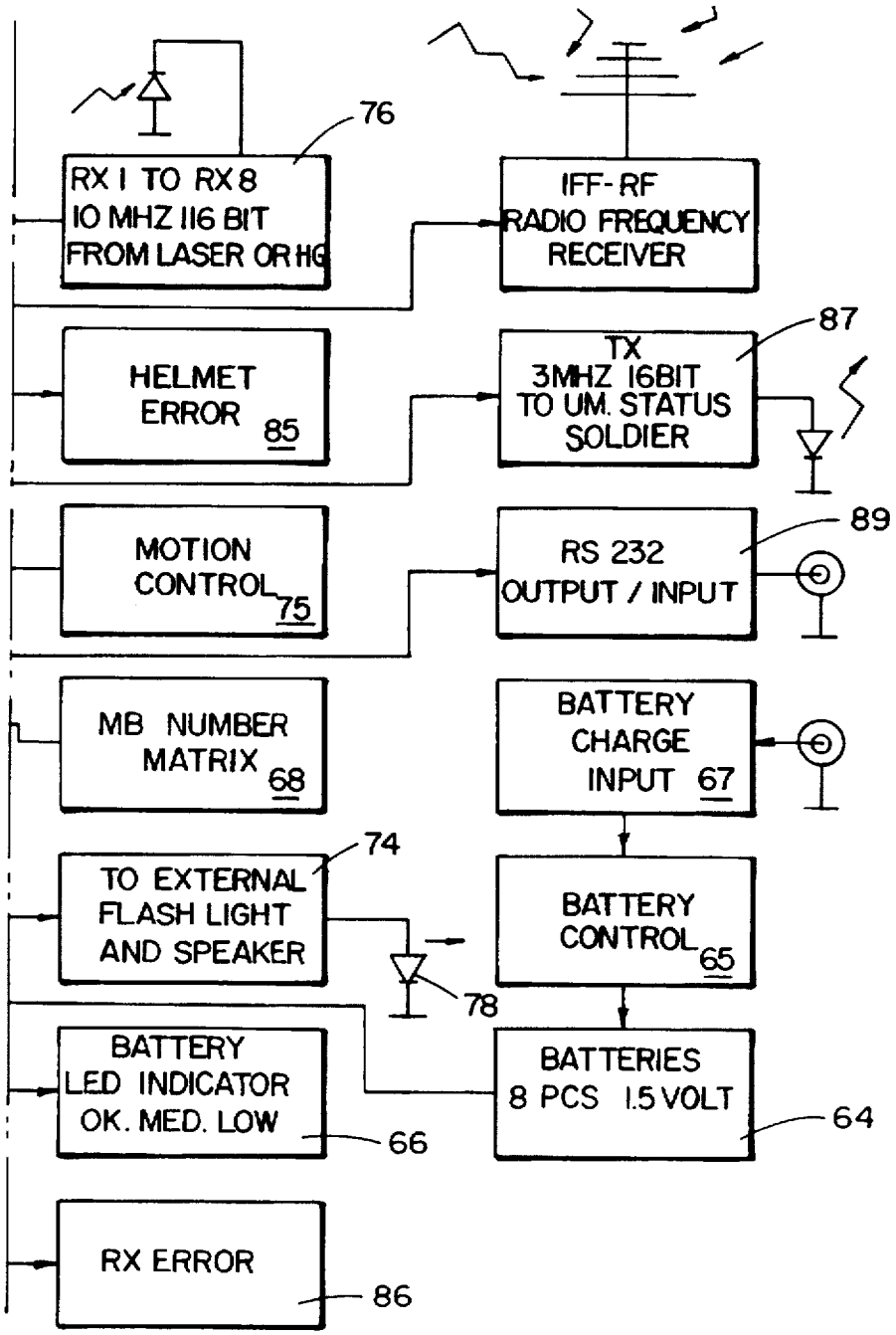
Figure 20:
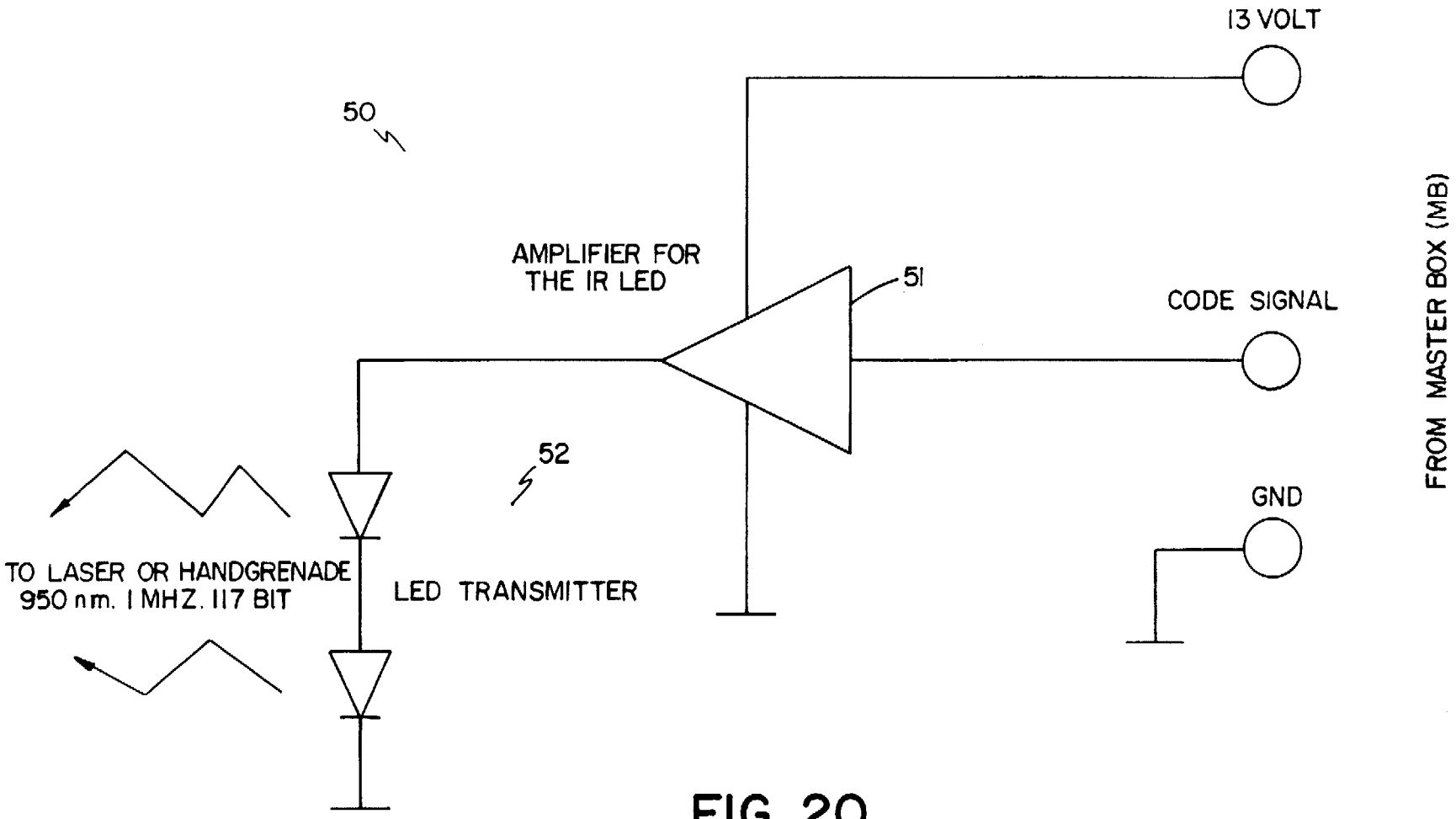
FIG. 20 is a circuit block diagram of a torso assembly transmitter.
Figure 21:
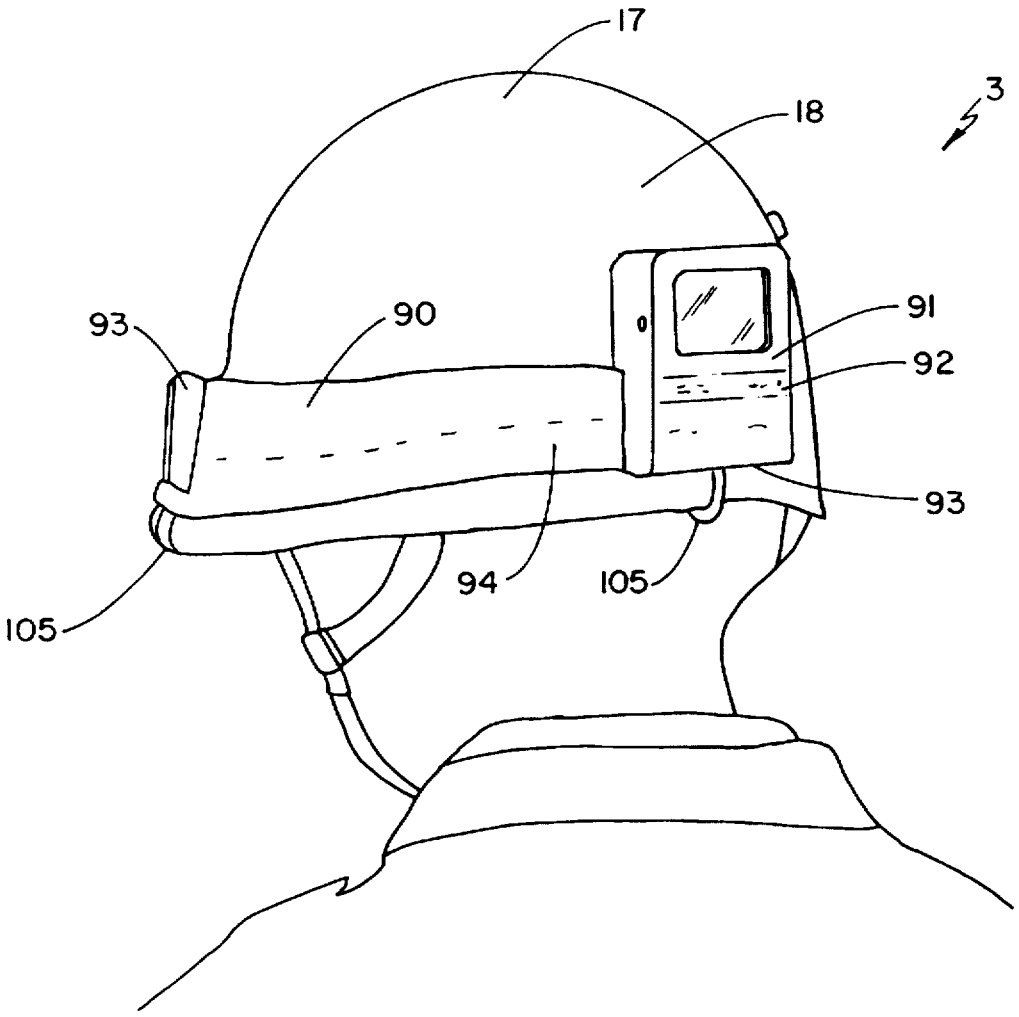
FIG. 21 is a close up view of the helmet assembly worn by the soldier participant in FIGS. 2–4.
Figure 22:
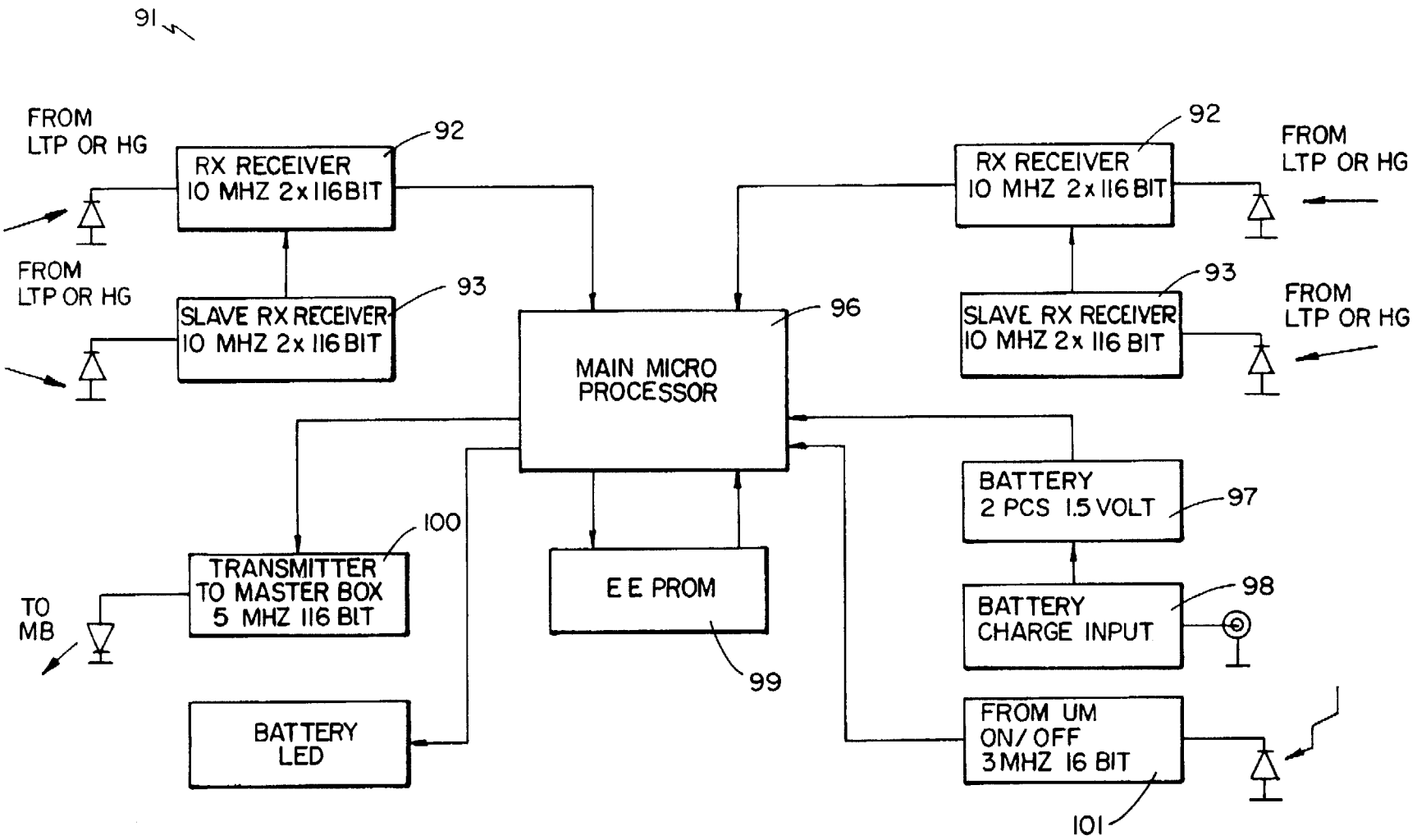
FIG. 22 is a circuit block diagram of the invention helmet assembly.

Referring more particularly to FIG. 19, there is shown a circuit block diagram of a master box 60. Central to the master box is the main microprocessor 63. The main microprocessor 63 is powered by means of a battery pack 64 and battery control 65. The battery pack 64 is comprised of eight, rechargeable, AA 1.5 volt alkaline batteries and can be run for thirty hours between charges. The battery pack 64 may be externally recharged via a battery charge plug 67. The status of the battery pack 64 is made known by means of a LED indicator 66. The unique master box permanent serial number may be hard wired or soft wired in by means of a number matrix 68. The master box clock 69 is synchronized by the umpire when the master box soldier-participant 10 is activated for the exercise. The microprocessor 63 has an external RAM 70 which contains the information concerning the identity of the soldier-participant 10, the initial data concerning the exercise, and a complete record of all events which occur to the soldier-participant 10 during the exercise maneuvers. The master box high speed transmitter 71 and high speed receiver 72 are the master box means for communicating with the umpire unit 5 and providing high speed data transfers, i.e., 1 MBits/second. The 10 MHz, 116-bit output from the eight detectors 40 are passed over the cable 61 a master box receiver 76 and therefrom to the main microprocessor 63. The master box 60 also receives helmet transmissions (5 MHz, 116-bit) through another receiver 77 physically mounted on the top of the master box 60. The receiver 77 is electrically connected to the main microprocessor 63. LEDs 73 may also be placed on the master box to indicate: status of the equipment, including battery status; operational status, such as placement of helmet, laser target pointer alignment; and fighting status, i.e., waiting, activated, injury or near miss, "kill" or direct hit, deactivated. In this embodiment of the invention 1 the master box has a group of individual LED status indicators 73. The LED status indicators 73 include: "FIGHTING" 80, "DEAD" 81, "INJURED" 82, "WAITING" 83, "NOT AIMED" 84, "HELMET ERROR" 85, and "RX-ERROR" 86. The "RX-ERROR" 86 box is both a control box and a LED. The LED would come on if one or more of the detectors 40 were not working. The control box function is activated by a test code sensed by the detector 33 attached to the center of the front horizontal support strap 23. The test code initializes the invention system 1 and/or tests the system 1. The master box 60 also contains a built-in speaker alarm 74 which can warn of a low battery, indicate when a shot or "near miss" is detected, and announce that a direct hit or "kill" has occurred. The alarm 74 also has a LED 78 attached to it thereby providing the capability for a visible alarm. A motion and angle sensor 75 is also built into the master box 60 for operational purposes described in detail below. The master box 60 also contains a receiver 79 for receiving "ON/OFF" commands from the umpire and a transmitter 87 for transmitting a soldier-participant's status to the umpire. Each master box 60 also contains an RS-232 interface port 89 for plugging into special modules thereby providing hardware access to the master box 60. The master box 60 contains a transmitter 59 for communication with an umpire unit 5. The transmitter 59 is comprised of a high powered, pulsed light emitting diode (LED). This transmitter 59 sends a 3 MHz, 16-bit coded signal to the umpire unit receiver 149.

Each master box 60 also has means for tying in a GPS function. Each master box 60 employs GPS satellites for determining the position of the soldier-participant wearing the particular master box 60. Each master box 60 contains a miniaturized GPS receiver 250. A GPS antenna 251 is attached to the torso harness 20 at the junction of the left connecting strap 26*b* and left suspender 21*b*. The GPS information is received and coded as 3×32-bit words. This information may then be transmitted to the laser target pointer 4 for encoding of the laser output beam. The soldier-participant 10 receiving the beam with a coded GPS position then passes the information to his own master box 60. The receiving soldier-participant's master box 60 calculates the distance between its own position and the position of the soldier-participant firing the laser beam. The shot can then be verified regarding the weapon and distance precisely. The GPS position in this embodiment of the invention is stored every 10 seconds. This data is then transferred to the computer 6 during the analysis period along with the shot identification and soldier identification. It is therefore possible to analyze a combat simulation including the actual position of the soldier-participants.

The harness 20 also contains two transmitter units 50, one 50*b* attached to the junction 55 of the front horizontal support strap 23 and the left suspender 21*b*, and the other 50*a* attached to the junction 56 of the right connecting strap 26*a* and the right suspender 21*a* on a soldier-participant's shoulder 11. This ensures that at least one transmitter 50*a* or 50*b* is always available for transmission in the direction of the soldier-participant's laser target pointer 4. Each transmitter unit 50 is comprised of a high powered, pulsed light emitting diode (LED) electrically connected by means of a cable 62 imbedded in the webbing of the harness 20 to the master box 60. As may be seen from FIG. 20, the transmitter unit 50 takes a 1 MHz, 117-bit, coded signal from the master box 60, brings the signal through an amplifier 51 to a LED 52 for transmission to the laser target pointer 4 or to a hand grenade 9 or to a mine 260. Each transmitter 50 has two LEDs 52, one pointing upward and one pointing directly out. This further ensures that at least one transmitter 50 will always have an available transmission path to the soldier-participant's laser target pointer 4.

Each soldier-participant 10 also wears a helmet assembly 3 during an exercise. See FIGS. 2–4 and 21. Each helmet assembly 3 has a belt 90 which fits snugly about the soldier-participant's helmet 17. The remaining assembly components are attached to this belt 90. The primary helmet assembly component is the helmet master box 91 which is preferably located at the helmet rear 18. The helmet master box 91 is a miniature version of the harness master box 60 and fulfils almost all the same functions in most of its facets. In this embodiment of the invention 1 the helmet assembly 3 has two main sensors 92, also termed master detectors, with built in microprocessors 96 controlled by the helmet master box 91. Each main sensor 92 controls a subsidiary sensor 93, also termed slave detector, located at various positions on the helmet belt 90. As with the torso assembly detectors 40 the helmet master detectors 92 are programed to look for the specific shaped laser beam 133 being fired. In this embodiment of the invention two slave detectors 93 are used with one of each connected to a master detector 92. Each slave detector 93 has a make-up identical to that of a torso assembly detector 40 except that each of the helmet slave detectors 93 are electrically connected to a master detector 92 by electrical cable 94 imbedded in the helmet belt 90 instead of to a master box 60. Each master detector 92 is in turn electrically connected by cable 94 to the main microprocessor 96 in the helmet master box 91. The helmet master box 91 is powered by a battery pack 97 containing two 1.5 V AA rechargeable alkaline batteries with a battery life of approximately 40 hours between recharges. A battery charge plug 98 is built into the helmet master box 91 for recharging the batteries. An EE PROM 99 is contained within the helmet master box 91 and is connected to the main microprocessor 96. The EE PROM unit 99 stores data even when the batteries are out. It is much smaller than the master box external RAM 70 and stores the last status in case of battery failure or other power interruption.

The helmet master box 91 communicates with the torso master box 60 at least every 10 seconds using a 5 MHz, 116-bit code. Communication with the torso master box 60 is accomplished by a helmet assembly transmitter 100. The helmet assembly master box 91 also contains a receiver 101 for receiving 3 MHz, 16-bit "On/Off" codes from an umpire. Communications between the helmet assembly 3 and torso assembly master box 60 are line of sight using coded infrared signals. If the soldier-participant 10 removes his helmet 17, the communications link will be interrupted and the torso master box 60 will inactivate the soldier-participant's laser target pointer 4. Should one of the helmet assembly detectors 92, 93 detect an enemy laser beam "shot", the information of the shot, including the serial number of the soldier-participant 10 who fired the shot, is passed to the torso master box 60. The helmet assembly 3 is initially activated by an optical signal from the umpire unit 5 or the test box 8 to the helmet assembly receiver 101.

When a soldier-participant is "shot", all detectors 40, 92, 93 which detected the shot-signal will transmit the information concerning the "shot" to the torso master box 60 either directly, if detected by a torso assembly detector 40, or indirectly via the helmet master box 91 if detected by a helmet detector 92, 93. The master box 60 will then use an algorithm to decide if the shot is a "hit" or a "near miss", or whether the soldier-participant 10 is "killed" or "injured". The master box 60 will then store the information in its memory 70. The combination of helmet detectors 92, 93 and torso detectors 40 monitors the face and neck, so that even there hits can be detected. Each helmet slave detector 93 has a light transmitting/receiving tubular member 105 attached thereto and extending below the helmet 17. These tubes 105 are particularly useful in picking up any light incident on the face or neck areas of the soldier-participant 10.

The present invention permits much smaller detectors to be used, while at the same time dramatically increasing their sensitivity. Eye safety is no longer a problem. Information gathering and simulation control are substantially increased because of the availability of PCM and PPM modulation techniques.

Figure 23B:
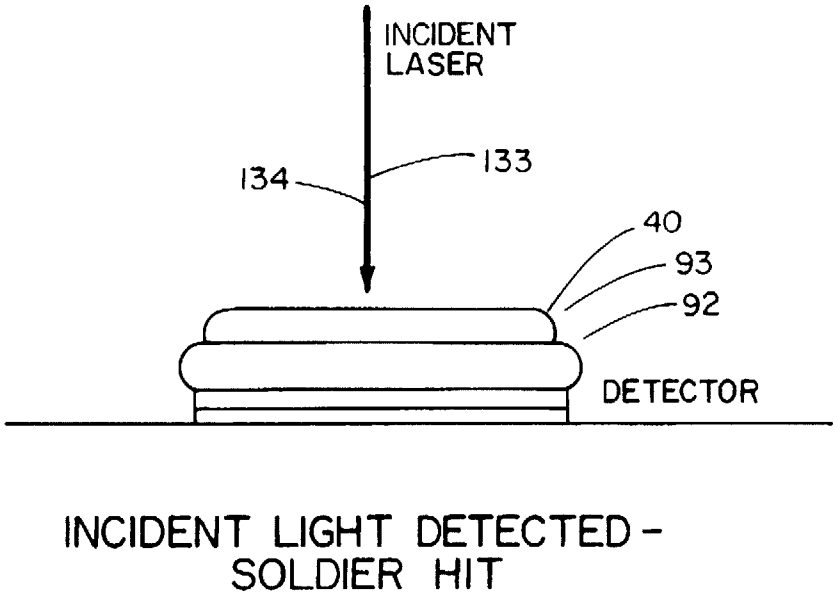
FIG. 23B is an illustrative view of an incident light detected soldier hit.
Figure 23A:
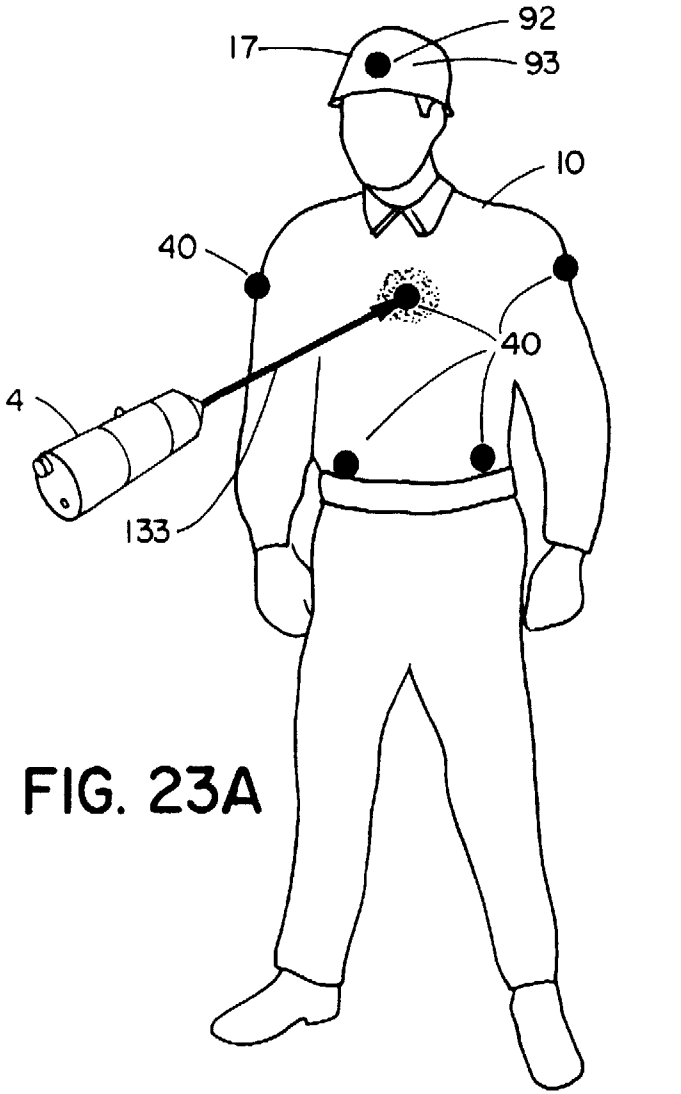
FIG. 23A is an illustrative view of a soldier direct hit.
Figure 24B:
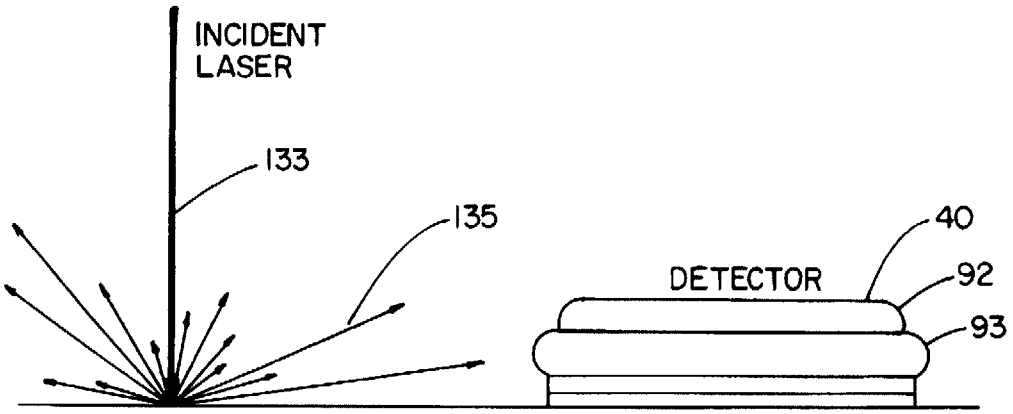
FIG. 24B is an illustrative view of a scattered light detected soldier hit.
Figure 24A:
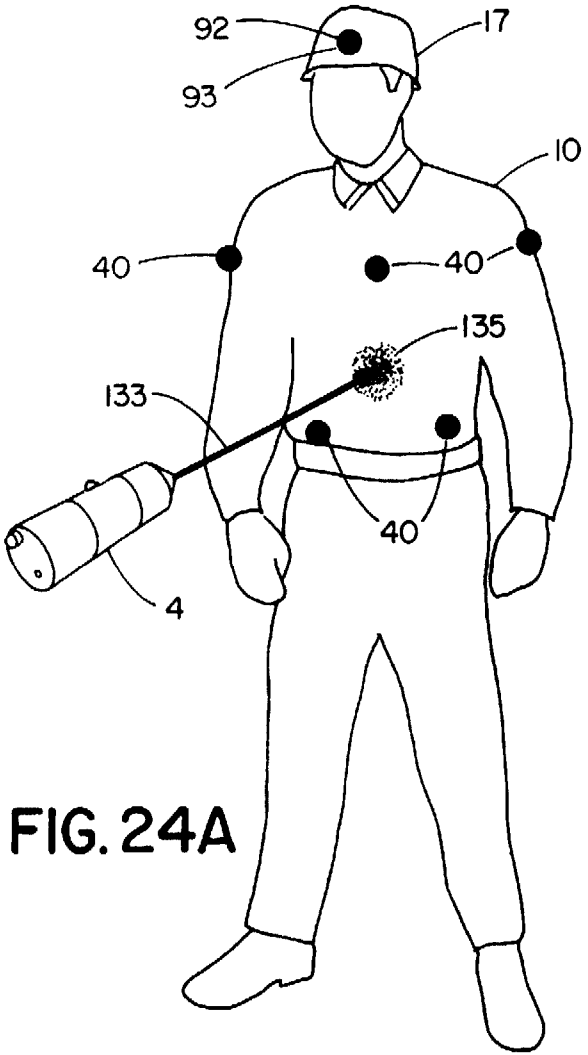
FIG. 24A is an illustrative view of a soldier indirect hit.
Figure 25A:
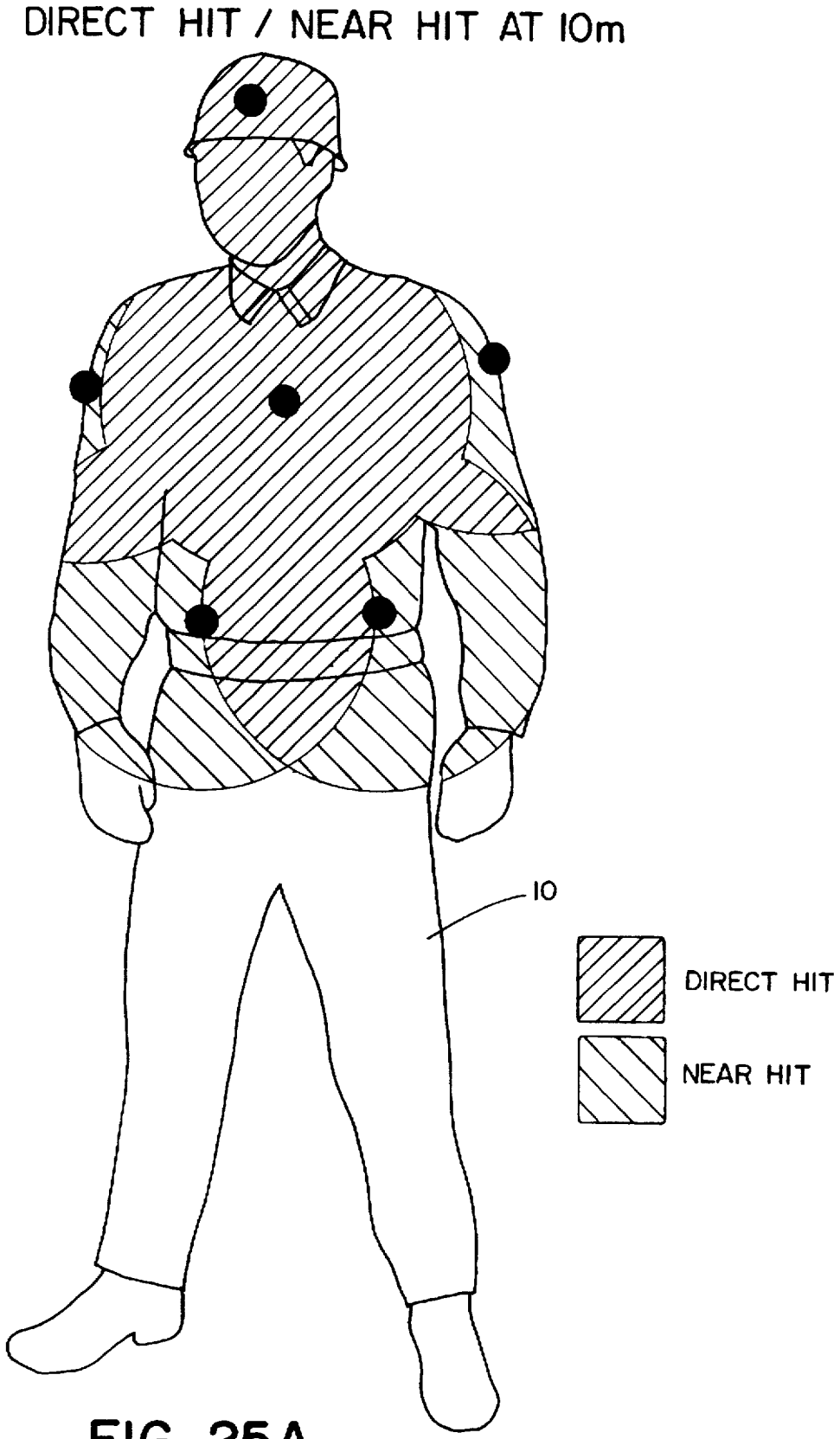
FIG. 25A is a direct/indirect hit profile at 10 meters.
Figure 25B:
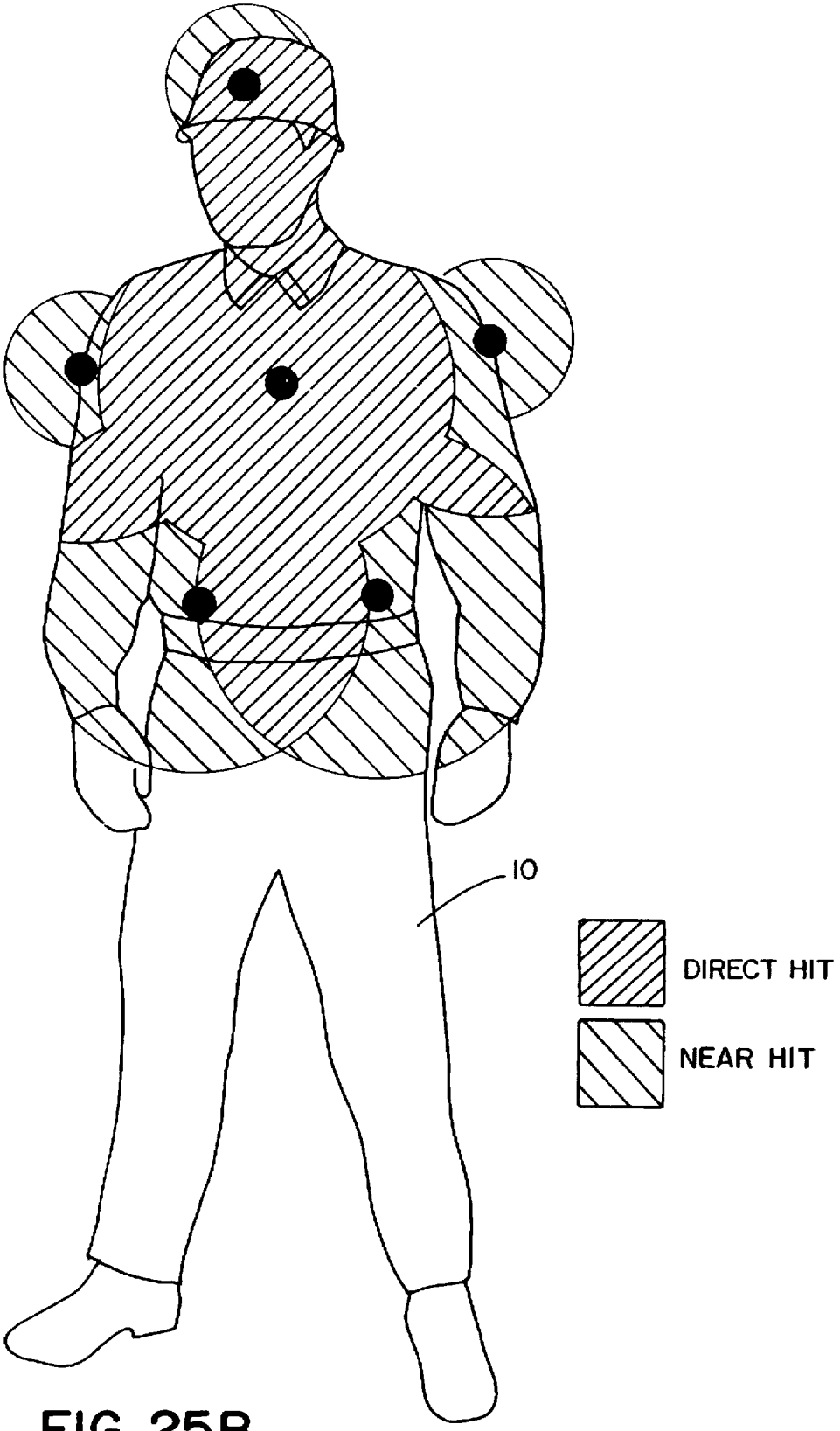
FIG. 25B is a direct/indirect hit profile at 100 meters.
Figure 25C:
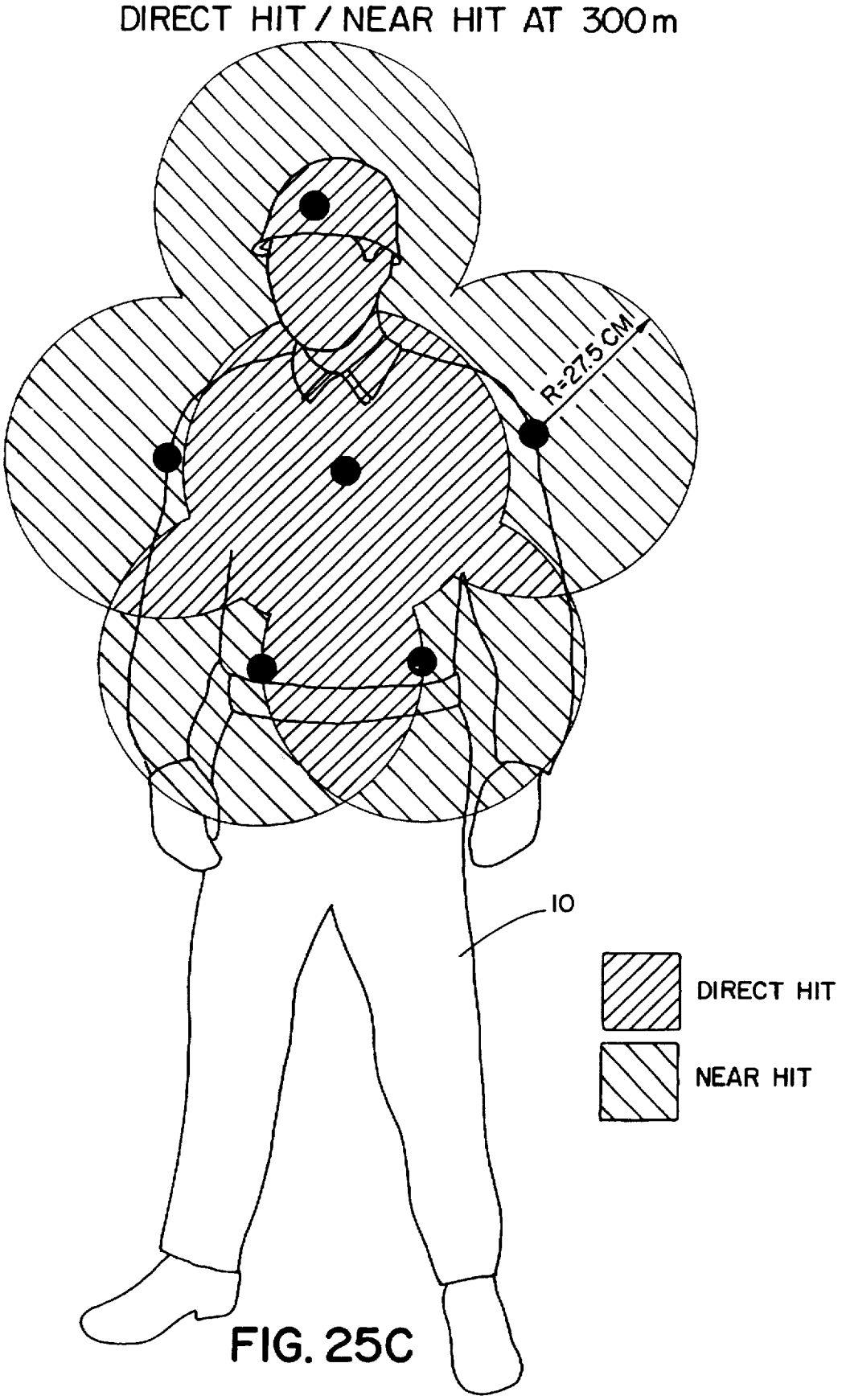
FIG. 25C is a direct/indirect hit profile at 300 meter.

Referring now more particularly to FIGS. 23–25, the present invention detectors 40, 92, 93 can be activated by both direct 134 and scattered 135 light from the laser beam 133. If direct light 134 from the laser beam 133 is incident on a detector 40, 92, 93, the detector will first filter out any beam frequencies outside a designated carrier band width, and then outside a designated modulation frequency bandwidth. Any signal within a designated carrier band width and modulation frequency bandwidth will be decoded and passed to the detector's microprocessor to determine if the pulse packet contained in the laser beam 133 meets certain specified code criteria. If the pulse packet meets designated code criteria, the information contained within the packet, as well as the fact of detection and the identity of the detector will be passed to the master box 60 of the soldier-participant "hit" by the laser beam 133. However, at short distances of a few meters, the laser beam radial diameter is sufficiently small that a laser beam 133 can strike the enemy soldier-participant yet not strike a detector 40, 92, 93 worn by the enemy soldier-participant 10. The system 1 of the present invention, however, will detect the light 135 of the laser beam 133 that is scattered by the clothing or skin of the soldier-participant 10. Thus all laser beams 133 which strike the enemy soldier-participant will be detected. If the pulse packet contained in the laser beam 133 meets certain specified code criteria, the detector 40, 92, 93 will pass the sensed information on to the "hit" soldier-participant master box 60 in the same manner as with incident light 134.

An injury is registered when one sensor, or the area surrounding one sensor is hit. This can be changed or customized to a particular simulation. A soldier-participant 10 can continue to fire when the hit status is "injured". This function can be altered as desired. Direct hits, as opposed to incident light detection, are registered when the sensor 40 at the center of the torso is hit, a helmet sensor 92, 93 is struck, or whenever two or more sensors 40, 92, 93 detect the same shot from an opponent. The soldier-participant 10 will be "dead" as a result of a direct hit, and his laser target pointer 4 will be rendered inoperable by a special infrared signal from the soldier-participant's master box 60. Further, a continuous "beep" may be emitted by the master box speaker 74. This can be modified, if desired, so that the tone is only emitted when the "dead" soldier-participant 10 moves or stands up, instead of remaining still while lying on the ground.

Figure 26:
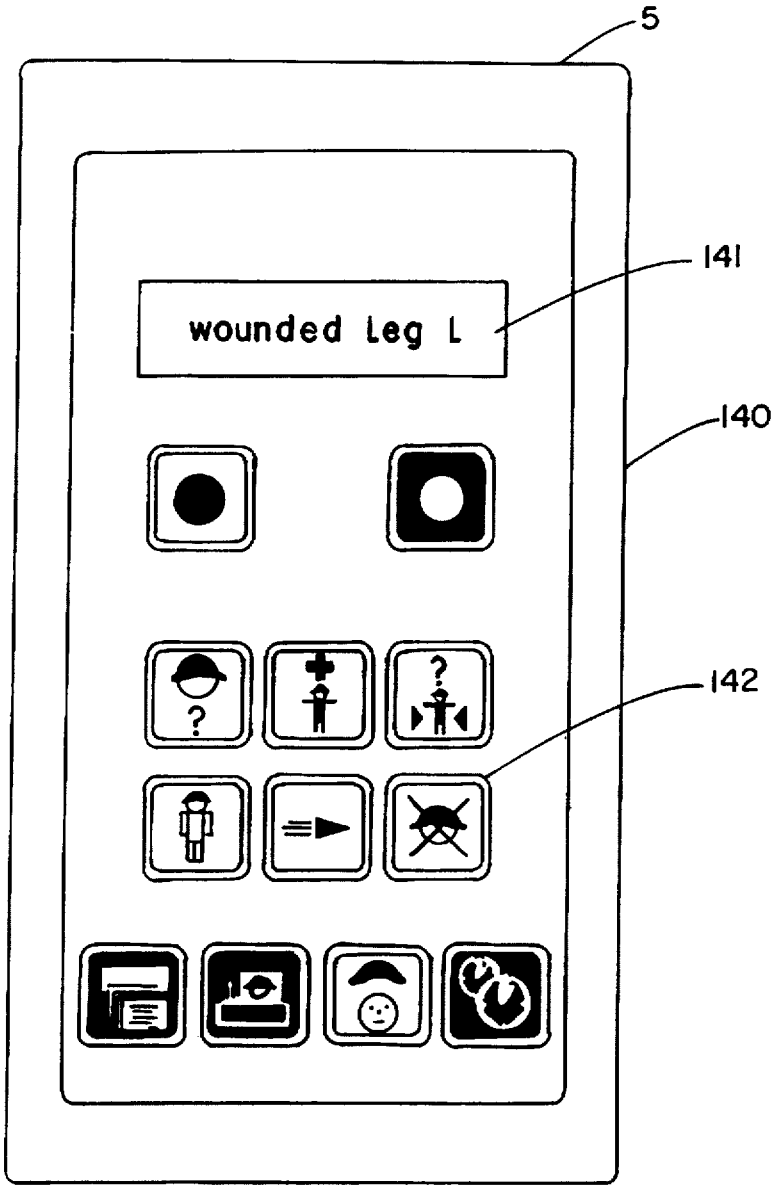
FIG. 26 is a front close-up view of the invention umpire unit.
Figure 27:
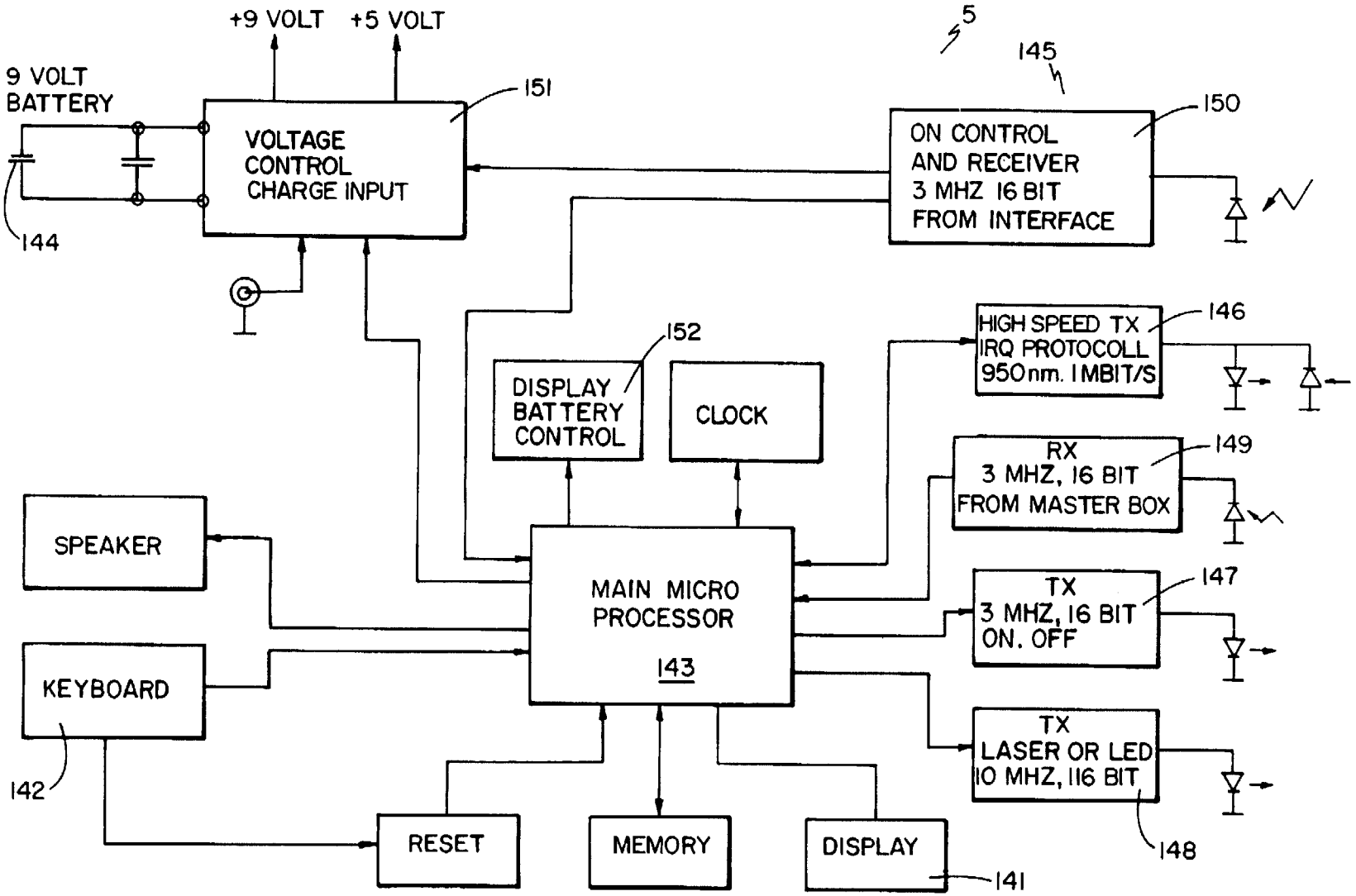
FIG. 27 is a circuit block diagram of the umpire unit.
Figure 28:
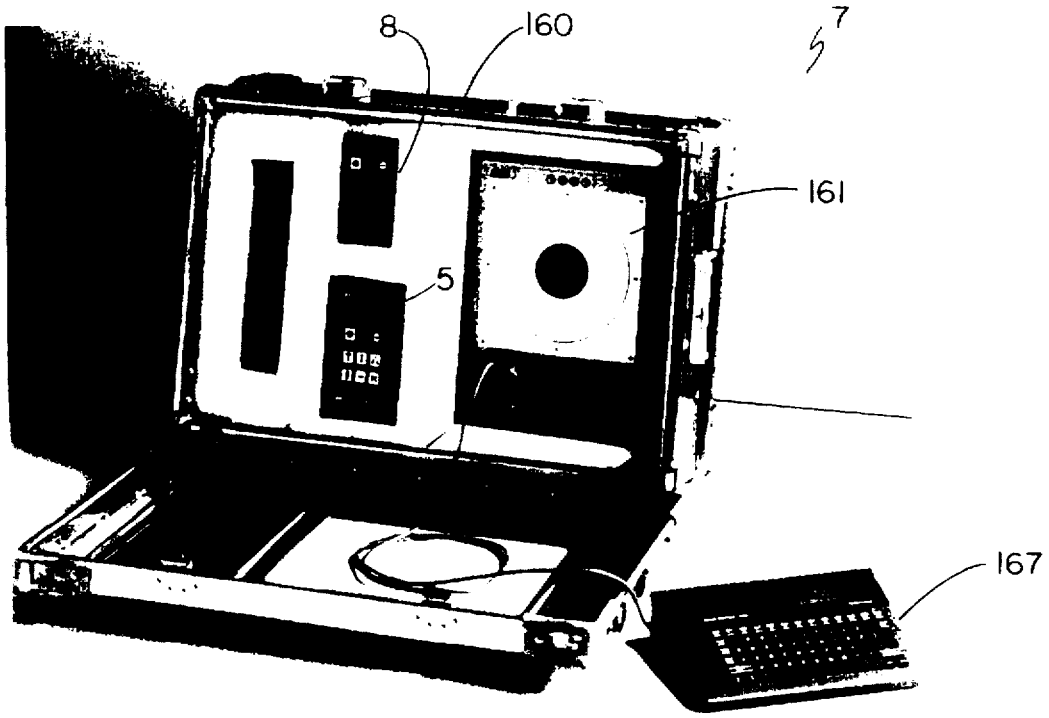
FIG. 28 is a front perspective view of the invention aiming tool with keyboard, umpire unit and test box.
Figure 29:
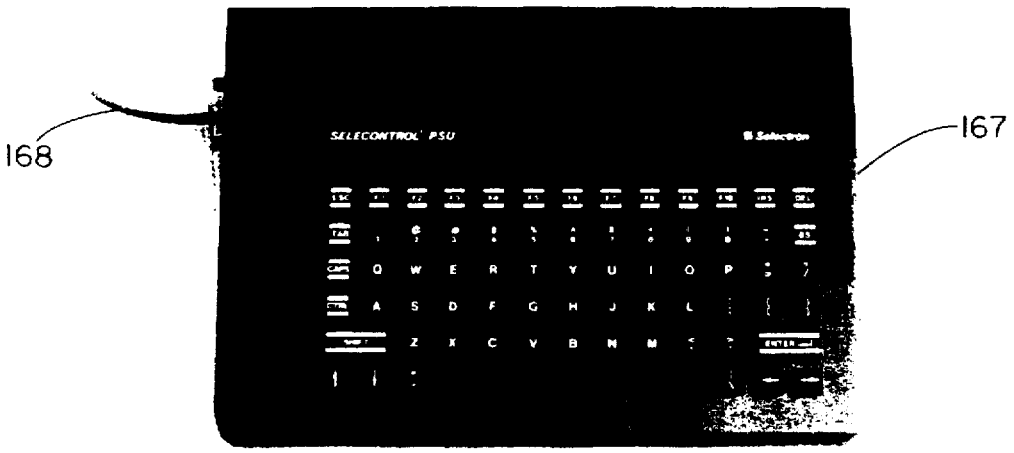
FIG. 29 is a close-up front elevational view of the Aiming Tool keyboard.
Figure 30:
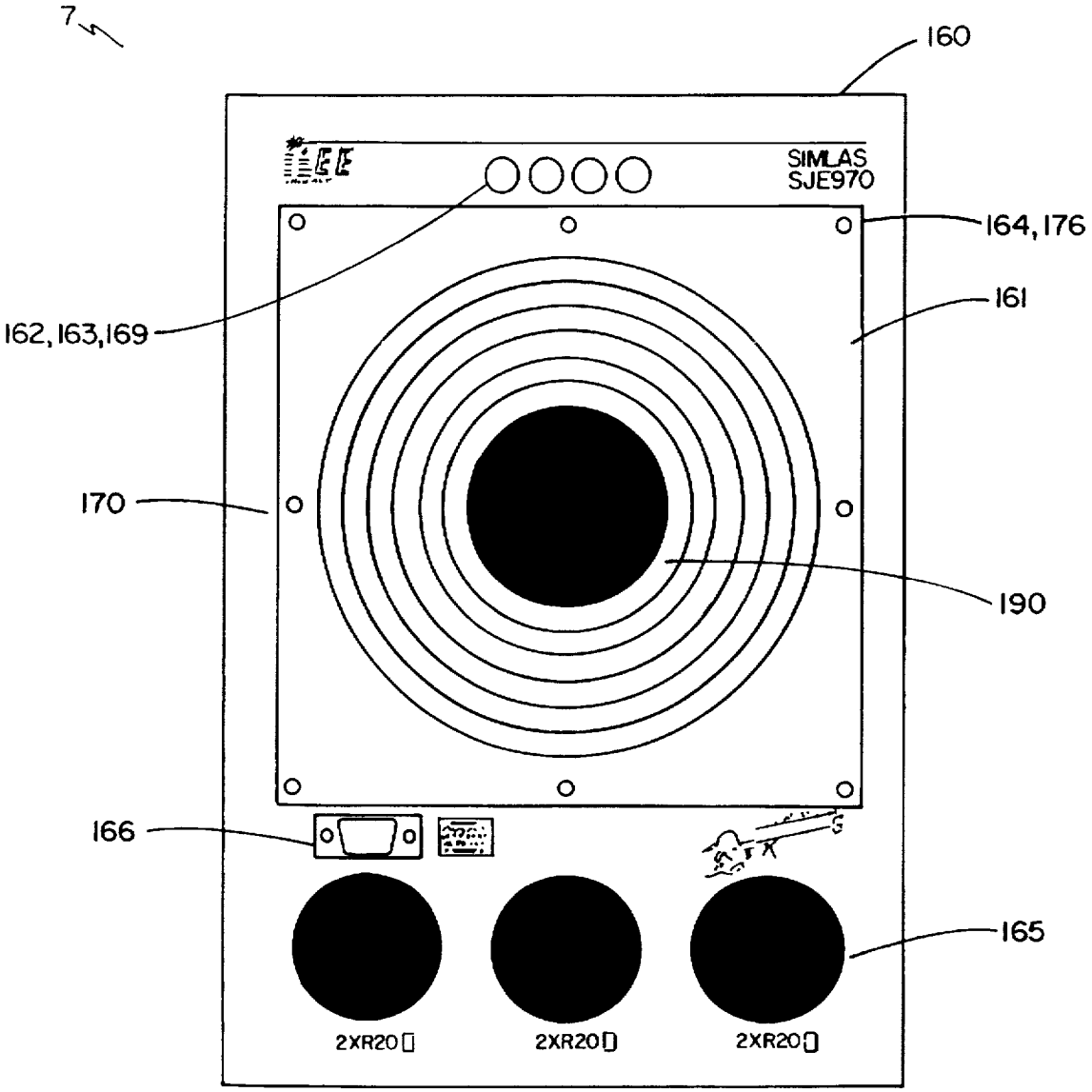
FIG. 30 is a close-up front elevational view of the aiming tool.
Figure 31:
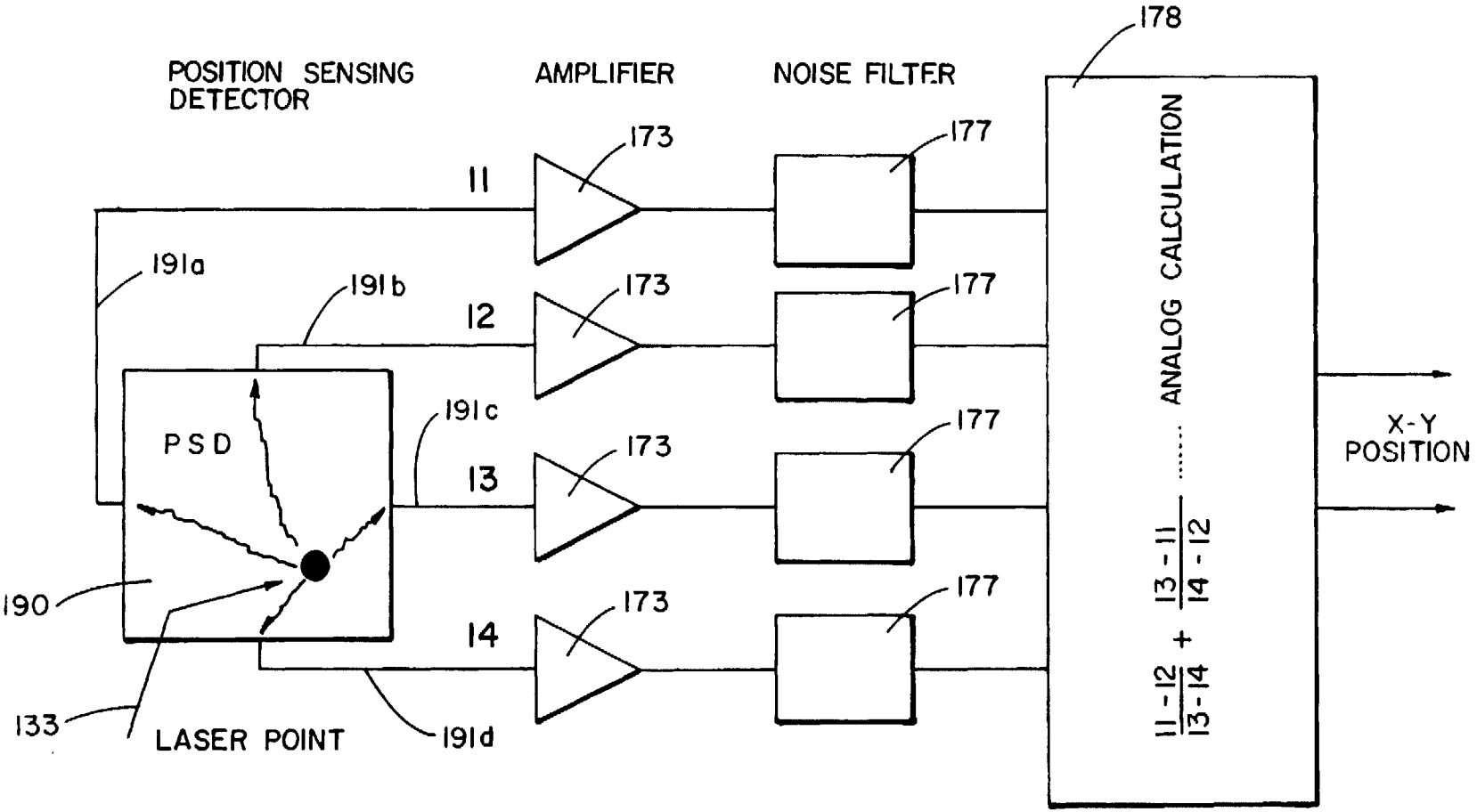
FIG. 31 is a schematic diagram of a position sensing detector.
Figure 32:
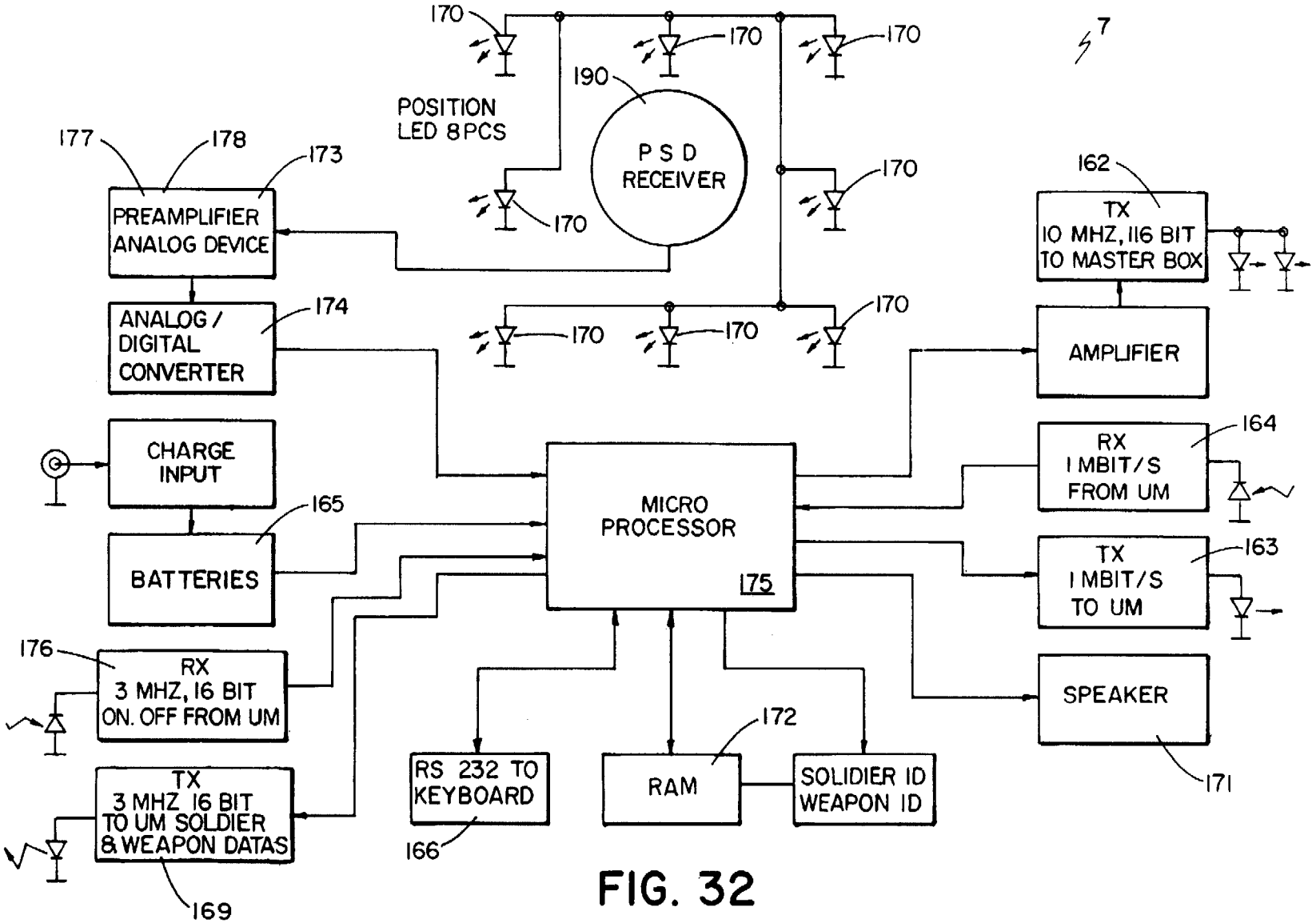
FIG. 32 is a circuit block diagram of the invention Aiming Tool.
Figure 33:
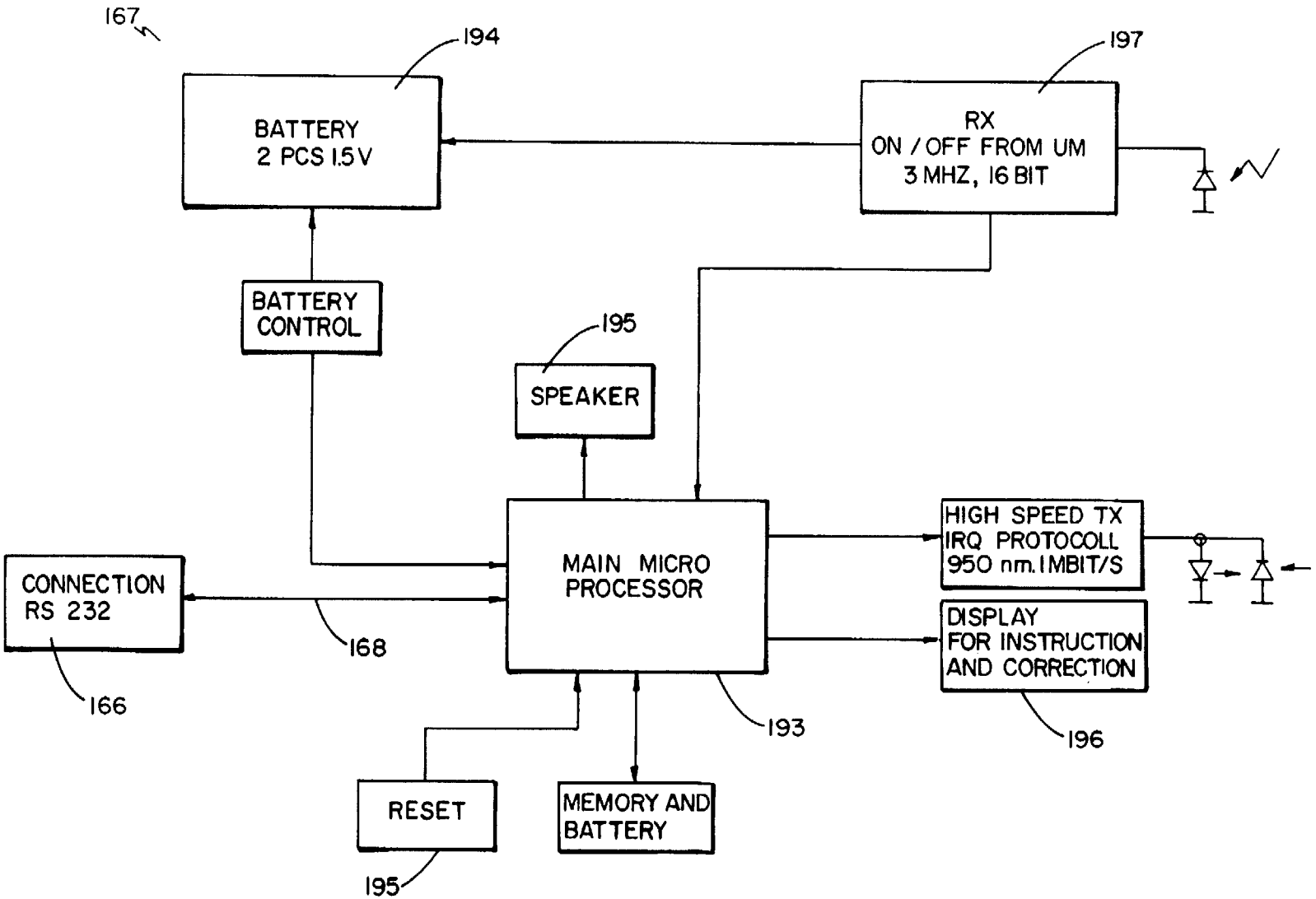
FIG. 33 is a circuit block diagram of the invention Keyboard.

Referring now more particularly to FIGS. 26 & 27, there is included within the invention system 1 an umpire unit 5. An umpire can query each soldier-participant's master box 60 and enter into a central point identification and simulation progress information. Following the end of the battlefield exercise, all of the soldier-participants 10 involved are deactivated by an umpire and the date contained in the master box 60 of each soldier-participant 10 is read out using an umpire unit 5. Each soldier-participant's master box 60 and the umpire unit 5 communicate via infrared optical signals; no cables are required. The umpire unit 5 stores all the data of each soldier-participant 10 he has read. The data includes a list of each event experienced by the soldier-participant during the exercise along with the time the event occurred. The data may include where the soldier-participant may have been shot; if and how he had been "killed"; when he had been activated; the status of the soldier-participant's equipment; and also a soldier-participant's GPS position.

The umpire unit 5 is a small, hand-held, rectangular console 140 with liquid crystal display (LCD) 141, keyboard 142, microprocessor 143, battery pack 144 with a voltage control/charging input unit 151 and display 152, and communications subsystem 145. It is held and operated by personnel designated as "umpires" for the simulation exercise. The umpire units communications subsystem 145 contains a high speed transceiver 146 for high volume data transfer (1 Mbits/second) to and from a soldier-participant's master box high speed transmitter 71 and receiver 72. The umpire unit has a transceiver 150 to communicate with the interface unit 201. The umpire unit communications subsystem 145 also contains another transmitter 147 which transmits a 3 MHz, 16-bit code to the master box receiver 79 and/or laser target pointer receiver 128 and also contains a receiver 149 for receiving transmissions from the master box 60. The 16-bit code is an "on/off" command. It may also query as to a soldier-participant's name, injury, status, and who shot the soldier-participant. The 16-bit code may also be used to change the laser target pointer mode of operation from simulation to continuous laser transmission for aiming of demonstration purposes. The umpire unit communications subsystem 145 contains a third transmitter 148 which has the same function as a soldier-participant's laser target pointer 4. This transmitter 148 transmits a 10 MHz, 116-bit code. The umpire can send forth his personal number which will be registered as a deadly hit to the soldier-participant 10. The umpire unit 5 is activated by the interface unit 201.

Referring now more particularly to FIGS. 28–33, there is included within the invention system 1 an aiming tool 7. The aiming tool 7 contains a suit-case console 160 with positioning sensing screen 161, transmitter 162 (to the master box 60), umpire unit transmitter 163, umpire unit receiver 164, battery pack 165, and keyboard connection 166, and a keyboard unit 167 with an RS-232 interconnecting cable 168.

Because realistic battlefield simulation requires exact correspondence between the simulated path of a bullet and an actual bullet path, the laser beam 133 must be properly aligned with the weapon 110. The aiming tool 7 is used in conjunction with the laser target pointer 4 to align the laser target pointer 4 and the weapon 110 on which the pointer 4 is mounted. To accomplish this, the aiming tool 7 incorporates eight positioning sensing detectors 190 about the screen 161. The screen 161 also contains 9 LEDs 170. The LEDs 170 show only in which quadrant the laser beam has hit the detector 190. Each position detector 190 has 4 connectors 191 and a ground 192. If the focused light of a laser beam hits the detector's surface, 4 analog currents move to the connectors 191*a*, 191*b*, 191*c*, and 191*d*. The current along each connector 191 is preamplified 173, filtered 177, analog calculated for an X-Y position 178, digitized 174 and passed to the microprocessor 175. The analog calculator 178 takes the intensity of the current measured along each connector 191 and from the four readings is able to calculate the exact X-Y point where the laser beam 133 hit the detector surface. The signals from the position detector 190 are so weak that the calculations must be done in analog for accuracy. The microprocessor 175 processes the resultant X-Y data and instructs the keyboard unit 167 to present the amount of horizontal and vertical adjustments needed to zero the laser beam 133 from the laser pointer 4. In this embodiment of the invention, one klick corresponds to 28 mm at 100 m. The keyboard 167 presents to the soldier-participant 10 how many klicks are needed horizontally and vertically. The aiming tool 7 can resolve the transverse position of a laser target pointer output beam 133 to better than 100 micrometers. Therefore, the adjustment distance can be reduced to 5 to 10 meters for the accuracy of a 100 to 200 meter shot.

The aiming tool 7 contains a receiver 176 and a transmitter 169 for reception and transmission of a 3 Mhz, 16-bit code "on/off" signal and other information from and to the umpire unit 5. The aiming tool umpire transmitter 163 and receiver 164 provide for high volume data transfers (1 MBits/second) between the umpire unit 5 and the aiming tool 7.

To align his weapon 110, the soldier-participant 10 stands ten meters from the aiming tool 7 which has been initialized with the time, exercise number and other information by an umpire unit 5. The aiming tool 7 transmits to the master box via an aiming tool transmitter 163 an infrared signal (10 MHz, 116-bit) which directs the soldier-participant's master box 60 to activate the soldier-participant's laser target pointer 4 thereby allowing the soldier-participant 10 to align the laser 120 to the weapon 110. The soldier-participant 10 then aims his weapon at the aiming tool screen (target) 161 to align the target pointer laser beam 133. The soldier-participant 10 is instructed how to align the laser by both an optical (LED indicators 170) and acoustical signal (analog speaker 171). The pointer 4 also sends the serial number of the soldier-participant 10 while he aligns his weapon 110 and this is saved in the aiming tool RAM 172.

Following the successful alignment of his laser target pointer 4, the soldier-participant 10 types in his name, rank, and unit using the aiming tool keyboard 167. After all the soldier-participants have successfully aligned their weapons, the memory 172 of the aiming tool 7 contains data of all soldier-participants and an umpire can then transfer all the data from the aiming tool to the umpire unit 5. In the case where there are several aiming tools 7 in use during a particular exercise, each umpire must read out the data of every aiming tool in order to have information concerning all the soldiers participating in the exercise. The keyboard 167 contains its own microprocessor 193 for preprocessing data to and from the aiming tool 7 via a cable 168 to the aiming tool RS 232 connection 166. The keyboard 167 is powered by a battery pack 194. The microprocessor 193 has a reset function 195, drives a speaker 195 for instructing the soldier-participant 10 aligning his laser target pointer 4 and weapon 110, and has its own display 196. The keyboard 167 also has its own receiver 197 connected to the microprocessor 193 for receiving "on/off" instructions from the umpire unit 5. The keyboard 167 also has a high speed transmitter 198 connected to the microprocessor 193 for transmission of IRQ protocols.

Figure 34:
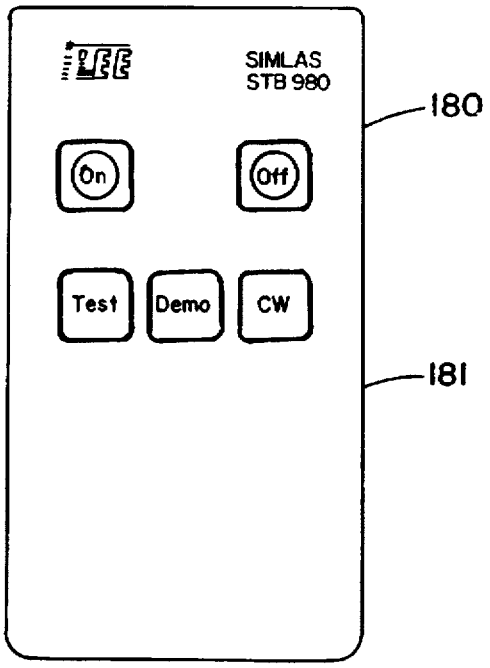
FIG. 34 is a front close-up view of the invention test box.
Figure 35:
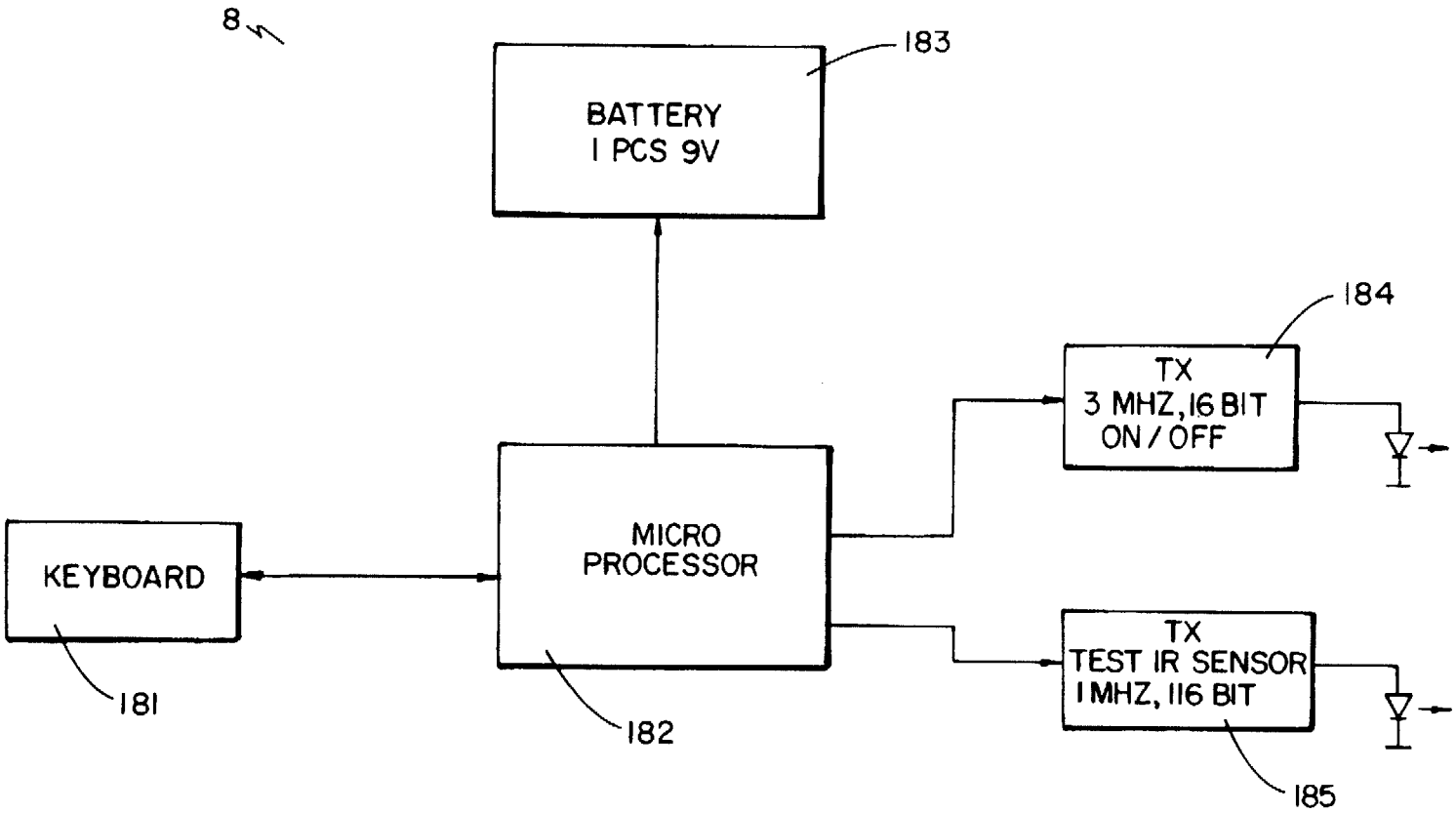
FIG. 35 is a circuit block diagram of the invention test box.

Referring now more particularly to FIGS. 34 & 35, there is included within the invention system 1 a test box 8. All simulation system equipment can be tested prior to the exercise using the test box 8. The test box 8 is contained within a hand held console 180 with a keyboard 181, internal microprocessor 182, battery pack 183, 3 MHz, 16 Bit Transmitter 184, and a 1 MHz test IR sensor transmitter 185. The test box 8 may operate in one of several available modes, such as a demonstration mode, a mode which drives the laser target pointer 4 as a CW laser, and a test mode. The test box 8 can also be used to activate and deactivate a soldier-participant's equipment, such as the laser target pointer 4, torso assembly 2, and helmet assembly 3.

Figure 36:
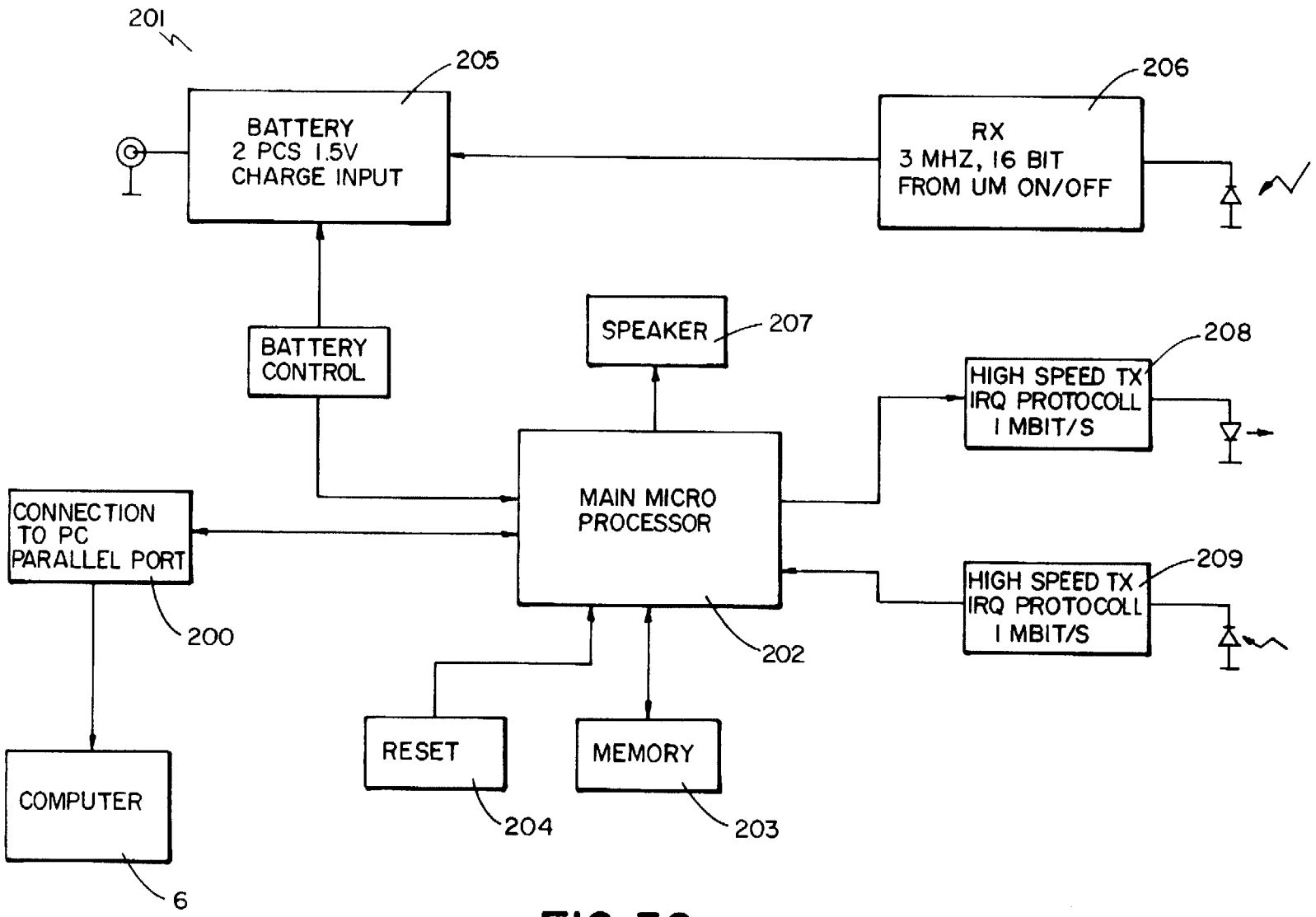
FIG. 36 is a circuit block diagram of the computer interface unit.
Figure 37A:
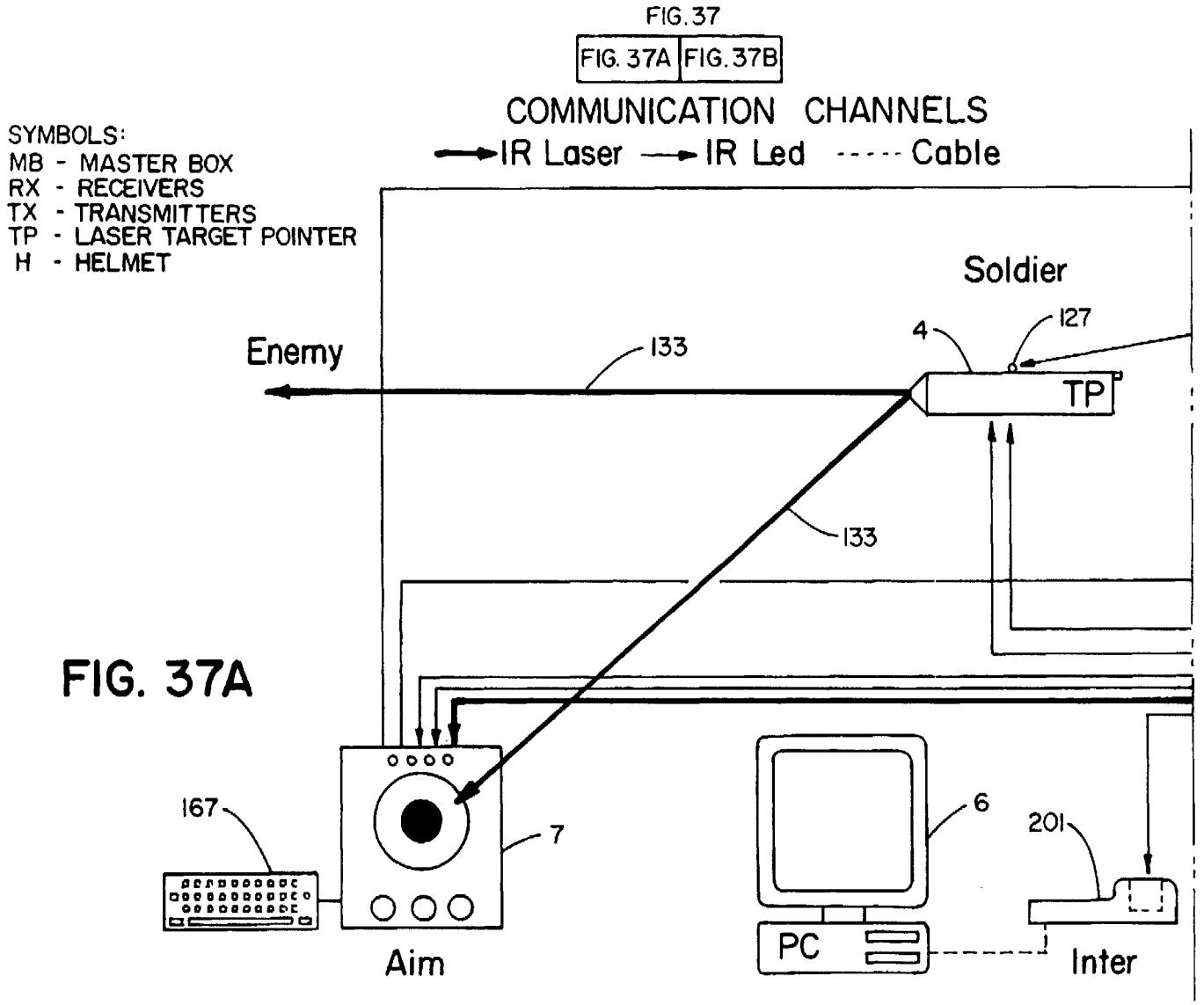
FIG. 37 is a schematic view of the invention with illustrated communications paths.
Figure 37B:
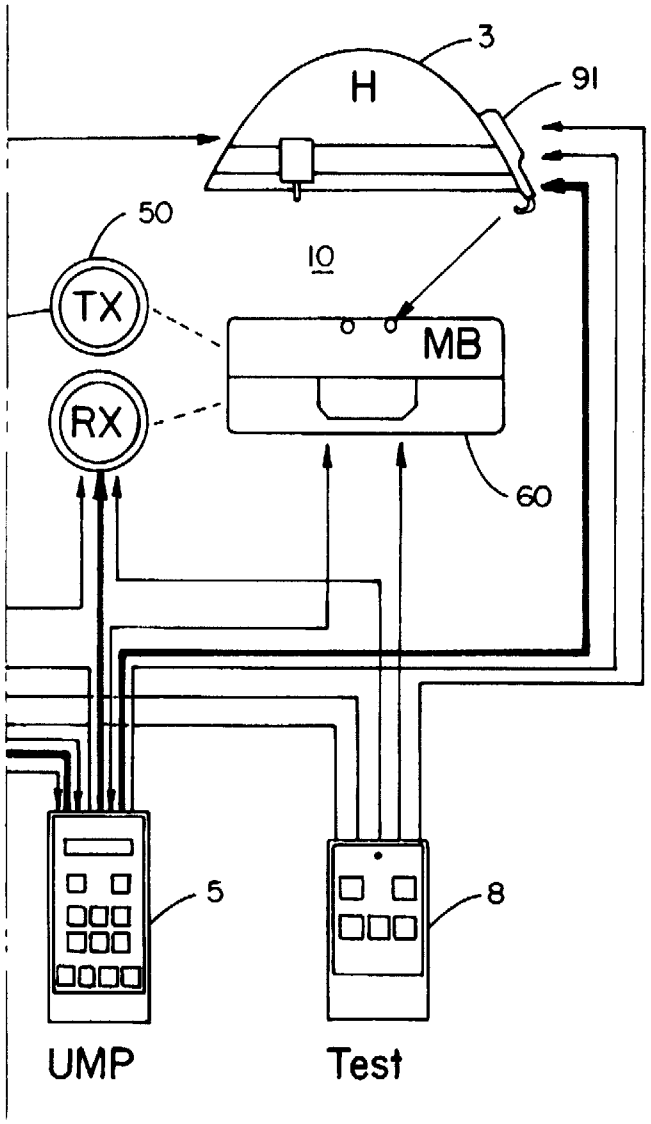
Figure 38:
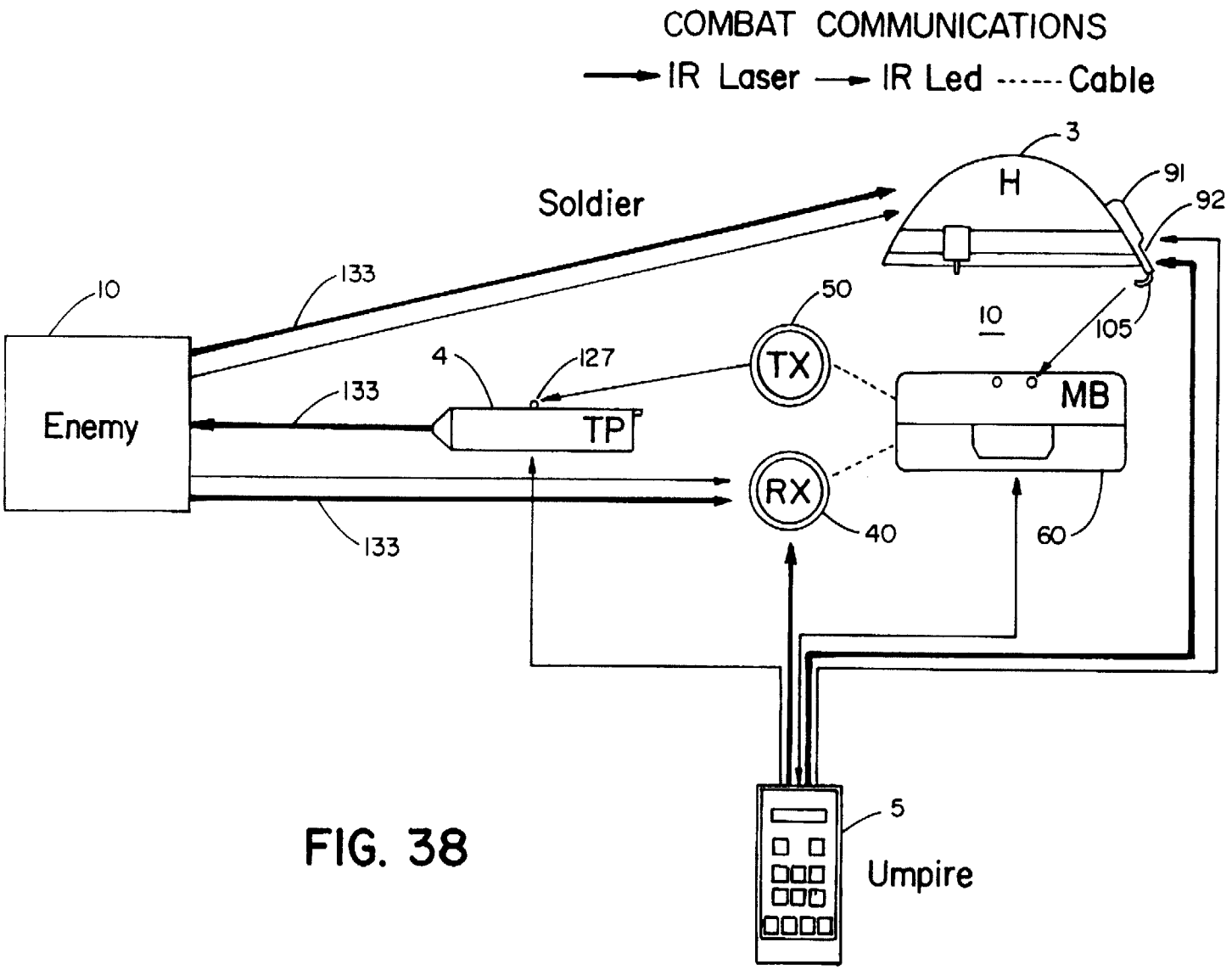
FIG. 38 is a schematic view of the invention with illustrated simulated combat communications paths.
Figure 39:
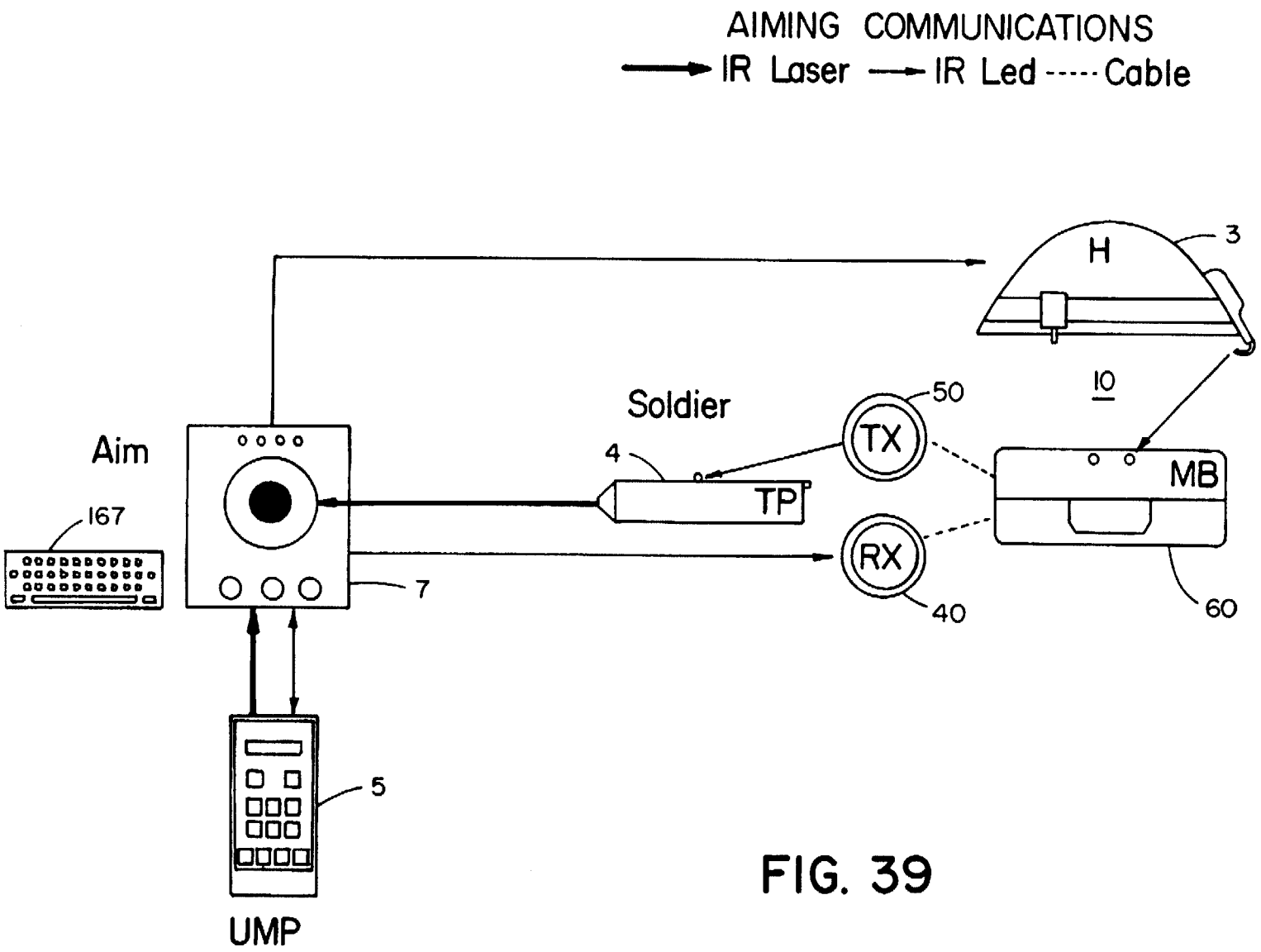
FIG. 39 is a schematic view of the invention with illustrated aiming communications paths.

The system 1 of the present invention contains a main central computer 6 which is of the PC class of computers. Communication by the various invention system components to the computer 6 is by means of an interface unit 201 which is connected to one of the main computer's parallel ports 200. See FIG. 36. The interface unit 201 has a main microprocessor 202 with memory 203, a reset function 204, and a direct connection 200 between the microprocessor 202 and main central computer 6. The microprocessor 202 directly drives a speaker unit 207 for audible signalling to a user. The interface unit 201 is powered by a battery pack 205 having the ability to be charged. The battery pack 205 may be remotely turned off and on by means of a receiver unit 206 adapted to receive a 3 MHz, 16 Bit, signal from the umpire unit 5. The microprocessor is directly connected to a high speed transmitter 208 and receiver 209 for transmission and reception of IRQ protocols at speeds of 1 MBit/second.

The invention system 1 is initialized with the name of the exercise and the time by the system main computer 6. The computer 6 will then generate the exercise number from an input exercise name. Using the computer interface 201, each umpire unit 6 is initialized individually with the time and exercise number. This makes it possible to synchronize all clocks precisely and facilitates an accurate analysis of maneuvers.

OPERATION

Figure 40:
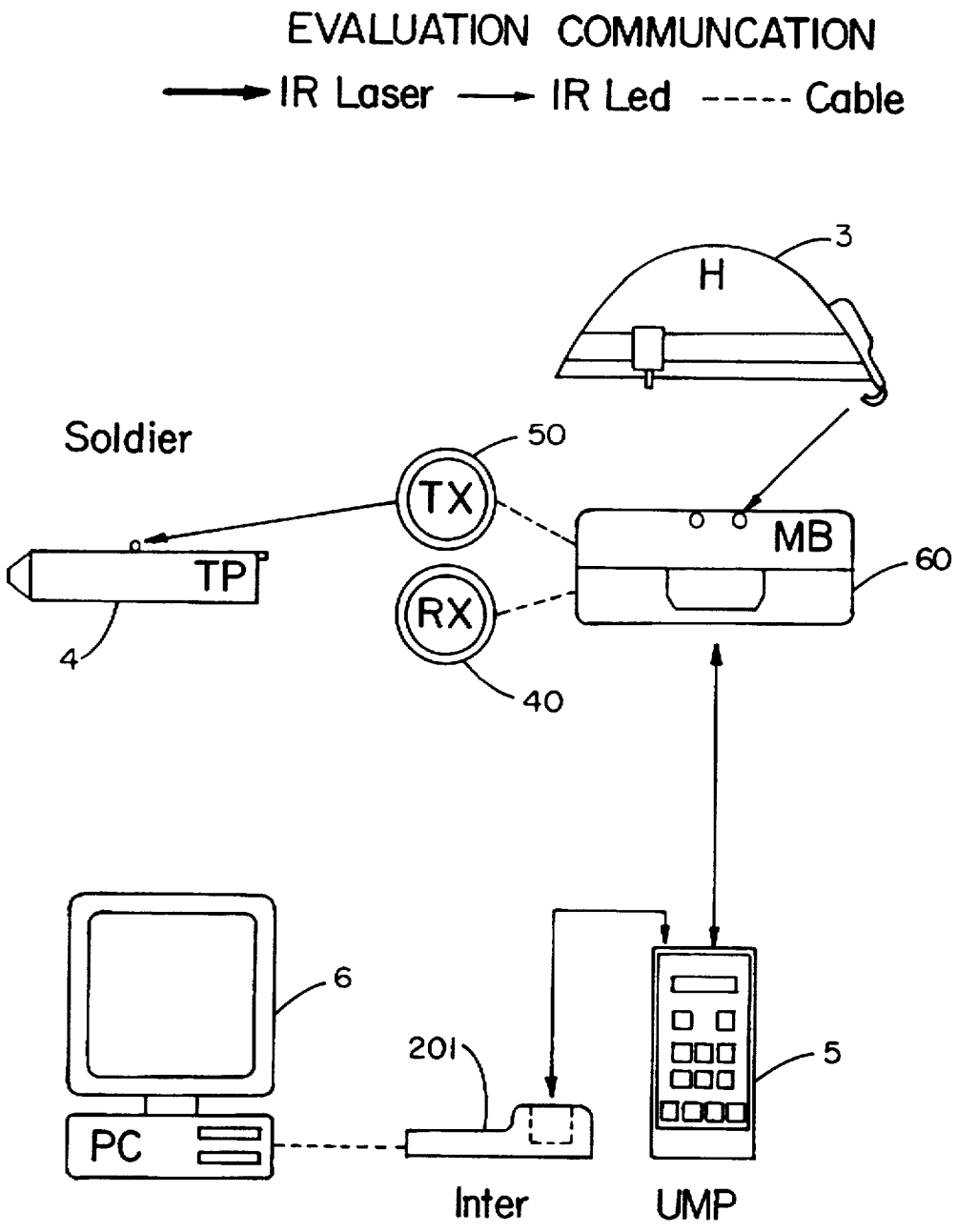
FIG. 40 is a schematic view of the invention with illustrated evaluation communications paths.

Referring more particularly to FIGS. 37–40, there are shown the communications channels between and among participants (FIG. 37), combat communications (FIG. 38), aiming communications (FIG. 39), and evaluation communications (FIG. 40). When maneuvers are ready to begin, an umpire activates the soldier-participant 10 with a signal from the umpire unit 5 or from the test box 8. Once activated, each soldier-participant's master box 60 monitors the events relating to the particular soldier-participant wearing a particular master box. The status of the master box 60 can be read at any time using the umpire unit 5. Status is transmitted from master box 60 to the umpire unit 5 using a coded infrared beam and the information is displayed on the built-in umpire unit LCD readout 141.

The helmet assembly 3 is in constant communication with the master box 60. If the soldier-participant 10 removes his helmet 17, the master box 60 will deactivate the laser target pointer 4 and the soldier-participant 10 will not be able to fire. Should the helmet assembly 3 be struck by an enemy laser beam 133, this information is transmitted to the master box 60. The helmet assembly 3 is turned on by an optical signal either from the umpire unit 5 or test box 8.

Using the umpire unit 5 the umpire can change the fighting status of a soldier-participant 10, i.e., deactivate a soldier, put a soldier on waiting status, or activate the soldier to fighting status. Furthermore, the umpire can determine the identity of the soldier-participant (including his name, unit and serial number), the last contact with the enemy that the soldier had, and his overall status (waiting, fighting, injured, etc.).

When the soldier-participant 10 "fires" his weapon 110, an infrared laser beam 133 is emitted. The laser beam 133 is emitted in the form of a train of microsecond pulses which contains: (a) a 16-bit soldier serial number in coded form, (b) a 4-bit weapon code, and (c) 3×32-bit GPS identification codes. Every shot is identified by the serial number of the soldier who shot it. Thus, credit (or blame) can be given where due.

The master box 60 has a record for its soldier-participant of every event, including information on who shot the soldier, where the soldier was hit, when the event occurred, and GPS information. The status of a particular soldier-participant can be read at any time using the umpire unit 5.

When a soldier-participant 10 is hit a loud acoustic signal may, as an option, be emitted by the master box 60. If the soldier-participant 10 suffers a direct hit, or is "killed", then the soldier-participant 10 will no longer be able to fire and must remain stationary. As stated above, a motion and angle sensor 75 is built into the master box 60. There are two optional modes to insure that the soldier-participant 10 is stationary. In one mode, a loud acoustic tone is emitted from the speaker 74 whenever the soldier-participant 10 moves. In the other mode a tone is emitted from the speaker 74 any time the soldier-participant 10 stands, so that he must remain laying on his back to keep the tone from emitting. The umpire can transmit a signal to the master box receiver 79 remotely neutralize the speaker 74 and soldier-participant 10 so that the soldier-participant 10 can move and remove himself from the active simulation field.

Typical data from a hypothetical exercise might resemble the following:

Event 5, SN=996
- time: 6:41
- shot status: NEAR MISS
- shot position: RIGHT SHOULDER
- shot by: SN=3984
- Status of 996 INJURED Event 6, SN=996
- time: 6:47
- shot status: HIT
- shot position: TORSO MIDDLE
- shot by: SN=33
- Status of 996 KILLED Following the end of the battlefield exercise, all soldier-participants are deactivated by the umpires and the data contained in the master box of each soldier-participant is read out by an umpire using an umpire unit 5. A master box 60 and umpire unit 5 communicate via infrared optical signals, no cables are required. The umpire unit 5 stores all the data of each soldier-participant 10 he has read. This data includes a list of each event for the soldier-participant 10 during the exercise (such as where he might have been shot, if and how he had been killed, when he had been activated, the status of the soldier's equipment, and GPS information) along with the time the event occurred.

Figure 41A:
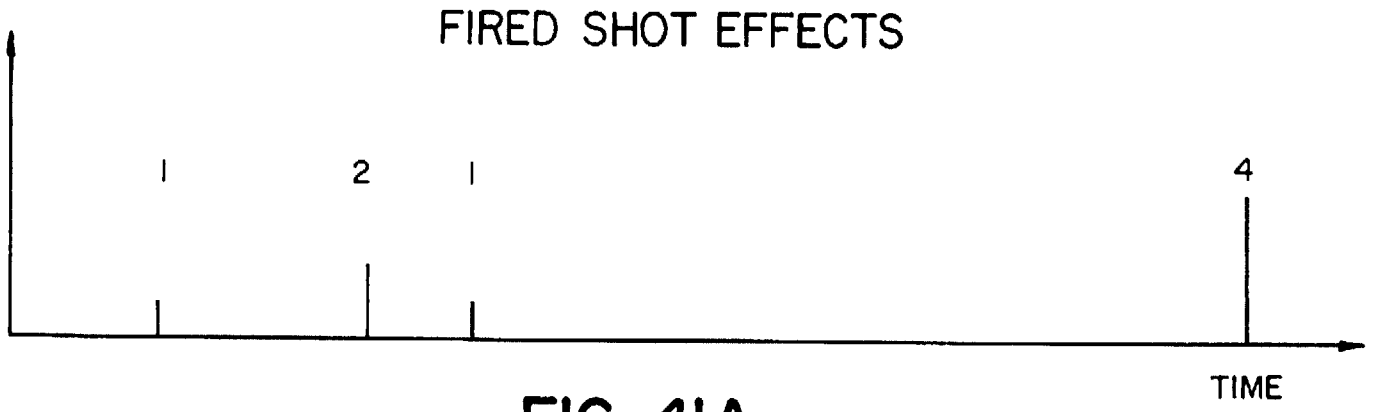
FIG. 41A is a soldier-participant activity diagram illustrating fired shot effects as a function of time.
Figure 41B:
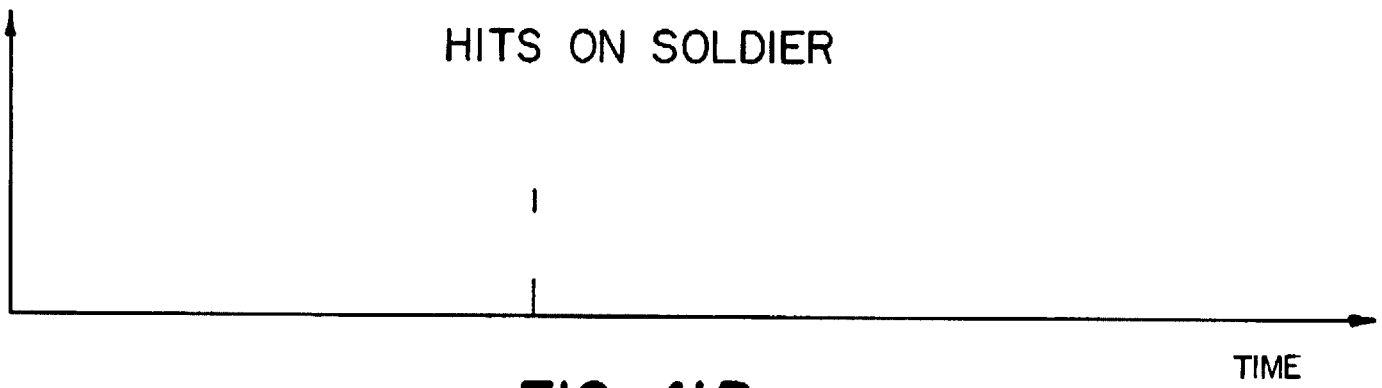
FIG. 41B is a soldier-participant activity diagram illustrating hits on a soldier-participant as a function of time.

Each umpire then proceeds to the system main computer 6 and the data of each soldier is transferred to the computer 6 using the PC interface 201. After all the umpires have finished transferring their data, the computer compiles a complete history of the exercise. The software in the computer allows one to view the entire exercise in chronological order, to study the efforts of individual soldiers, to compare various companies or units, or to receive a concise summary of all important data of the exercise. The standard software is menu driven and straight forward to use by any DOS computer. There also may be a soldier activity diagram to analyze each soldier individually. See FIGS. 41A and 41B, for example, which illustrate the number of shots fired versus time, and the actual hits on a soldier-participant.

All shots which strike the body will be detected and recorded. The effectiveness of each shot will be evaluated according to the location of the shot. For example, if the laser beam 133 strikes the detector 37 on the left arm or strikes near the detector 37 on the left arm, the system 1 will register an injury and the injured soldier-participant 10 will be able to fight on. See FIGS. 25A–25B. These conditions can be changed to meet particular demands. If the shot 133 strikes the soldier-participant 10 in the middle of the torso, then two or three detectors 33, 34, 35 may respond simultaneously. This will be registered as a direct hit and will be treated as a deadly injury. Any shot to the helmet assembly 3 will be registered as a direct hit. If a direct hit is registered, then the soldier-participant's laser target pointer 4 will be deactivated by an infrared signal from his master box 60. The laser target pointer LED 132 will turn red indicating that the soldier-participant 10 will no longer be able to fire. Only the umpire, using the umpire unit 5, can change a soldier-participant's status.

Exercises in the forest, in grass, in bushy areas, in rain and fog, in daylight and night-time are all possible because the laser beam 133 is not required to strike a sensor directly. A fraction 135 of the laser beam 133 falling somewhere on the body of the soldier-participant 10 is sufficient to activate a detector and be recorded. Indeed a ricochet can be simulated when the laser beam 133 strikes a wall; this can be registered as a hit by the system 1.

The present invention is a multiple purpose system. By using CW laser techniques, the system can be used for simulation with a modulated CW laser beam, for high volume data transfer applications, and for aiming purposes. The CW beam divergence of 0.5 mrad makes it possible to use the invention for all these applications. The high sensitivities of the system detectors make it possible to use a low divergence laser beam because the system sensors do not have to be directly hit - scattered light is good enough.

It is understood that the above-described embodiment is merely illustrative of the application. Other embodiments may be readily devised by those skilled in the art which will embody the principles of the invention and fall within the spirit and scope thereof.

I claim:

1. A continuous wave laser battlefield simulation system to be used by a plurality of soldier-participants, with helmets and weapons, and umpires in a simulation exercise, comprising:

a laser target pointer attached to each soldier-participant's weapon, comprising:

a housing with a mount for attachment to said soldier-participant's weapon;

a semiconductor continuous wave laser within said housing adapted to generate and transmit a beam of energy;

means within said housing for code modulating said continuous wave laser generated beam of energy;

a triggering mechanism for activating and deactivating said continuous wave laser generated beam of energy;

a plurality of communications means for providing modulating codes for said means for code modulating said continuous wave laser generated beam of energy; and a power supply mounted within said housing and electrically connected to said means for code modulating and transmission of a continuous wave laser generated beam of energy, continuous wave laser generated beam triggering mechanism, and plurality of communications means;

a torso assembly worn by each soldier-participant, said torso assembly being comprised of:

a soldier-participant torso harness;

a master box attached to said torso harness, said master box having communications means and processing means;

a plurality of torso detectors attached to said harness and electrically connected to said master box communications means and processing means, said torso detectors being adapted to sense the modulated, continuous wave laser generated beam of energy from a soldier-participant's laser target pointer; and a plurality of transmitter units attached to said harness and electrically connected to said master box communications means and processing means;

said master box communications means being adapted to receive from said torso detectors a code contained in a sensed modulated, continuous wave laser generated beam of energy, said master box processing means being adapted to process and store said code;

said master box communications means and processing means being adapted to communicate through said transmitter units to the communications means of the laser target pointer of the soldier-participant wearing said torso assembly a coded signal for modulating said laser target pointer continuous wave laser generated beam of energy;

a power supply mounted within said and electrically connected to said master box, master box communications means, master box processing means, plurality of torso detectors and plurality of transmitter units;

a helmet assembly attached to the helmet of each soldier-participant, said helmet assembly being comprised of:

a belt encircling and attached to said helmet;

a helmet master box attached to said belt, said helmet master box having communications means and processing means;

a plurality of helmet detectors attached to said belt and electrically connected to said helmet master box communications means and processing means, said helmet detectors being adapted to sense a modulated, continuous wave laser generated beam of energy from a soldier-participant's laser target pointer;

transmission means attached to said helmet master box communications means and processing means;

said helmet master box being adapted to communicate through said transmission means with the torso assembly master box communications means of the soldier-participant wearing said helmet assembly, a code contained in a sensed modulated, continuous wave laser generated beam of energy; and a power supply attached to said belt and electrically connected to said helmet master box communications means, processing means, helmet detectors and transmission means;

an umpire unit carried by each umpire, said umpire unit being comprised of:

a housing;

processing means within said housing;

a display mounted on said housing and electrically connected to said processing means;

a keyboard mounted on said housing and electrically attached to said processing means;

a communications subsystem mounted on said housing and electrically connected to said processing means;

said processing means being adapted to communicate through said communications subsystem with the communications means of the master box of a soldier-participant and transmit operating codes and receive processed and stored codes from a master box; and a power supply mounted within said housing and electrically connected to said processing means, display and communications subsystem; and a system computer with an interface unit and maneuver evaluation software, wherein said umpire unit communicates through said communications subsystem with the interface unit to the system computer and its maneuver evaluation software processed and stored codes from said master boxes.

2. A continuous wave laser battlefield simulation system, as recited in claim 1, further comprising:

an aiming tool for alignment of a soldier-participant's weapon with said laser target pointer mounted thereon, comprising:

a console;

a positioning sensing screen mounted on said console;

processing means within said console;

transmission means for communicating with said soldier-participant's master box and said umpire communications subsystem electrically connected to said console processing means;

receiving means for communicating with said umpire communications subsystem electrically connected to said console processing means;

a power supply mounted within said console and electrically connected to said positioning sensing screen, processing means, transmission means, and receiving means;

a keyboard unit electrically connected to said console processing means.

3. A continuous wave laser battlefield simulation system, as recited in claim 2, further comprising:

a test box comprised of:

a hand held console;

processing means within said console;

a keyboard mounted on said console and electrically attached to said processing means;

a communications subsystem mounted on said housing and electrically connected to said processing means;

said processing means being adapted to transmit test codes and communicate through said communications subsystem with the communications means of the master box, laser target pointer, and torso and helmet detectors of a soldier-participant; and a power supply mounted within said housing and electrically connected to said processing means and communications subsystem.

4. A continuous wave laser battlefield simulation system, as recited in claim 3, further comprising:

means for tracking the position of a soldier-participant employing global positioning system (GPS) satellites, wherein said means is comprised of:

a GPS antenna for receiving signals provided by a plurality of GPS satellites, said antenna being mounted on the torso harness of a soldier-participant;

a GPS receiver connected to said soldier-participant's master box processing means and electrically connected to said GPS antenna, wherein said GPS receive is adapted for receiving signals comprising selected raw satellites measurements; and wherein said master box processing means is adapted for periodically receiving and storing said raw satellites measurements and computing therefrom position information relative to said soldier-participant.

5. A continuous wave laser battlefield simulation system, as recited in claim 4, wherein each said master box is comprised of:

a housing attached to said torso harness;

said master box processing means within said housing;

a number matrix within said housing adapted to provide said processing means with a coded permanent serial number unique to said master box;

a clock within said housing connected to said processing means and synchronized with said umpire unit;

an external random access memory (RAM) within said housing and connected to said processing means, said RAM adapted to hold information concerning the identity of a soldier-participant wearing the torso assembly containing said master box, initial data concerning said simulation exercise, and a complete record of all events which occur to said soldier-participant during said simulation exercise;

a plurality of LEDs mounted on said master box housing and electrically connected to said processing means, said LEDs being adapted to indicate the status of various functions;

a speaker alarm mounted on said master box housing and electrically connected to said processing means, said speaker alarm adapted to sound upon the occurrence of certain designated events;

a motion and angle sensor electrically connected to said processing means, said sensor being activated upon the occurrence of certain events determined by said processing means; and an RS-232 interface port mounted on said housing and electrically connected to said processing means.

6. A continuous wave laser battlefield simulation system, as recited in claim 5, wherein said master box communications means includes:

a high speed, high powered, pulsed light emitting diode (LED) transmitter and high speed receiver for high speed data transfers with said umpire unit, both of which are mounted on said master box housing and electrically connected to said processing means;

a receiver within said master box housing electrically interconnecting said torso detectors by means of an electrical cable in said torso harness to said processing means;

a receiver mounted on said master box housing and electrically connected to said processing means and adapted to receive transmissions from said helmet transmission means;

a receiver mounted on said master box housing and electrically connected to said processing means and adapted to receive transmissions from said umpire unit; and a high speed, high powered, pulsed LED receiver mounted on said master box housing and electrically connected to said processing means, said receiver adapted for communication with an umpire unit.

7. A continuous wave laser battlefield simulation system, as recited in claim 6, wherein:

said laser target pointer has a front end and a rear end defining a longitudinal axis parallel to the longitudinal axis of the weapon to which the laser target pointer is mounted, said laser target pointer being divided into front, middle and back sections, said front section containing said semiconductor continuous wave laser adapted to generate a beam of energy, and horizontal and vertical adjustment means, said middle section containing said means for code modulating, means for activating and deactivating said beam of energy, and said back section containing said power supply.

8. A continuous wave laser battlefield simulation system, as recited in claim 7, wherein said means for code modulating, means for activating and deactivating said beam of energy includes:

a microprocessor;

a trigger detector interconnecting said microprocessor with said triggering mechanism;

a laser driver electrically interconnecting said microprocessor with said semiconductor continuous wave laser;

two laser target pointer communications means receivers mounted on said housing section middle said receivers being electrically connected to said microprocessor, one of said receivers being adapted to receive instructions and data from the torso assembly master box on the torso assembly worn by the soldier-participant to whose weapon said laser target pointer is attached, the other of said receivers being adapted to receive instructions and data from an umpire unit and test box;

wherein said microprocessor is adapted to process signals from said receivers, to generate a resulting pulse coded signal from said processed received signals, to generate a laser firing signal in response to said triggering mechanism, and to transmit said firing signal and said pulse coded signal through said laser driver to said semiconductor continuous wave laser.

9. A continuous wave laser battlefield simulation system, as recited in claim 8, wherein:

said laser target pointer semiconductor continuous wave laser generates a modulated beam of energy with a superimposed pulse coded signal when the weapon with said laser target pointer mounted thereon is aimed at another soldier-participant and said triggering mechanism activated.

10. A continuous wave laser battlefield simulation system, as recited in claim 9, wherein:

said beam of energy has a wavelength in the 780 nanometer to 2 micrometer range.

11. A continuous wave laser battlefield simulation system, as recited in claim 10, wherein:

said beam of energy has a divergence not exceeding 0.5 millirad and an effective range from 0 to 6 miles.

12. A continuous wave laser battlefield simulation system, as recited in claim 11, wherein:

said laser target pointer has a plurality of LEDs mounted on said laser target pointer housing and electrically connected to said microprocessor, said LEDs being adapted to indicate the status of various designated functions.

13. A continuous wave laser battlefield simulation system, as recited in claim 12, wherein said torso harness is comprised of:

two suspenders positioned over the shoulders of a soldier-participant, said suspenders engaging a waist belt worn by said soldier-participant, each said suspender beginning at the waist belt portion on the soldier-participant's front and terminating at the waist belt portion on the soldier-participant's lower back, said suspenders being further engaged by two horizontal support straps, one interconnecting the suspenders across the soldier-participant's chest and the other interconnecting the suspenders across the soldier-participant's upper back;

two upper arm bands, each one fitted over an upper arm of the soldier-participant, each said upper arm band being connected by means of a connecting strap to the nearest suspender at the soldier-participant's shoulder.

14. A continuous wave laser battlefield simulation system, as recited in claim 13, wherein each said torso detector is comprised of:

a microprocessor;

a detection circuit comprised of a detector component, an amplifier connected to said detector component and an integrator filter interconnecting said amplifier with said microprocessor, whereby said detector component is adapted to detect a continuous wave laser generated beam of energy and generate an output which is passed to said amplifier, through said integrator filter into said microprocessor;

a frequency sensitive tank circuit comprised of a capacitor and coil, electrically connected to said microprocessor in parallel to said detection circuit; and electrical means for connecting said microprocessor to said torso assembly master box.

15. A continuous wave laser battlefield simulation system, as recited in claim 14, wherein:

each said torso detector microprocessor is adapted to respond to designated pulse coded signals superimposed on said laser target pointer generated modulated beam of energy, thereby filtering out extraneous signals and noise.

16. A continuous wave laser battlefield simulation system, as recited in claim 15, wherein said plurality of torso detectors are comprised of:

seven detectors attached to said torso harness, a first detector being centrally attached to the front horizontal support strap, a second detector being attached to the right suspender near to a front junction of right suspender and the waist belt, a third detector being attached to the left suspender near to a front junction of left suspender and the waist belt, a fourth detector being attached to the right connecting strap near to the right upper arm band, a fifth detector being attached to the left connecting strap near to the left upper arm band, a sixth detector being attached to the right suspender near to a back junction of the right suspender and the waist belt, a seventh detector being attached to the left suspender near to a back junction of the left suspender and the waist belt; and one detector mounted on said master box.

17. A continuous wave laser battlefield simulation system, as recited in claim 16, wherein:

one of said torso assembly transmitter units is attached to a junction of the front horizontal support strap and the left suspender, and the other of said torso assembly transmitter units is attached to a junction of the right connecting strap and the right suspender, each said transmitter units being electrically connected by means of a cable attached to said torso harness master box, wherein said transmitters are adapted to simultaneously transmit a coded signal from said master box.

18. A continuous wave laser battlefield simulation system, as recited in claim 17, wherein:

said helmet master box is comprised of a housing attached to said helmet assembly belt, a microprocessor contained within said housing, an EEPROM contained within said housing electrically connected to said microprocessor, said EEPROM being adapted to store data even when energy from said power supply is interrupted;

said plurality of helmet detectors are comprised of two master detectors having built in microprocessors controlled by said helmet master box microprocessor, each said master detector electrically connected to and controlling a slave detector located at various positions on the helmet belt, said master detectors being adapted to recognize a continuous wave laser generated beam of energy and generate an output which is passed to said helmet master box.

19. A continuous wave laser battlefield simulation system, as recited in claim 18, wherein:

each said helmet detector microprocessor is adapted to respond to designated pulse coded signals superimposed on said laser target pointer generated modulated beam of energy, thereby filtering out extraneous signals and noise.

20. A continuous wave laser battlefield simulation system, as recited in claim 19, wherein:

said processed codes received by said umpire unit from the master box of a soldier-participant includes a list of each event experienced by the soldier-participant during the said simulation exercise along with the time the event occurred, where the soldier-participant may have been shot, if and how he had been "killed", when he had been activated, the status of the soldier-participant's equipment, and also a soldier-participant's GPS position.

21. A continuous wave laser battlefield simulation system, as recited in claim 20, wherein:

said umpire unit housing is a small, hand-held, rectangular console adapted to being held and operated by personnel designated as umpires for the simulation exercise;

said umpire unit communications subsystem contains a high speed transceiver for high volume data transfer to and from a soldier-participant's master box high speed transmitter and receiver, said aiming tool receiving means, and said system computer interface unit;

said umpire unit communications subsystem also contains a transmitter which transmits code to the master box receiver and laser target pointer receiver, said code being adapted as an "on/off" command, a query as to a soldier-participant's name, injury, status, and who shot the soldier-participant, and to change the laser target pointer mode of operation from simulation to continuous laser transmission for aiming or demonstration purposes; and said umpire unit communications subsystem contains a third transmitter which has the same function as a soldier-participant's laser target pointer.

22. A continuous wave laser battlefield simulation system, as recited in claim 21, wherein:

said positioning sensing screen incorporates a plurality of positioning sensing detectors and LEDs about the screen, said LEDs being adapted to show in which quadrant the laser beam of energy has hit the detector screen.

23. A continuous wave laser battlefield simulation system, as recited in claim 22, wherein:

each said position sensing detector has four connectors and a ground, each said connector being electrically connected to a preamplifier and an analog computer, wherein upon the laser beam of energy striking the detector's surface, an analog current is generated on each of said connectors, the amount of each current being in proportion to the strike position of said laser beam of energy, said analog computer adapted to calculate and convert the intensity of the current measured along each connector to an exact point where the laser beam hit the detector surface;

said analog computer is connected to an analog-to-digital converter, said analog-to-digital converter being connected to said an aiming tool microprocessor, wherein said microprocessor converts said exact point into "X" and "Y" coordinates, said microprocessor adapted to instruct said keyboard unit to present on said display the amount of horizontal and vertical adjustments needed to zero the laser beam.

24. A continuous wave laser battlefield simulation system, as recited in claim 23, wherein:

said two torso assembly transmitter units are high powered, pulsed, light emitting diodes (LEDs).

25. A continuous wave laser battlefield simulation system, as recited in claim 24, wherein:

said helmet assembly transmission means contains a high powered, pulsed, light emitting diode (LED) transmitter.

26. A continuous wave laser battlefield simulation system, as recited in claim 25, wherein:

said umpire unit communications subsystem contains of a plurality of high powered, pulsed, light emitting diode (LED) transmitters.

27. A continuous wave laser battlefield simulation system, as recited in claim 26, wherein:

said test box communications subsystem contains a plurality of high powered, pulsed, light emitting diode (LED) transmitters.

28. A continuous wave laser battlefield simulation system, as recited in claim 27, wherein:

said aiming tool transmission means contains a plurality of high powered, pulsed, light emitting diode (LED) transmitters.

29. A continuous wave laser battlefield simulation system, as recited in claim 28, wherein:

said master box communications means contains a plurality of high powered, pulsed, light emitting diode (LED) transmitters.

* * * * *